US011648778B2

(12) United States Patent
Kanegae et al.

(10) Patent No.: US 11,648,778 B2
(45) Date of Patent: May 16, 2023

(54) LIQUID EJECTING HEAD AND LIQUID EJECTING APPARATUS

(71) Applicant: Seiko Epson Corporation, Tokyo (JP)

(72) Inventors: Takahiro Kanegae, Shiojiri (JP); Katsuhiro Okubo, Azumino (JP); Hiroyuki Hagiwara, Matsumoto (JP); Nobuaki Ito, Shiojiri (JP); Shun Katsuie, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/387,685

(22) Filed: Jul. 28, 2021

(65) Prior Publication Data

US 2022/0032640 A1 Feb. 3, 2022

(30) Foreign Application Priority Data

Jul. 31, 2020 (JP) ..... JP2020-131017

(51) Int. Cl.

| | |
|---|---|
| ***B41J 2/175*** | (2006.01) |
| ***B41J 2/18*** | (2006.01) |
| ***B41J 2/14*** | (2006.01) |
| *B41J 2/155* | (2006.01) |

(52) U.S. Cl.

CPC ..... *B41J 2/17563* (2013.01); *B41J 2/18* (2013.01); *B41J 2/14233* (2013.01); *B41J 2/155* (2013.01); *B41J 2002/14403* (2013.01); *B41J 2202/12* (2013.01); *B41J 2202/20* (2013.01)

(58) Field of Classification Search

CPC ..... B41J 2/17563; B41J 2/18; B41J 2/14233; B41J 2/155; B41J 2002/14403; B41J 2202/12; B41J 2202/20

See application file for complete search history.

(56) References Cited

U.S. PATENT DOCUMENTS

| | | | | |
|---|---|---|---|---|
| 10,144,218 | B2 * | 12/2018 | Takino | B41J 2/17563 |
| 2020/0101733 | A1 | 4/2020 | Hagiwara et al. | |
| 2020/0282721 | A1 | 9/2020 | Hagiwara et al. | |
| 2020/0282724 | A1 | 9/2020 | Okubo et al. | |

FOREIGN PATENT DOCUMENTS

| | | |
|---|---|---|
| JP | 2016-196169 | 11/2016 |
| JP | 2020-049874 | 4/2020 |
| JP | 2020-142378 | 9/2020 |
| JP | 2020-142379 | 9/2020 |

* cited by examiner

*Primary Examiner* — Geoffrey S Mruk

(74) *Attorney, Agent, or Firm* — Workman Nydegger

(57) ABSTRACT

There is provided a liquid ejecting head including: first and second nozzle rows extending in a first direction; a first supply flow path; a first filter chamber having a first inlet; and a second filter chamber having a second inlet, in which the first and second nozzle rows are shifted from each other in both the first direction and a second direction orthogonal to the first direction, the first supply flow path has a branch flow path for distributing the liquid between the first filter chamber and the second filter chamber at a branch position, the branch position is disposed between the first filter chamber and the second filter chamber in a plan view, and the first and second inlets are disposed at a part where the first filter chamber and the second filter chamber overlap each other when viewed in the second direction.

14 Claims, 22 Drawing Sheets

LIQUID EJECTING HEAD AND LIQUID EJECTING APPARATUS

The present application is based on, and claims priority from JP Application Serial Number 2020-131017, filed Jul. 31, 2020, the disclosure of which is hereby incorporated by reference herein in its entirety.

BACKGROUND

1. Technical Field

The present disclosure relates to a liquid ejecting head and a liquid ejecting apparatus for ejecting a liquid from a nozzle, particularly to an ink jet type recording head and an ink jet type recording apparatus for ejecting ink as a liquid.

2. Related Art

A liquid ejecting apparatus represented by an ink jet type recording apparatus, such as an ink jet type printer or plotter, includes a liquid ejecting head that is capable of ejecting a liquid, such as ink stored in a cartridge, a tank or the like, as liquid droplets.

In such a liquid ejecting head, it is difficult to elongate the nozzle (increase the number of nozzles) or to increase the density by itself, because the liquid ejecting head becomes large, the yield deteriorates, and the manufacturing cost becomes expensive. Therefore, a liquid ejecting head in which a nozzle is elongated by fixing a plurality of head chips for ejecting liquid to a common flow path member, was proposed.

In the liquid ejecting head, the head chips are disposed to be offset from each other in an extending direction of a nozzle row, and a filter chamber is provided corresponding to each head chip (for example, refer to JP-A-2020-49874).

However, since there is a difference in the flow path length from the position of the introduction port where the liquid is supplied to each filter chamber, there is a problem that variation in the pressure loss occurs between the nozzle rows of the same series of head chips, the variation in the discharge characteristics of the liquid droplets occurs, and there is a concern that the print quality deteriorates.

Such a problem is not limited to the ink jet type recording head, and also exists in a liquid ejecting head that ejects the liquid other than ink.

SUMMARY

According to an aspect of the present disclosure, there is provided a liquid ejecting head including: a first nozzle row extending in a first direction; a second nozzle row extending in the first direction; a first supply flow path for supplying a liquid to the first nozzle row and the second nozzle row; a first filter chamber, which has a first inlet through which the liquid flows in from the first supply flow path, and in which the liquid to be supplied from the first supply flow path to the first nozzle row flows; and a second filter chamber, which has a second inlet through which the liquid flows in from the first supply flow path, and in which the liquid to be supplied from the first supply flow path to the second nozzle row flows, in which the first nozzle row and the second nozzle row are disposed to be offset from each other in both the first direction and a second direction orthogonal to the first direction, the first nozzle row ejects the liquid in a third direction orthogonal to the first direction and the second direction, the first supply flow path has a branch flow path for distributing the liquid between the first filter chamber and the second filter chamber at a branch position, the branch position is disposed between the first filter chamber and the second filter chamber in a plan view when viewed in the third direction, the first filter chamber and the second filter chamber are disposed so as to at least partially overlap each other when viewed in the second direction, and the first inlet and the second inlet are disposed at a part where the first filter chamber and the second filter chamber overlap each other when viewed in the second direction.

According to another aspect of the present disclosure, there is provided a liquid ejecting apparatus including: the liquid ejecting head according to the above-described aspect; and a transport section that transports a medium.

DESCRIPTION OF EXEMPLARY EMBODIMENTS

Figure 1:
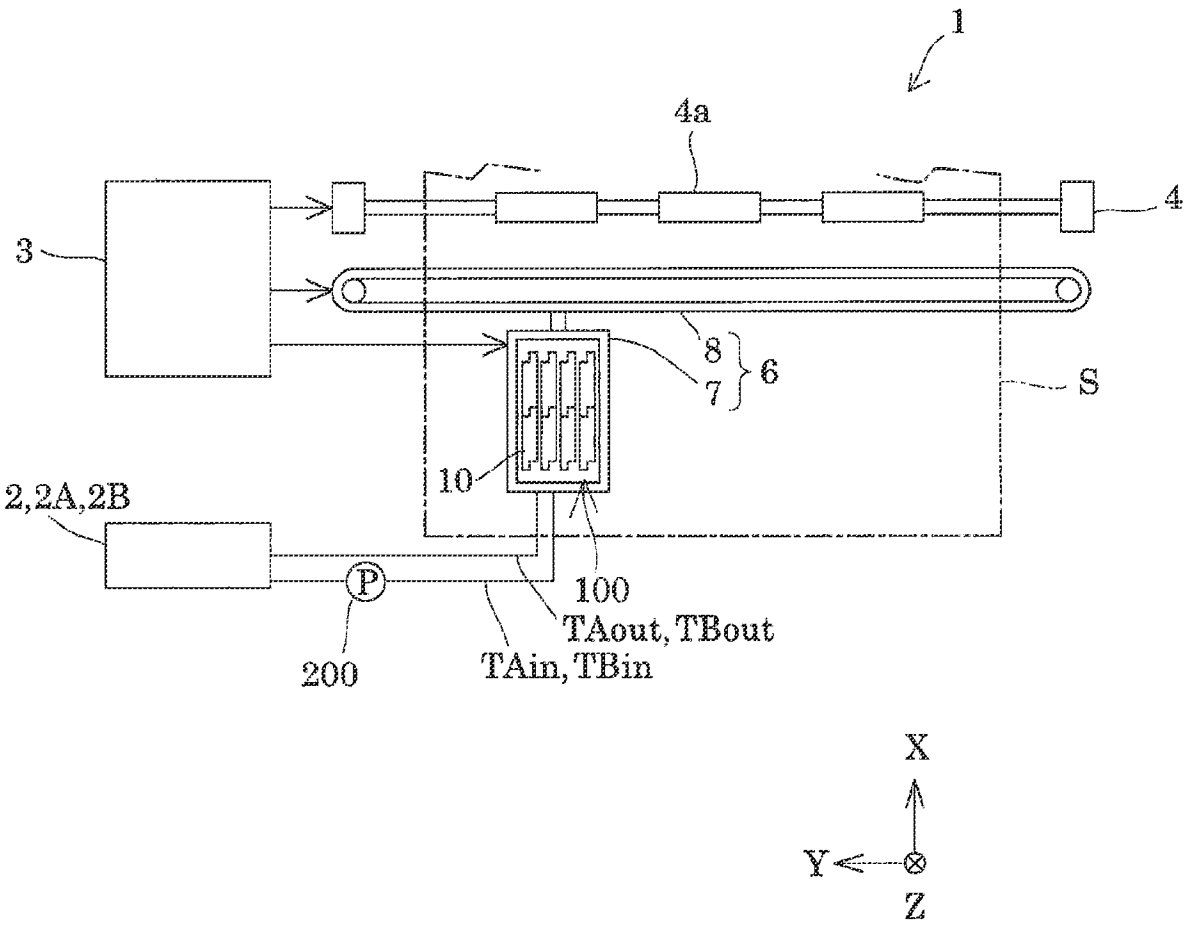
FIG. 1 is a view schematically illustrating a schematic configuration of a recording apparatus.

Hereinafter, the present disclosure will be described in detail based on embodiments. However, the following description shows one aspect of the present disclosure, and can be changed in any manner within the scope of the present disclosure. Those having the same reference numerals in each drawing indicate the same members, and the description thereof will be omitted as appropriate. In each of the drawings, X, Y, and Z represent three spatial axes orthogonal to each other. In the present specification, the directions along these axes are the X direction, the Y direction, and the Z direction. The direction in which the arrows in each drawing are oriented is described as the positive (+) direction, and the opposite direction of the arrows is described as the negative (−) direction. The Z direction indicates a vertical direction, the +Z direction indicates a vertically downward direction, and the −Z direction indicates a vertically upward direction. Furthermore, the three spatial axes X, Y, and Z, which do not limit the positive direction and the negative direction, will be described as an X-axis, a Y-axis, and a Z-axis. In the following Embodiment 1, as an example, the "first direction" is the +X direction, the "second direction" is the +Y direction, and the "third direction" is the +Z direction.

Embodiment 1

FIG. 1 is a view illustrating a schematic configuration of an ink jet type recording apparatus 1 which is an example of a "liquid ejecting apparatus" according to Embodiment 1 of the present disclosure.

As illustrated in FIG. 1, the ink jet type recording apparatus 1 which is an example of the liquid ejecting apparatus is a printing apparatus that performs printing of an image or the like by arranging dots formed on a medium S by ejecting and landing ink, which is a type of liquid, as ink droplets on the medium S, such as a printing paper sheet. As the medium S, any material such as a resin film or cloth can be used in addition to a recording paper sheet.

The ink jet type recording apparatus 1 includes a head module 100 including an ink jet type recording head 10 (hereinafter, also simply referred to as a recording head 10) which is an example of a "liquid ejecting head", a liquid container 2, a control unit 3 which is a control section, a transport mechanism 4 for sending out the medium S, and a moving mechanism 6.

The liquid container 2 individually stores a plurality of types (for example, a plurality of colors) of ink ejected from the head module 100. Examples of the liquid container 2 include a cartridge that can be attached to and detached from the ink jet type recording apparatus 1, a bag-like ink pack formed of a flexible film, an ink tank that can be refilled with ink, and the like. Although not particularly illustrated, a plurality of types of ink having different colors or types are stored in the liquid container 2.

Although not particularly illustrated, the control unit 3 includes, for example, a control apparatus such as a central processing unit (CPU) or a field programmable gate array (FPGA) and a storage apparatus such as a semiconductor memory. The control unit 3 comprehensively controls each element of the ink jet type recording apparatus 1, that is, the transport mechanism 4, the moving mechanism 6, the head module 100, and the like by executing the program stored in the storage apparatus by the control apparatus.

The transport mechanism 4 is an example of the "transport section" controlled by the control unit 3 to transport the medium S in the −X direction or +X direction, and has, for example, a transport roller 4*a*. The transport mechanism 4 that transports the medium S is not limited to the transport roller 4*a*, and may transport the medium S by a belt or a drum.

The moving mechanism 6 is controlled by the control unit 3 to reciprocate the head module 100 in the +Y direction and the −Y direction along the Y-axis. The +Y direction and the −Y direction in which the head module 100 reciprocates by the moving mechanism 6 are directions intersecting with the −X direction or the +X direction in which the medium S is transported.

The moving mechanism 6 of the present embodiment includes a transport body 7 and a transport belt 8. The transport body 7 is a substantially box-shaped structure for accommodating the head module 100, a so-called carriage, and is fixed to the transport belt 8. The transport belt 8 is an endless belt erected along the Y-axis. The rotation of the transport belt 8 under the control of the control unit 3 causes the head module 100 to reciprocate together with the transport body 7 in the +Y direction and the −Y direction along the Y-axis. It is also possible to mount the liquid container 2 on the transport body 7 together with the head module 100.

In the present embodiment, two liquid containers 2 are provided, and ink is supplied from the two liquid containers 2 to one recording head 10. In FIG. 1, the plurality of liquid containers 2 are collectively illustrated as one. The two liquid containers 2 corresponding to one recording head 10 are referred to as a liquid container 2A and a liquid container 2B, respectively. A supply tube TAin and a discharge tube TAout are coupled to the liquid container 2A. A supply tube TBin and a discharge tube TBout are coupled to the liquid container 2B. The supply tube TAin, the discharge tube TAout, the supply tube TBin, and the discharge tube TBout are also collectively referred to as a tube.

The supply tube TAin and the supply tube TBin are tubes that supply the ink of the liquid container 2A and the liquid container 2B, which is set to have a predetermined pressure by a pump 200, to the recording head 10. The discharge tube TAout and the discharge tube TBout are tubes that discharge the ink discharged from the recording head 10 to the liquid container 2A and the liquid container 2B.

The liquid container 2A, the liquid container 2B, and the above-described tube are provided for each recording head 10.

The recording head 10 ejects the ink supplied from the liquid container 2 onto the medium S as ink droplets, which are liquid droplets, under the control of the control unit 3. The ink droplets are ejected from the recording head 10 in the +Z direction. When the medium S is transported in the −X direction or the +X direction by the transport mechanism 4 and the recording head 10 is transported along the Y-axis by the moving mechanism 6, the recording head 10 ejects ink droplets onto the medium S, and accordingly, a desired image is formed on the medium S.

Figure 2:
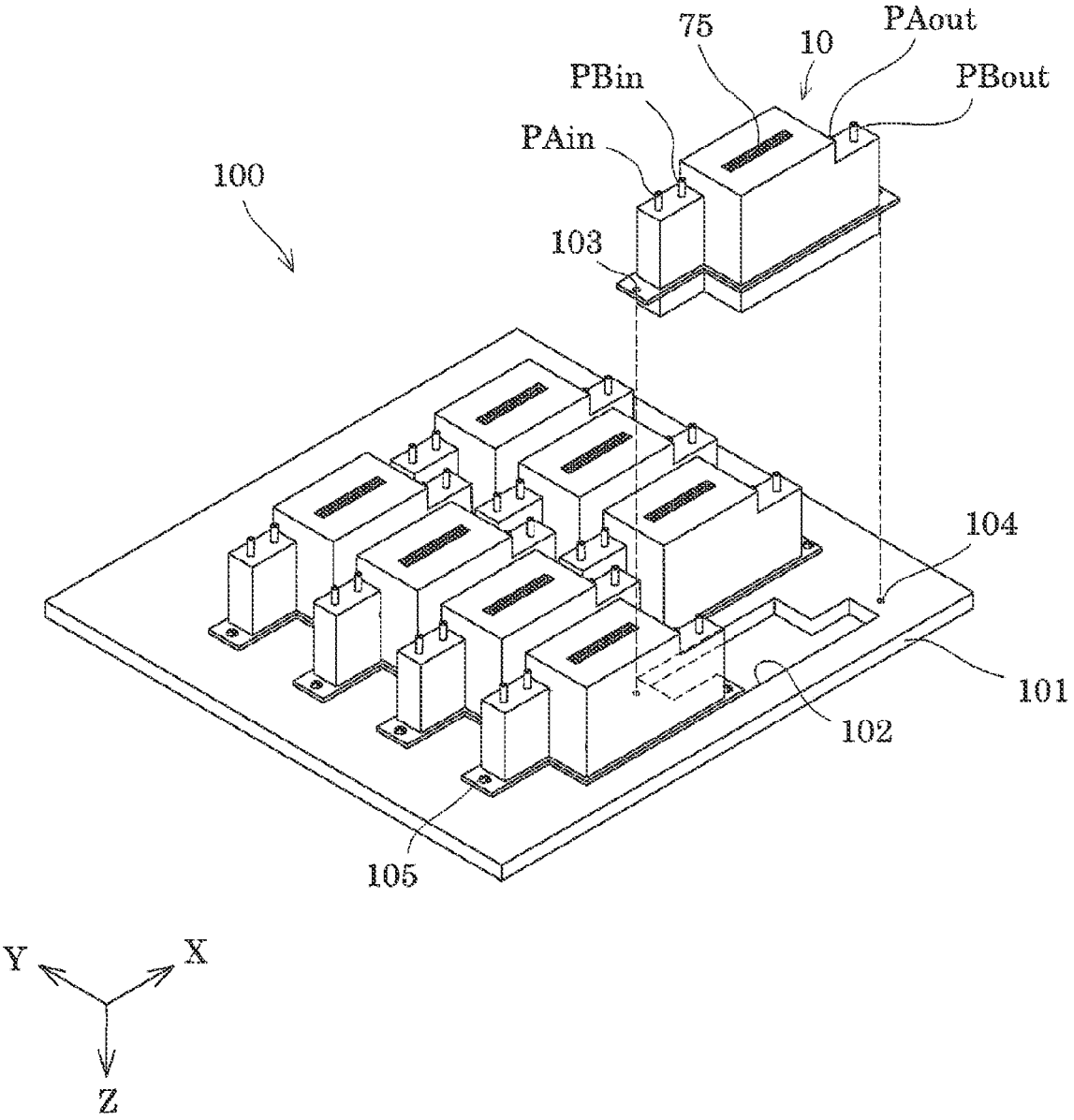
FIG. 2 is an exploded perspective view of a head module.
Figure 3:
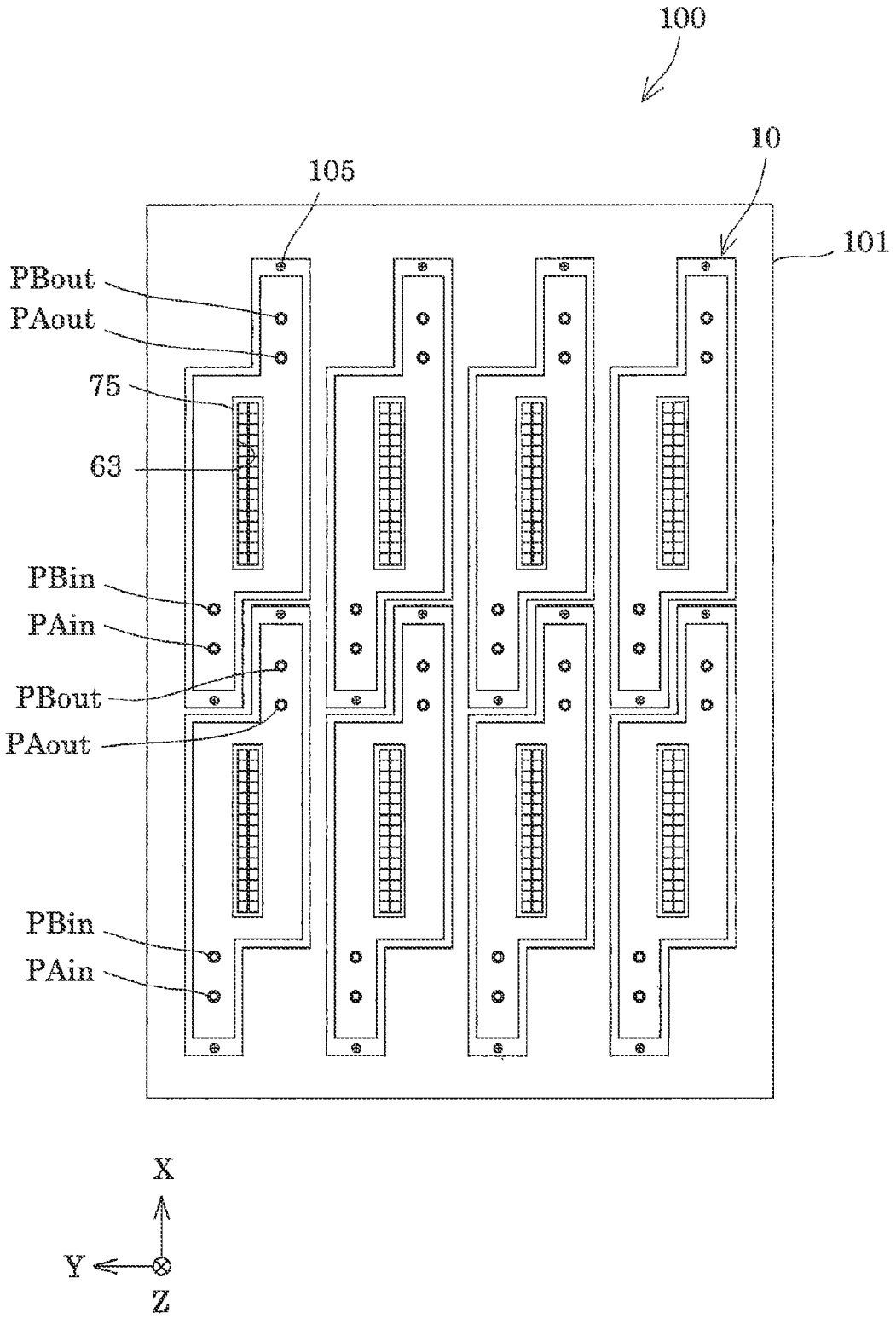
FIG. 3 is a plan view of the head module.

The head module 100 will be described in detail with reference to FIGS. 2 and 3. FIG. 2 is an exploded perspective view of the head module 100 according to the present embodiment. FIG. 3 is a plan view of the head module 100.

The head module 100 includes a support 101 and a plurality of recording heads 10. The support 101 is a plate-shaped member that supports a plurality of recording heads 10. The support 101 is provided with a support hole 102 for holding each recording head 10. In the present embodiment, the support holes 102 are provided independently for each recording head 10. It is needless to say that the support holes 102 may be continuously provided over the plurality of recording heads 10.

The recording head 10 is inserted through the support hole 102, and a flange section 35 (refer to FIG. 4) of the recording head 10 described later is supported by the peripheral edge portion of the support hole 102. The head chip 44 (refer to FIG. 6) side of the recording head 10 protrudes from the surface of the support 101 on the +Z direction side.

Each recording head 10 is provided with fixing ports 103 at both end portions in the +X direction and the −X direction.

The support 101 is provided with a screw hole 104 for fixing each recording head 10. Each recording head 10 is fixed to the support 101 by screwing a screw 105 into the screw hole 104 through the fixing port 103.

In the present embodiment, a total of eight recording heads 10 including two along the X-axis and four along the Y-axis, are fixed to the support 101. Each recording head 10 is disposed such that the parallel direction of nozzles N, which will be described later, matches the X-axis.

Figure 4:
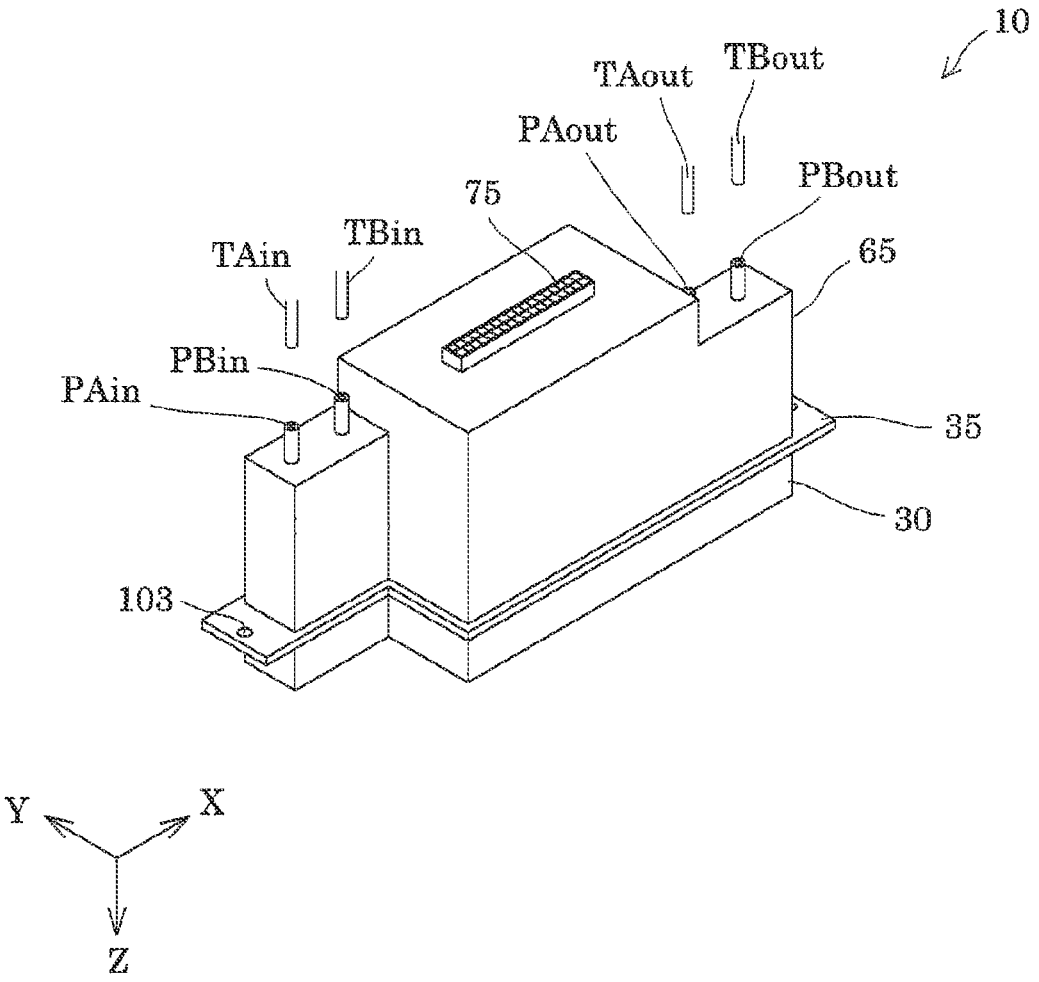
FIG. 4 is a perspective view of a recording head when viewed in a +Z direction.
Figure 5:
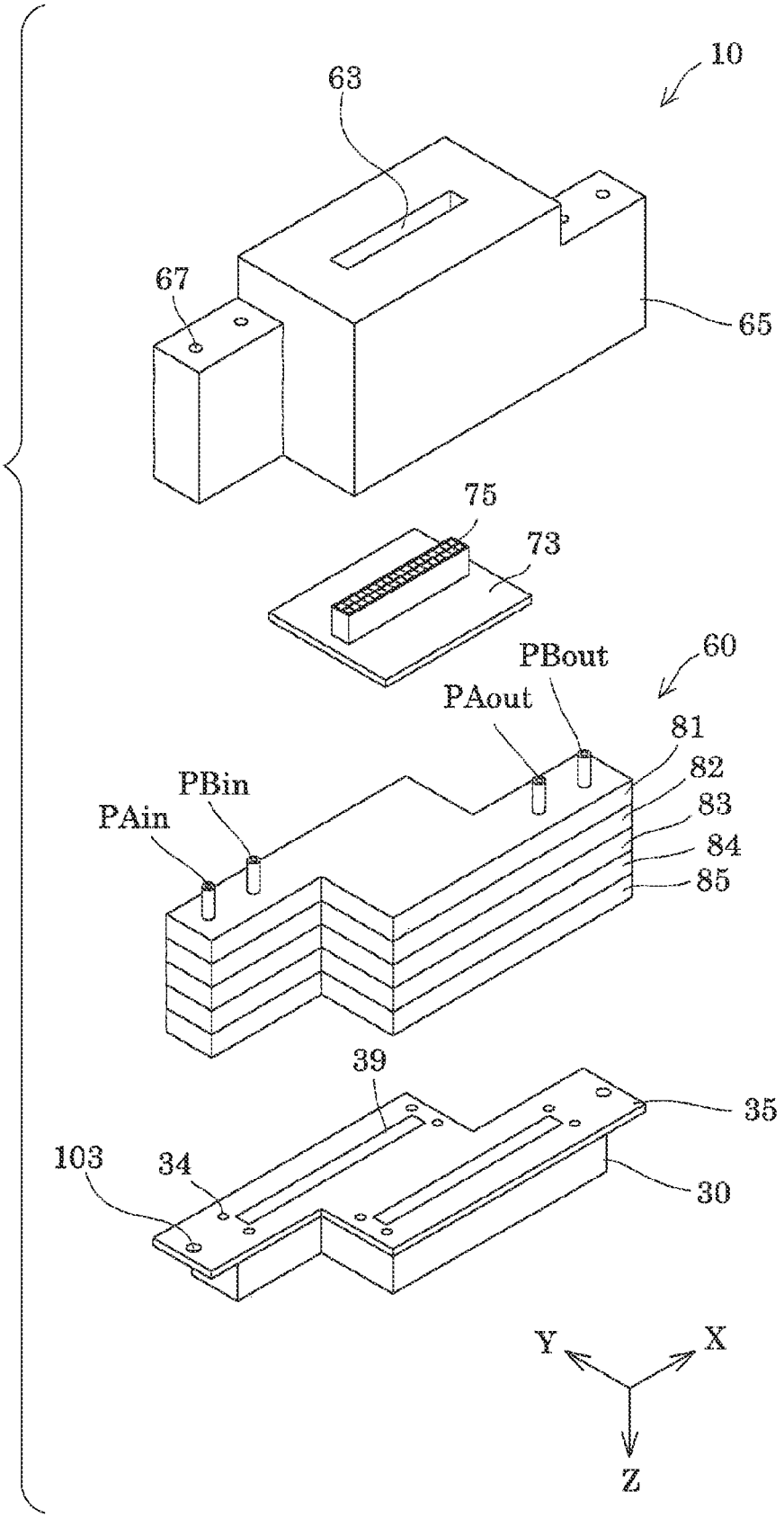
FIG. 5 is an exploded perspective view of the recording head when viewed in the +Z direction.
Figure 6:
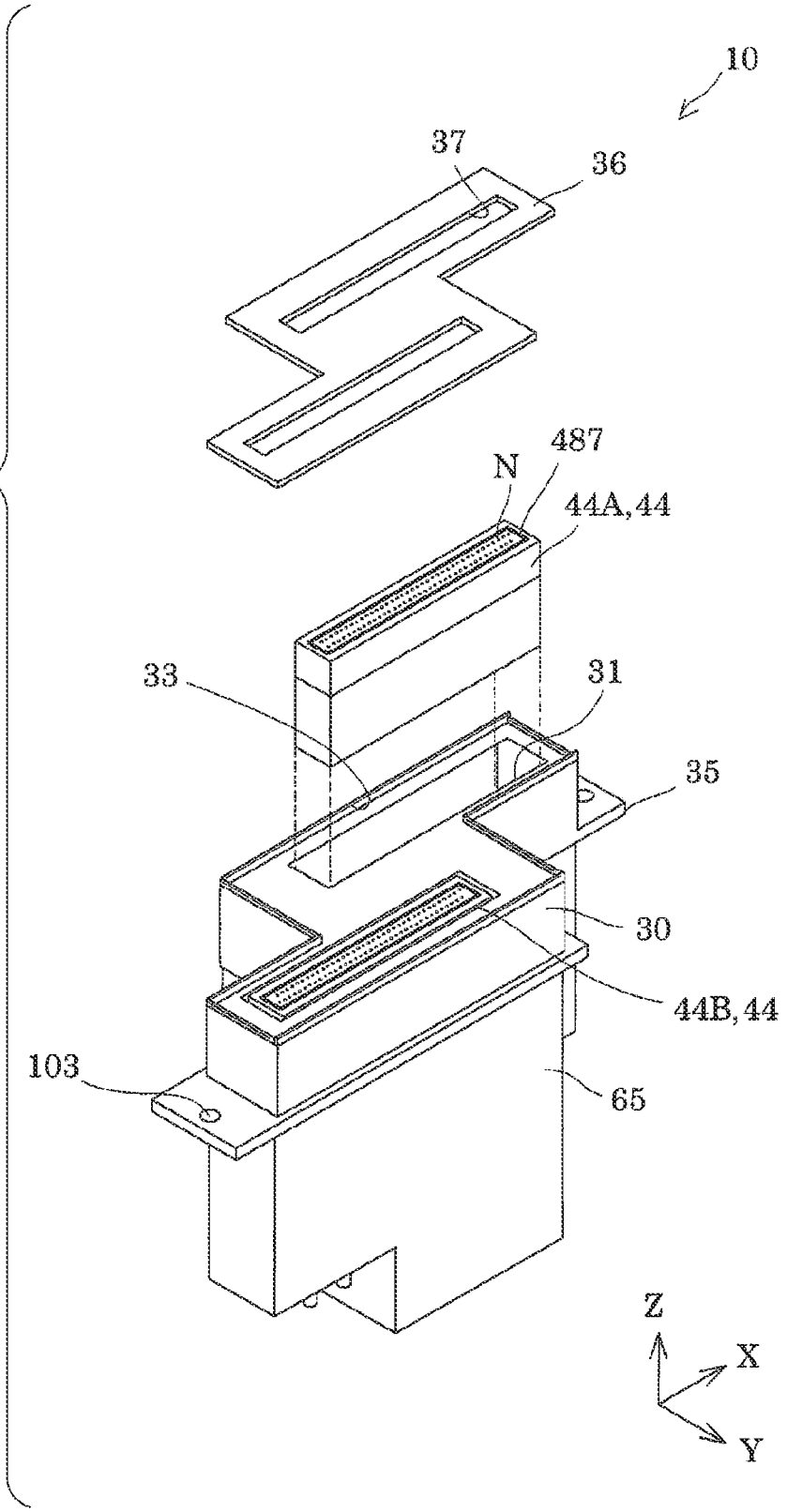
FIG. 6 is an exploded perspective view of the recording head when viewed in a −Z direction.
Figure 7:
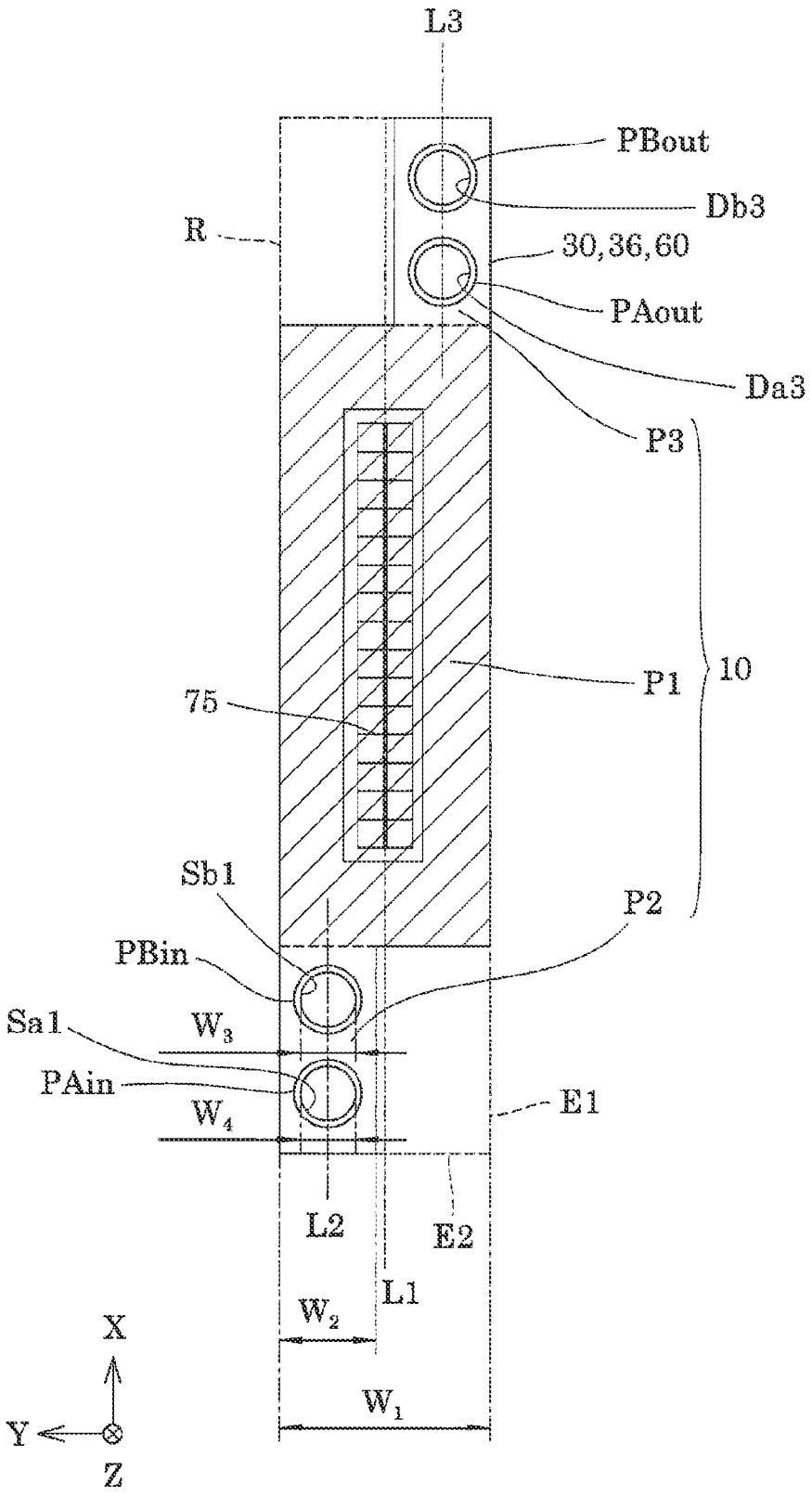
FIG. 7 is a plan view when viewed in the +Z direction for describing a shape of the recording head.
Figure 8:
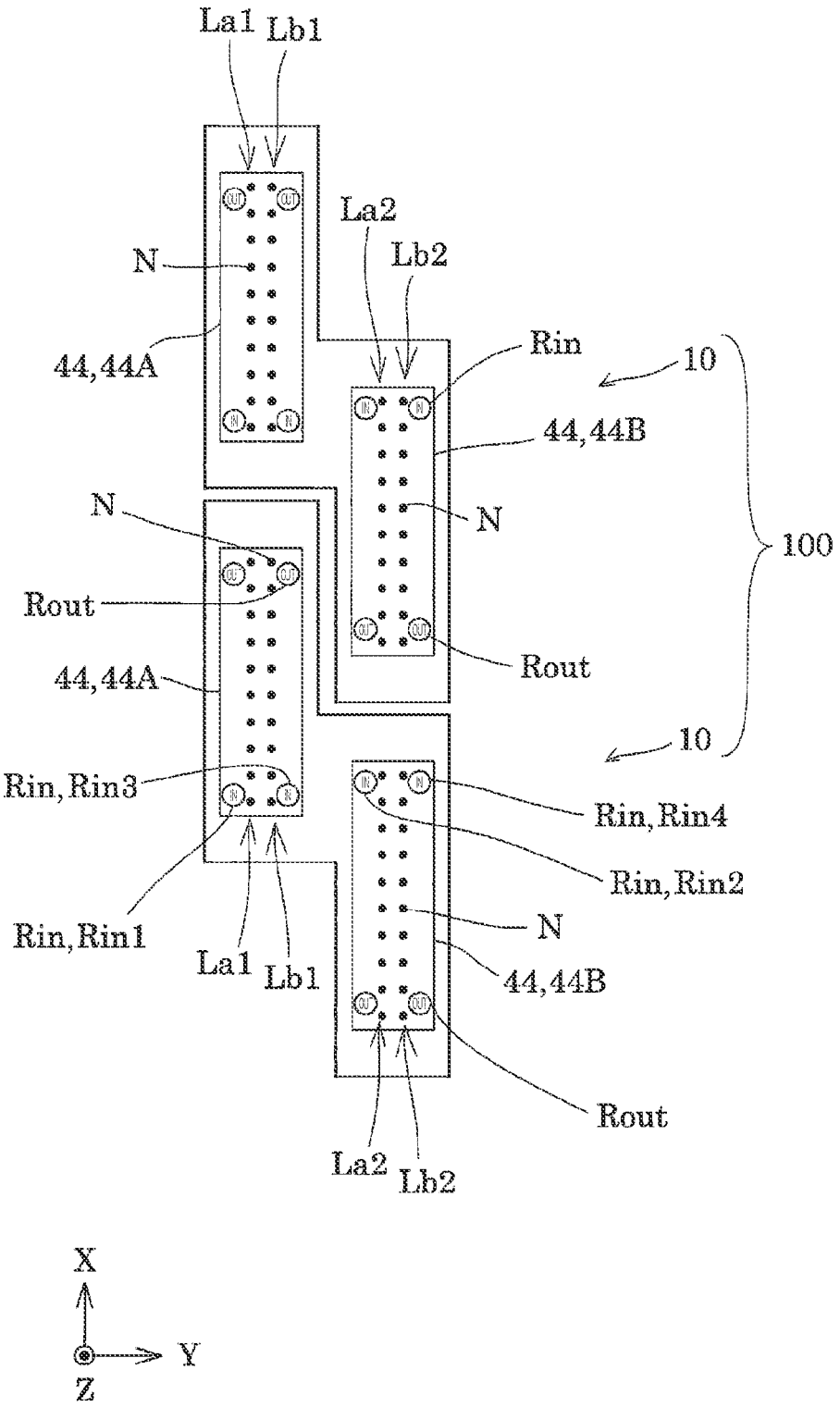
FIG. 8 is a plan view of the recording head when viewed in the −Z direction.

Here, the recording head 10 of the present embodiment will be described with reference to FIGS. 4 to 8. FIG. 4 is a perspective view of the recording head 10. FIG. 5 is an exploded perspective view of the recording head 10 when viewed in the +Z direction. FIG. 6 is an exploded perspective view of the recording head 10 when viewed in the −Z direction. FIG. 7 is a plan view for describing a shape of the recording head 10. FIG. 8 is a plan view of the head chip 44 provided on the recording head 10 when viewed in the +Z direction.

As illustrated in FIGS. 5 to 8, the recording head 10 has a shape which is long in the +X direction and short in the +Y direction. Here, the fact that the recording head 10 is long in the +X direction and short in the +Y direction means that a long side E1 is disposed along the +X direction and a short side E2 is disposed along the +Y direction when a rectangle with the smallest area including the recording head 10 is set to R, when the recording head 10 is viewed in the +Z direction.

The recording head 10 includes: a plurality of head chips 44 provided with the nozzles N for discharging ink droplets; a holder 30 for holding the head chips 44; a flow path member 60 for supplying ink to the head chips 44; a connector 75 to which a wiring for transmitting and receiving control signals and the like to and from the head chip 44 is coupled; and a cover member 65 for accommodating the flow path member 60 inside. In the present embodiment, one recording head 10 includes two head chips 44. As will be described in detail later, the two head chips 44 are disposed at different positions in the +X direction. Therefore, in the present embodiment, with respect to the two head chips 44, the head chip 44 disposed on the +X direction side is referred to as a first head chip 44A, and the head chip 44 disposed on the −X direction side is referred to as a second head chip 44B.

Figure 9:
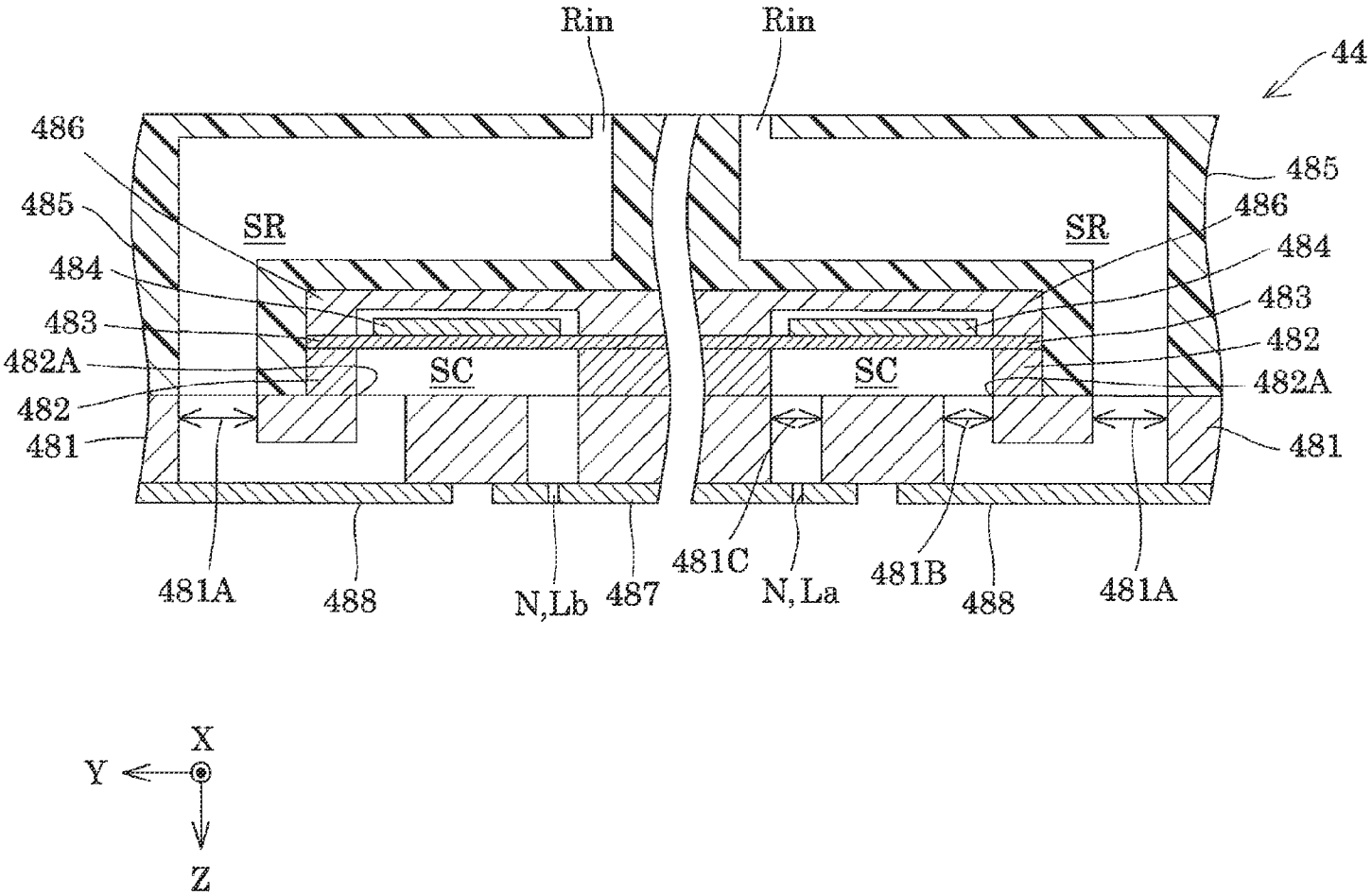
FIG. 9 is a sectional view of a head chip.
Figure 10:
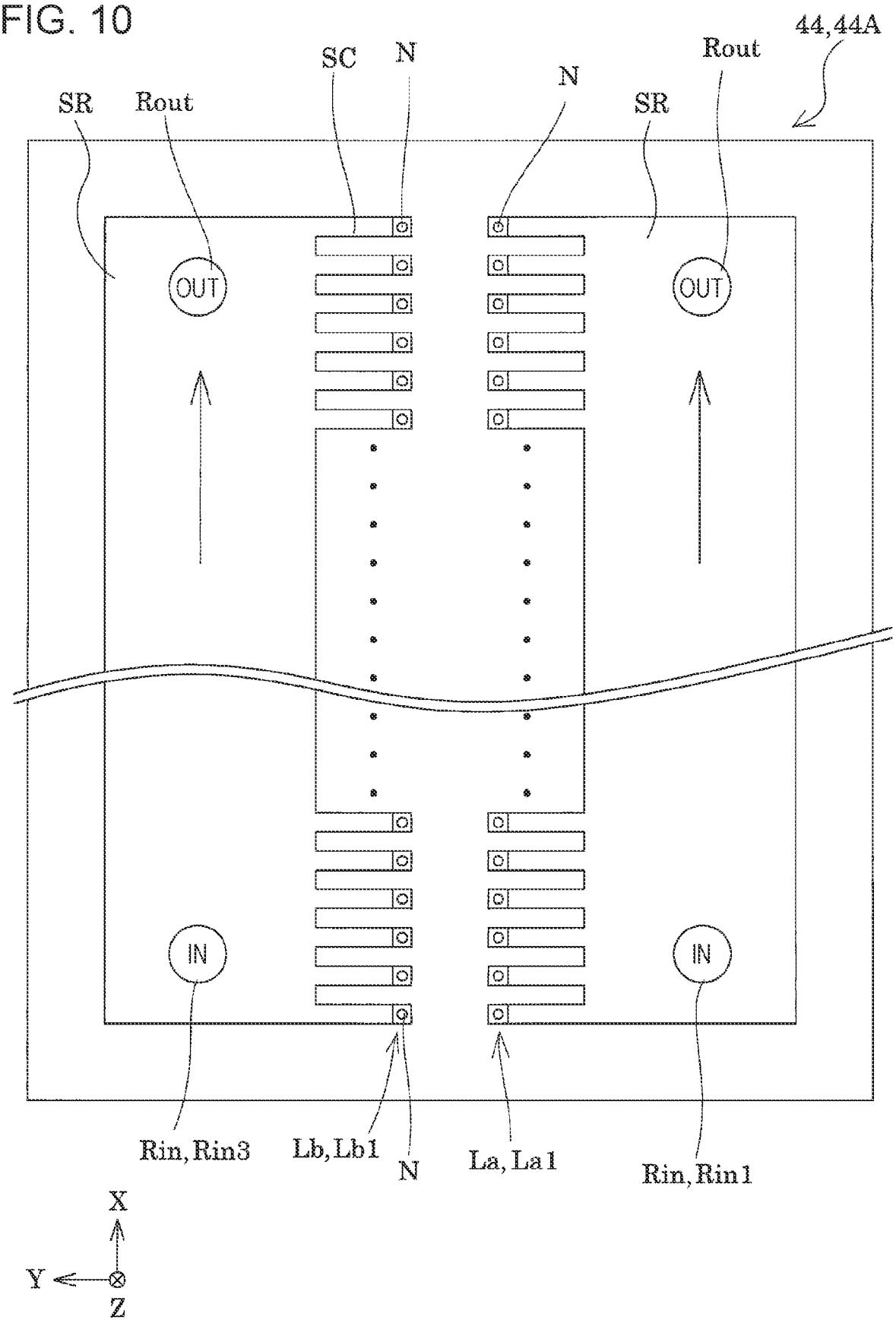
FIG. 10 is a view schematically illustrating a flow path of the head chip.

Here, the head chip 44 of the present embodiment will be further described with reference to FIGS. 9 and 10. FIG. 9 is a sectional view of the head chip 44. FIG. 10 is a view schematically illustrating the flow path of the first head chip 44A. Each direction of the head chip 44 will be described based on the direction when the head chip 44 is used for the recording head 10, that is, the X direction, the Y direction, and the Z direction. Hereinafter, in the description of the configuration common to the first head chip 44A and the second head chip 44B, the description will be made as the head chip 44, but unique configurations of each of the first head chip 44A and the second head chip 44B will be described as the first head chip 44A or the second head chip 44B.

As illustrated in FIGS. 9 and 10, the head chip 44 of the present embodiment is a structure in which a pressure chamber substrate 482, a diaphragm 483, a piezoelectric actuator 484, a housing section 485, and a protective substrate 486 are disposed on the −Z direction side, which is one side of a flow path forming substrate 481, and a nozzle plate 487 and a buffer plate 488 are disposed on the +Z direction side, which is the other side of the flow path forming substrate 481.

The flow path forming substrate 481, the pressure chamber substrate 482, and the nozzle plate 487 are formed of, for example, a silicon flat plate material, and the housing section 485 is formed, for example, by injection molding of a resin material. The plurality of nozzles N are formed on the nozzle plate 487. The surface of the nozzle plate 487 opposite to the flow path forming substrate 481 is a nozzle surface.

The flow path forming substrate 481 is formed with an opening portion 481A, an individual flow path 481B which is a throttle flow path, and a communication flow path 481C. The individual flow path 481B and the communication flow path 481C are through holes formed for each nozzle N, and the opening portion 481A is a continuous opening over the plurality of nozzles N. The buffer plate 488 is a compliance substrate made of a flat plate material which is installed on the surface of the flow path forming substrate 481 opposite to the pressure chamber substrate 482 and closes the opening portion 481A. The pressure fluctuation in the opening portion 481A is absorbed by the flexible deformation of the buffer plate 488.

A manifold SR, which is a common liquid chamber communicating with the opening portion 481A of the flow path forming substrate 481, is formed in the housing section 485. The manifold SR is a space for storing ink supplied to the plurality of nozzles N, and is continuously provided over the plurality of nozzles N. As illustrated in FIG. 10, the housing section 485 is provided with an introduction port Rin through which ink is supplied to the manifold SR from the upstream and a discharge port Rout through which ink is discharged from the manifold SR to the downstream. In FIG. 10, the introduction port Rin is indicated by "in" and the discharge port Rout is indicated by "out". As will be described in detail later, the introduction port Rin is coupled to supply pipes PAin and PBin of the flow path member 60 via a first supply path Sa and a second supply path Sb, and the discharge port Rout is coupled to discharge pipes PAout and PBout of the flow path member 60 via a first discharge path Da and a second discharge path Db.

In the present embodiment, as illustrated in FIGS. 8 and 10, the head chip 44 is provided with a nozzle row in which the nozzles N are arranged side by side along the +X direction, which is the first direction. In the head chip 44, a plurality of nozzle rows, in which the nozzles N are arranged side by side in the +X direction, are provided in the +Y direction, and in the present embodiment, two nozzle rows are provided. In the present embodiment, of the two nozzle rows provided on one head chip 44, one disposed in the −Y direction is referred to as a nozzle row La, and the other disposed in the +Y direction is referred to as a nozzle row Lb. In the present embodiment, the nozzle row La and the nozzle row Lb are collectively referred to as a nozzle row L. In these two rows of nozzle rows La and nozzle rows Lb, the positions of the respective nozzles N may be the same in the +X direction, that is, may overlap each other when viewed in the +Y direction, and the other nozzle row Lb may be disposed to be offset from one nozzle row La by half a pitch of the nozzle N in the +X direction.

In the present embodiment, the two rows of the nozzle rows La and nozzle rows Lb of the first head chip 44A are referred to as a first nozzle row La1 and a third nozzle row Lb1. Of the two introduction ports Rin of the first head chip 44A, the introduction port Rin communicating with the first nozzle row La1 is referred to as a first introduction port Rin1, and the introduction port Rin communicating with the third nozzle row Lb1 is referred to as a third introduction port Rin3.

The two rows of nozzle rows La and nozzle rows Lb of the second head chip 44B are referred to as a second nozzle row La2 and a fourth nozzle row Lb2. Of the two introduction ports Rin of the second head chip 44B, the introduction port Rin communicating with the second nozzle row La2 is referred to as a second introduction port Rin2, and the introduction port Rin communicating with the fourth nozzle row Lb2 is referred to as a fourth introduction port Rin4.

As illustrated in FIG. 10, the introduction port Rin of the first head chip 44A is disposed on one end side of the manifold SR with respect to the parallel direction of the nozzles N, and in the present embodiment, on the −X direction side, and the discharge port Rout is disposed on the other end side of the manifold SR with respect to the parallel direction of the nozzles N, and in the present embodiment, on the +X direction side. The ink supplied from the introduction port Rin into the manifold SR is discharged from the discharge port Rout to the outside of the manifold SR. In other words, the ink circulates in the manifold SR. In other words, one head chip 44 is formed with two ink circulation flow paths leading to the introduction port Rin, the manifold SR coupled to one nozzle row L, and the discharge port Rout.

As illustrated in FIG. 8, the introduction port Rin of the second head chip 44B is disposed on the other end side of the manifold SR with respect to the parallel direction of the nozzles N, that is, on the +X direction side, and the discharge port Rout is disposed on one end side of the manifold SR with respect to the parallel direction of the nozzles N, that is, on the −X direction side.

In other words, the positions of the introduction port Rin and the discharge port Rout of the first head chip 44A and the second head chip 44B are reversed to each other in the +X direction.

An opening portion 482A is formed for each nozzle N in the pressure chamber substrate 482 of the head chip 44. The diaphragm 483 is an elastically deformable flat plate material installed on the surface of the pressure chamber substrate 482 opposite to the flow path forming substrate 481. The space sandwiched between the diaphragm 483 and the flow path forming substrate 481 inside each opening portion 482A of the pressure chamber substrate 482 functions as a pressure chamber SC filled with ink supplied from the manifold SR via the individual flow paths 481B. Each pressure chamber SC communicates with the nozzle N via the communication flow path 481C of the flow path forming substrate 481.

The piezoelectric actuator 484 is formed for each nozzle N on the surface of the diaphragm 483 opposite to the pressure chamber substrate 482. Each piezoelectric actuator 484 is also called a piezoelectric element, and is a driving element in which a piezoelectric body is interposed between electrodes facing each other. The piezoelectric actuator 484 deforms based on the driving signal to vibrate the diaphragm 483 and fluctuate the pressure of the ink in the pressure chamber SC, and accordingly, the ink in the pressure chamber SC is ejected from the nozzle N. The protective substrate 486 also protects the plurality of piezoelectric actuators 484.

Instead of the piezoelectric actuator 484, a so-called electrostatic actuator can be used in which a heat generating element is disposed in the flow path to discharge ink droplets from the nozzle N by a bubble generated by the heat of the heat generating element, or electrostatic force is generated between the diaphragm 483 and the electrode and the diaphragm 483 is deformed by the electrostatic force to discharge ink droplets from the nozzle N.

The head chip 44 is provided to be long in the +X direction, which is the parallel direction of the nozzles N. Here, the fact that the head chip 44 is long in the +X direction means that the long side of the rectangle having the smallest area including the head chip 44 is disposed along the +X direction when the head chip 44 is viewed in the +Z direction. The head chip 44 is provided to be short in the +Y direction. In other words, the short side of the rectangle having the smallest area including the head chip 44 is disposed along the +Y direction when the head chip 44 is viewed in the +Z direction. In this manner, by providing the head chip 44 to be long in the parallel direction of the nozzles N, the length of the nozzle row L in which the nozzles N are arranged side by side can be ensured, and the increase in size of the head chip 44 in the +Y direction can be suppressed.

As illustrated in FIGS. 5 to 8 and the like, a plurality of such head chips 44 are provided in one recording head 10, and in the present embodiment, two are provided. Specifically, the two head chips 44 are held in the common holder 30 of the recording head 10.

The holder 30 is provided with a recess portion 33 that is open on the surface on the +Z direction side, and a recessed accommodation section 31 is provided on the bottom surface of the recess portion 33, that is, the surface of the recess portion 33 on the −Z direction side. The recess portion 33 has an opening having a size and shape in which a fixing plate 36 is fitted and fixed. The accommodation section 31 has an opening having a size and shape sufficient to accommodate the head chip 44.

The holder 30 is provided with a plurality of communication paths 34 for circulating ink between the head chip 44 and the flow path member 60. One end of the communication path 34 is open on the bottom surface of the accommodation section 31, that is, the surface in the −Z direction in the accommodation section 31, and communicates with each of the two introduction ports Rin and the two discharge ports Rout of the head chip 44. Therefore, four communication paths 34 are provided for each head chip 44. The other end of the communication path 34 is open on the surface of the holder 30 on the −Z direction side, and communicates with the first supply path Sa, the second supply path Sb, the first discharge path Da, and the second discharge path Db of the flow path member 60, which will be described in detail later.

The holder 30 is provided with a plurality of wiring insertion holes 39 through which a wiring (not illustrated) coupled to the head chip 44 and a relay substrate 73 is inserted. The wiring insertion hole 39 is provided so as to be open on the bottom surface of the accommodation section 31, that is, the surface of the accommodation section 31 on the −Z direction side, and open on the surface of the holder 30 on the −Z direction side.

A pair of flange sections 35 protruding respectively in the +X direction and the −X direction are provided on the −Z direction side of the holder 30. The fixing port 103 through which the above-described screw 105 is inserted is provided in the flange section 35 so as to penetrate in the +Z direction.

Each head chip 44 is fixed to the fixing plate 36. Specifically, the fixing plate 36 is formed in a shape accommodated in the recess portion 33, and an exposed opening portion 37 is formed at a predetermined location. Each head chip 44 is fixed to the fixing plate 36 with an adhesive or the like such that the buffer plate 488 is covered with the fixing plate 36 and the nozzle N, that is, the nozzle plate 487, is exposed from the exposed opening portion 37. The head chip 44 fixed to the fixing plate 36 in this manner is accommodated in the accommodation section 31 such that the nozzle plate 487 side is on the +Z direction side. The fixing plate 36 is fixed to the recess portion 33 with an adhesive or the like. The surface of the head chip 44 on the −Z direction side adheres to the bottom portion of the accommodation section 31, that is, the surface of the inner surface of the accommodation section 31 on the −Z direction side, with an adhesive.

In other words, the head chip 44 is accommodated in the space formed by the accommodation section 31 and the fixing plate 36, and the nozzle N is exposed from the exposed opening portion 37. The accommodation section 31 may be provided in common across the plurality of head chips 44.

As illustrated in FIG. 6, the plurality of head chips 44 held in the holder 30 are disposed such that the positions on the XY plane defined by the X-axis and the Y-axis are different from each other. In other words, the two head chips 44 are provided at positions where the two head chips 44 do not overlap each other in a plan view when viewed in the +Z direction. In other words, the first nozzle row La1 and the second nozzle row La2 are disposed to be offset from each other at different positions in both the +X direction and the +Y direction. The fact that the two head chips 44 are disposed at different positions on the XY plane means that the nozzle surfaces of the head chips 44 are provided at different positions from each other. Therefore, the parts of the plurality of head chips 44 other than the nozzle surfaces may be provided so as to overlap each other when viewed in the +Z direction. In the present embodiment, as illustrated in FIG. 8, the first head chip 44A is disposed on the +X direction side, and the second head chip 44B is disposed on the −X direction side.

In the present embodiment, as illustrated in FIG. 8, the nozzle rows L of the two head chips 44 are disposed at positions so as to partially overlap each other in the +X direction, and the continuous rows of the nozzles N in the +X direction are formed. In other words, by disposing the first nozzle row La1 of the first head chip 44A and the second nozzle row La2 of the second head chip 44B so as to partially overlap each other when viewed in the +Y direction, the continuous rows of the nozzles N along the +X direction can be formed by the first nozzle row La1 and the second nozzle row La2. The expression "by disposing the first nozzle row La1 of the first head chip 44A and the second nozzle row La2 of the second head chip 44B so as to partially overlap each other when viewed in the +Y direction" may include a case where the range in which the first nozzle row La1 of the first head chip 44A exists in the +X direction, that is, the range from the nozzle N disposed in the most +X direction of the first nozzle row La1 to the nozzle N disposed in the most −X direction, overlaps the range in which the second nozzle row La2 of the second head chip 44B exists in the +X direction, that is, the range from the nozzle N disposed in the most +X direction of the second nozzle row La2 to the nozzle N disposed in the most −X direction, when viewed in the +Y direction. In other words, the expression is not limited to a configuration in which the nozzle N that forms the first nozzle row La1 of the first head chip 44A and the nozzle N that forms the second nozzle row La2 of the second head chip 44B are necessarily positioned at the same position in the +X direction.

Similarly, by disposing the third nozzle row Lb1 of the first head chip 44A and the fourth nozzle row Lb2 of the second head chip 44B so as to overlap each other when viewed in the +Y direction, the continuous rows of the nozzles N along the +X direction can be formed by the third nozzle row Lb1 and the fourth nozzle row Lb2. The definition "by disposing the third nozzle row Lb1 of the first head chip 44A and the fourth nozzle row Lb2 of the second head chip 44B so as to partially overlap each other when viewed in the +Y direction" is the same as the above-described definition "by disposing the first nozzle row La1 of the first head chip 44A and the second nozzle row La2 of the second head chip 44B so as to partially overlap each other when viewed in the +Y direction", and thus, the duplicate description thereof will be omitted.

In this manner, by disposing the first introduction port Rin1 of the first head chip 44A on the −X direction side of the first head chip 44A, and the second introduction port Rin2 of the second head chip 44B on the +X direction side of the second head chip 44B, the first introduction port Rin1 and the second introduction port Rin2 can be disposed at positions relatively close to each other in the +X direction. However, by disposing the first nozzle row La1 and the second nozzle row La2 so as to partially overlap each other when viewed in the +Y direction, the first introduction port Rin1 communicating with the first nozzle row La1 and the second introduction port Rin2 communicating with the second nozzle row La2 are disposed to be offset from each other in the +X direction.

Similarly, by disposing the third introduction port Rin3 of the first head chip 44A on the −X direction side of the first head chip 44A, and the fourth introduction port Rin4 of the second head chip 44B on the +X direction side of the second head chip 44B, the third introduction port Rin3 and the fourth introduction port Rin4 can be disposed at positions relatively close to each other in the +X direction. However, by disposing the third nozzle row Lb1 and the fourth nozzle row Lb2 so as to partially overlap each other when viewed in the +Y direction, the third introduction port Rin3 communicating with the third nozzle row Lb1 and the fourth introduction port Rin4 communicating with the fourth nozzle row Lb2 are disposed to be offset from each other in the +X direction. In the present embodiment, the first introduction port Rin1 and the third introduction port Rin3 are disposed at positions offset from the second introduction port Rin2 and the fourth introduction port Rin4 on the −X direction side.

Here, the shape of the recording head 10 in a plan view when viewed in the +Z direction will be described with reference to FIG. 7. The recording head 10 includes a first part P1 (a part illustrated by a hatch in FIG. 7), a second part P2, and a third part P3.

When the rectangle having the smallest area including the recording head 10 is set to R, the long side E1 of the rectangle R overlaps the side along the +X direction of the holder 30, and the short side E2 of the rectangle R overlaps the side along the +Y direction of the holder 30. The center line parallel to the long side E1 of such a virtual rectangle R is set to L1.

The first part P1 is a rectangular part through which the center line L1 passes.

The second part P2 is a rectangular part protruding from the first part P1 in the −X direction opposite to the +X direction. In the second part P2, a dimension $W_2$ in the +Y direction is smaller than a dimension $W_1$ of the first part P1 in the +Y direction. Furthermore, the second part P2 is disposed to be shifted with respect to the first part P1 in the +Y direction or in the −Y direction opposite to the +Y direction. The fact that the second part P2 is disposed to be shifted with respect to the first part P1 in the +Y direction or the −Y direction means that the position of a center line L2 of the second part P2 does not match the center line L1 of the first part P1, and the center line L2 is offset from the center line L1 in the +Y direction or the −Y direction. It is preferable that the side surfaces of the first part P1 and the second part P2 are continuous on a straight line. It is needless to say that the present disclosure is not limited thereto, and the side surfaces of the first part P1 and the second part P2 may not be continuous on a straight line.

It is preferable that, in the second part P2, the dimension $W_2$ in the +Y direction is smaller than half the dimension $W_1$ of the first part P1 in the +Y direction ($W_2<W_1/2$), and the second part P2 is disposed in the +Y direction or the −Y direction opposite to the +Y direction with respect to the center of the first part P1. In other words, the second part P2 is disposed with dimensions and positions in the +Y direction such that the center line L1 indicating the center of the first part P1 does not pass therethrough. Accordingly, the size of the recording head 10 can be further reduced in the +Y direction, and thus, the plurality of recording heads 10 can be easily disposed on the support 101, and the size of the head module 100 can be reduced in the +Y direction. The nozzle rows of the recording heads 10 can be arranged in the +X direction while overlapping each other in the +X direction. It is needless to say that the second part P2 may have the dimension $W_2$ in the +Y direction through which the center line L1 passes, and may be disposed to be shifted in the +Y direction such that the center line L1 passes through the second part P2.

The third part P3 is a rectangular part protruding from the first part P1 in the +X direction. In the third part P3, the dimension in the +Y direction is smaller than the dimension of the first part P1 in the +Y direction. The third part P3 is disposed to be shifted in the +Y direction or the −Y direction opposite to the +Y direction with respect to the first part P1. The fact that the third part P3 is disposed to be shifted in the +Y direction or the −Y direction with respect to the first part P1 means that the position of a center line L3 of the third part P3 does not match the center line L1 of the first part P1, and the center line L3 is offset from the center line L1 in the +Y direction or the −Y direction.

The third part P3 of the present embodiment has a width in the +Y direction such that the center line L1 does not pass therethrough, and is disposed to be shifted in the −Y direction with respect to the first part P1. It is needless to say that the third part P3 may have the width in the +Y direction through which the center line L1 passes, and may be disposed at a position shifted in the −Y direction such that the center line L1 passes through the third part P3.

The nozzle surfaces of the head chip 44 are disposed at different positions in the +X direction and the +Y direction in the first part P1, the second part P2, and the third part P3. As illustrated in FIG. 8, when the recording heads 10 are arranged side by side in the +X direction to form the head module 100, the second part P2 of one recording head 10 (the recording head 10 disposed in the +X direction in FIG. 8) and the third part P3 of the other recording head 10 (the recording head 10 disposed in the −X direction in FIG. 8) are disposed to face each other in the +Y direction, and accordingly, the nozzles N of the recording head 10, which are adjacent to each other in the +X direction, can partially overlap each other in the +X direction, and the continuous rows of the nozzles N in the +X direction can be formed. When the recording heads 10 are arranged side by side in the +X direction, the size can be reduced in the +Y direction by providing the second part P2 and the third part P3.

In the present embodiment, the recording head 10 is provided with the third part P3, but the present disclosure is not particularly limited thereto, and the third part P3 may not be provided. In other words, when the recording heads 10 are arranged side by side in the +X direction to form the head module 100, the second part P2 of one recording head 10 and the second part P2 of the other recording head 10 are disposed to face each other in the +Y direction, and accordingly, the nozzles N of the recording head 10, which are adjacent to each other in the +X direction, can partially overlap each other in the +X direction, and the continuous rows of the nozzles N in the +X direction can be formed. However, when three or more recording heads 10 are arranged side by side in the +X direction, it is possible to easily form continuous nozzles N in the +X direction by providing the third part P3 in the recording head 10, and the size can be reduced in the +Y direction.

Figure 11:
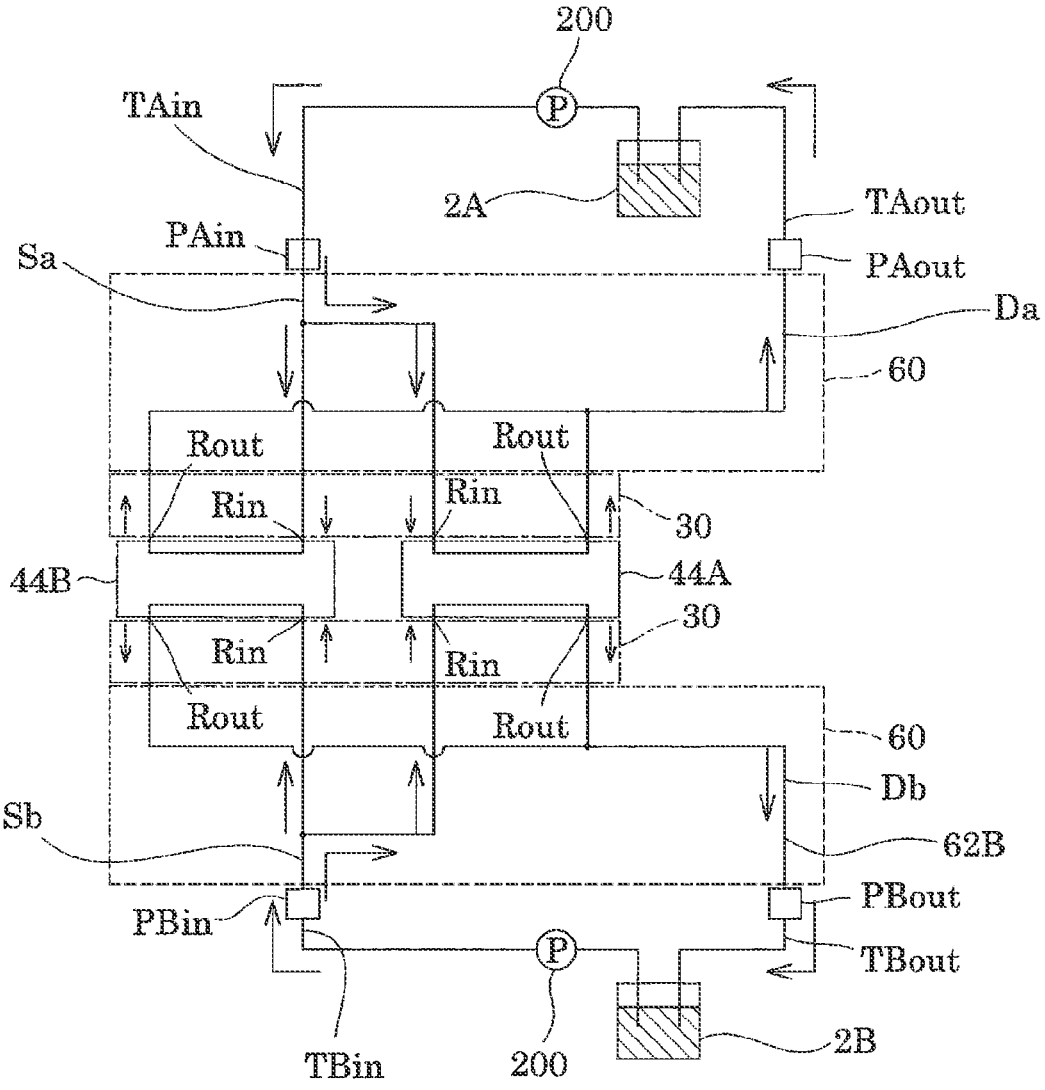
FIG. 11 is a schematic view describing a flow path.

Here, the flow path member 60 will be further described with reference to FIG. 11. FIG. 11 is a schematic view describing the flow path.

As illustrated in FIGS. 5 and 11, the flow path member 60 is a member in which the flow path for supplying ink to the head chip 44 is formed. The flow path member 60 of the present embodiment includes the first supply path Sa and the second supply path Sb for supplying ink to the head chip 44, and the first discharge path Da and the second discharge path Db for discharging ink from the head chip 44. As described above, since two manifolds SR are provided in the head chip 44 of the present embodiment and the introduction port Rin and the discharge port Rout are provided in each of the manifolds SR, two types of ink are supplied and discharged and circulates in the head chip 44. Therefore, the flow path member 60 includes: the first supply path Sa that communicates with each of the two introduction ports Rin provided in different head chips 44; the second supply path Sb that communicates with each of the two introduction ports Rin provided in different head chips 44; the first discharge path Da that communicates with each of the two discharge ports Rout provided in different head chips 44; and a second discharge path Db that communicates with each of the two discharge ports Rout provided in different head chips 44.

On the surface of the flow path member 60 on the −Z direction side, the cylindrical supply pipe PAin, the supply pipe PBin, the discharge pipe PAout, and the discharge pipe PBout protruding in the −Z direction are provided. As illustrated in FIG. 7, a first introduction section Sa1 which is a part of the first supply path Sa is provided inside the supply pipe PAin, and a second introduction section Sb1 which is a part of the second supply path Sb is provided inside the supply pipe PBin. A first discharge section Da3 which is a part of the first discharge path Da is provided inside the discharge pipe PAout, and a second discharge section Db3 which is a part of the second discharge path Db is provided inside the discharge pipe PBout.

A tube is coupled to each of the supply pipes PAin and PBin and the discharge pipes PAout and PBout, or the tube can be removed. The supply tube TAin is coupled to the supply pipe PAin, the supply tube TBin is coupled to the supply pipe pBIN. The discharge tube TAout is coupled to the discharge pipe PAout, and the discharge tube TBout is coupled to the discharge pipe PBout.

The first supply path Sa is branched into two in the flow path member 60, which will be described in detail later. Each of the branched flow paths communicates with the communication path 34 (refer to FIG. 5) formed in the holder 30. Similarly, the second supply path Sb is branched into two in the flow path member 60. Each of the branched flow paths communicates with the communication path 34 (refer to FIG. 5) formed in the holder 30.

The first discharge path Da is branched into two in the flow path member 60. Each of the branched flow paths communicates with the communication path 34 (refer to FIG. 5) formed in the holder 30. Similarly, the second discharge path Db is branched into two in the flow path member 60. Each of the branched flow paths communicates with the communication path 34 (refer to FIG. 5) formed in the holder 30.

The ink in the liquid container 2A is boosted to a predetermined pressure by the pump 200 and supplied to the first supply path Sa via the supply tube TAin and the supply pipe PAin. The ink is branched in the first supply path Sa and is supplied to one introduction port Rin of the two head chips 44 via the communication path 34 of the holder 30. Specifically, the ink supplied to the first supply path Sa is supplied to the first introduction port Rin1 of the first head chip 44A and the second introduction port Rin2 of the second head chip 44B. The ink supplied to the second supply path Sb is supplied to the third introduction port Rin3 of the first head chip 44A and the fourth introduction port Rin4 of the second head chip 44B. The ink discharged from the discharge ports Rout of the two head chips 44 merges at the first discharge path Da via the communication path 34 of the holder 30, and returns to the liquid container 2A via the discharge pipe PAout and the discharge tube TAout. The liquid container 2A, the supply tube TAin, the supply pipe PAin, the discharge pipe PAout, and the discharge tube TAout are configured to hold the nozzles N of each of the first head chip 44A and the second head chip 44B at a negative pressure within a predetermined range.

The ink in the liquid container 2B is boosted to a predetermined pressure by the pump 200 and supplied to the second supply path Sb via the supply tube TBin and the supply pipe PBin. The ink is branched in the second supply path Sb and is supplied to the other introduction port Rin of the two head chips 44 via the communication path 34. The ink discharged from the discharge ports Rout of the two head chips 44 merges at the second discharge path Db via the communication path 34, and returns to the liquid container 2B via the discharge pipe PBout and the discharge tube TBout. Similar to the liquid container 2A, the liquid container 2B, the supply tube TBin, the supply pipe PBin, the discharge pipe PBout, and the discharge tube TBout are configured to hold the nozzles N of each of the first head chip 44A and the second head chip 44B at a negative pressure within a predetermined range.

As described above, the holder 30 is provided with the communication path 34 through which ink flows, and the holder 30 also functions as a flow path member.

As illustrated in FIG. 5, the flow path member 60 is accommodated in the cover member 65 fixed to the −Z side of the holder 30.

The cover member 65 is provided with four through holes 67 on the surface on the −Z direction side, and the supply pipe PAin, the supply pipe PBin, the discharge pipe PAout, and the discharge pipe PBout are exposed to the outside from these four through holes 67.

As illustrated in FIGS. 4 and 5, the relay substrate 73 having the connector 75 is accommodated inside the cover member 65. The connector 75 provided on the relay substrate 73 is exposed to the outside from a coupling opening portion 63, which is a through hole provided on the surface of the cover member 65 on the −Z direction side, and the wiring (not illustrated) coupled to the control unit 3 on the outside is coupled to the connector 75.

The above-described supply pipe PAin and supply pipe PBin, that is, the first introduction section Sa1 and the second introduction section Sb1 described in detail later are provided in the second part P2 of the recording head 10. The discharge pipe PAout and the discharge pipe PBout, that is, the first discharge section Da3 and the second discharge section Db3 described in detail later, are provided in the third part P3 of the recording head 10. The connector 75, which is an electrical element of the present embodiment, is provided in the first part P1 of the recording head 10. In the present embodiment, the supply pipe PAin provided with the first introduction section Sa1 and the supply pipe PBin provided with the second introduction section Sb1 are disposed in this order in the +X direction. In other words, the first introduction section Sa1 and the second introduction section Sb1 are disposed at the same position in the +Y direction and at different positions in the +X direction, and the second introduction section Sb1 is disposed on the +X direction side of the first introduction section Sa1 while using the first introduction section Sa1 as a reference. In the present embodiment, the first introduction section Sa1 and the second introduction section Sb1 are disposed such that the positions in the +Y direction are the same, but it is needless to say that the present disclosure is not limited thereto, and the first introduction section Sa1 and the second introduction section Sb1 may be positioned at different positions in the +Y direction. Similarly, the two discharge pipes PAout and PBout are arranged side by side in the +X direction in this order.

In this manner, by providing the first introduction section Sa1, the second introduction section Sb1, the first discharge section Da3, and the second discharge section Db3 in the second part P2 and the third part P3, it is not necessary to provide a space for providing the first introduction section Sa1, the second introduction section Sb1, the first discharge section Da3, and the second discharge section Db3 in the flow path member 60 on the outside of the first part P1, the second part P2, and the third part P3, and the increase in size of the flow path member 60 can be suppressed. By providing the first introduction section Sa1, the second introduction section Sb1, the first discharge section Da3, and the second discharge section Db3 in the second part P2 and the third part P3, the connector 75 can be provided in the first part P1, and the size of the flow path member 60 can be reduced by effectively utilizing the space. Furthermore, by providing the first introduction section Sa1, the second introduction section Sb1, the first discharge section Da3, and the second discharge section Db3 in the second part P2 and the third part P3, the supply pipe PAin, the supply pipe PBin, the discharge pipe PAout, and the discharge pipe PBout can be provided at a position away from the connector 75 provided in the first part P1. Therefore, the ink leaked when the tubes are attached to and detached from each of the supply pipe PAin, the supply pipe PBin, the discharge pipe PAout, and the discharge pipe PBout, which are provided with the first introduction section Sa1, the second introduction section Sb1, the first discharge section Da3, and the second discharge section Db3, is unlikely to adhere to the connector 75, and an electrical defect caused by the ink adhering to the connector 75 can be suppressed.

It is preferable that a dimension $W_3$ of the first introduction section Sa1 in the +Y direction is at least half the dimension $W_2$ of the second part P2 in the +Y direction ($W_{3W2}/2$). It is preferable that a dimension $W_4$ of the second introduction section Sb1 in the +Y direction is at least half the dimension $W_2$ of the second part P2 in the +Y direction ($W_{4W2}/2$). In this manner, by setting each of the dimensions $W_3$ and $W_4$ of the first introduction section Sa1 and the second introduction section Sb1 to be at least half the dimension $W_2$ of the second part P2, the supply performance can be improved by enlarging the first introduction section Sa1 and the second introduction section Sb1. Even when the first introduction section Sa1 and the second introduction section Sb1 are disposed to be offset from each other in the +X direction in order to reduce the dimension $W_2$ of the second part P2 in the +Y direction, as will be described later in detail, by disposing the first introduction section Sa1, the second introduction section Sb1, a first filter chamber group Fa, and a second filter chamber group Fb in this order in the +X direction, it is possible to reduce the variation in the flow path length between a first supply flow path Sa2 that couples the first introduction section Sa1 and the first filter chamber group Fa to each other and a second supply flow path Sb2 that couples the second introduction section Sb1 and the second filter chamber group Fb to each other. Therefore, it is possible to reduce the variation in the pressure loss between the first supply flow path Sa2 and the second supply flow path Sb2.

Figure 12:
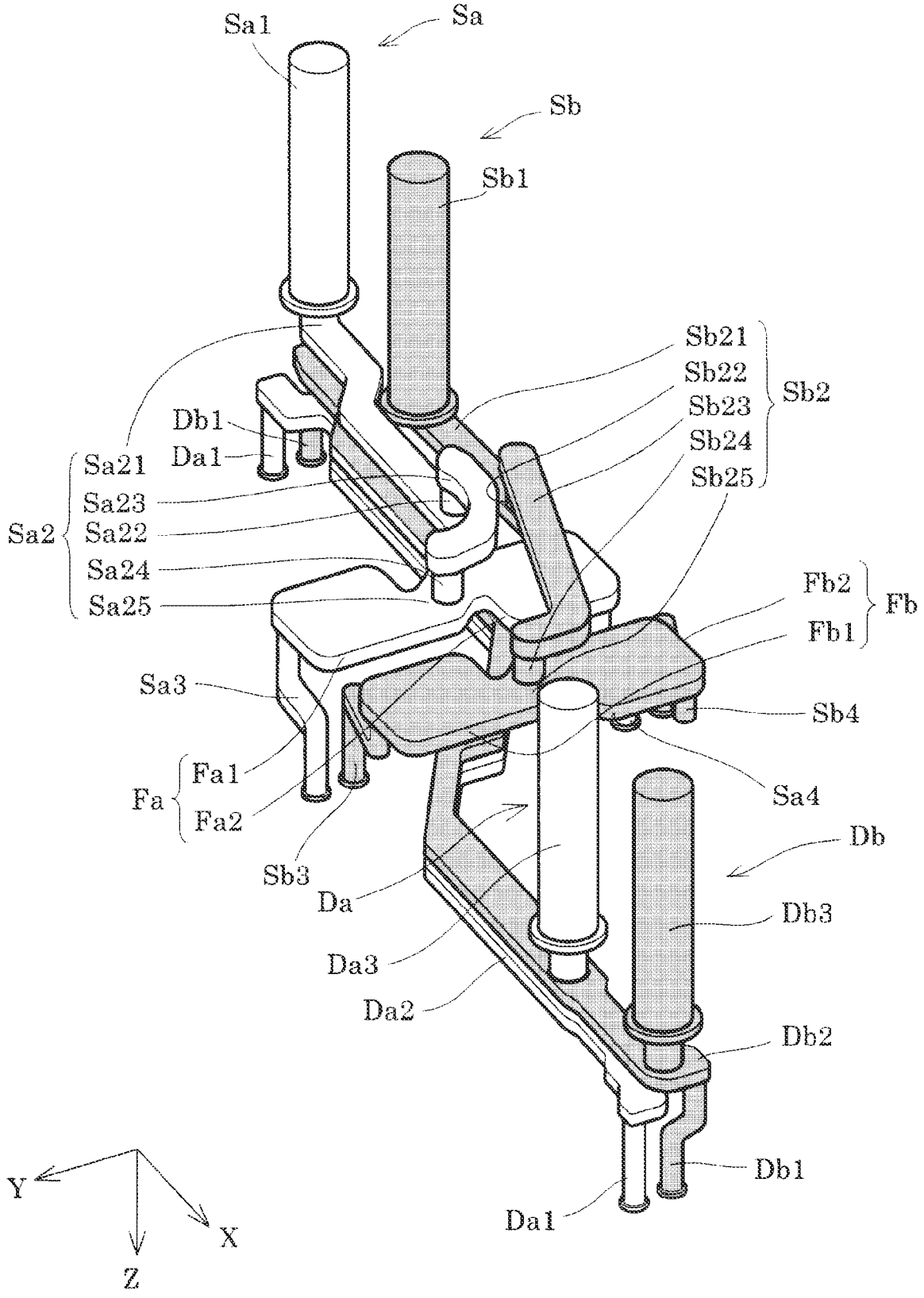
FIG. 12 is a perspective view of the flow path.
Figure 13:
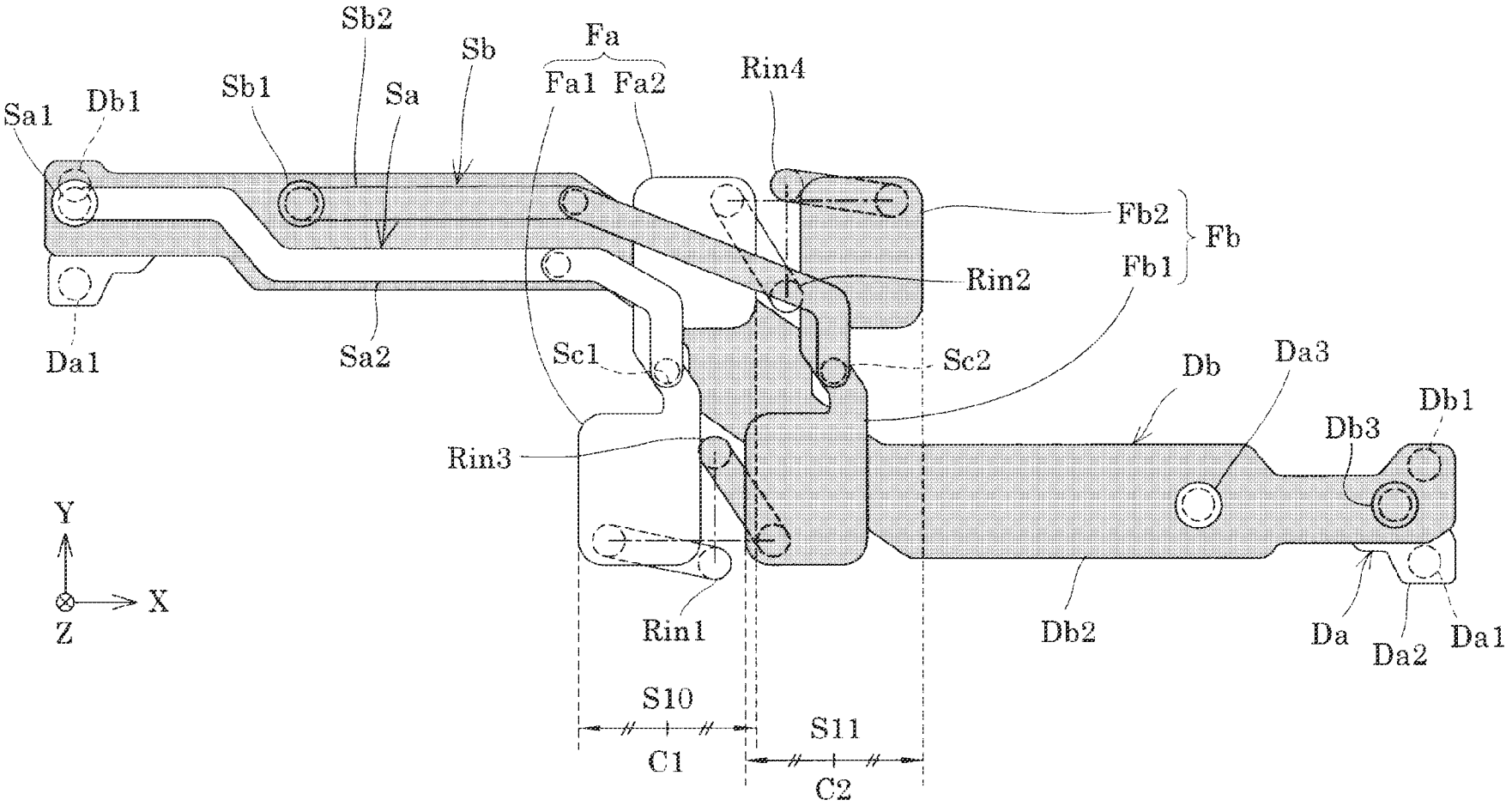
FIG. 13 is a plan view of the flow path.
Figure 14:
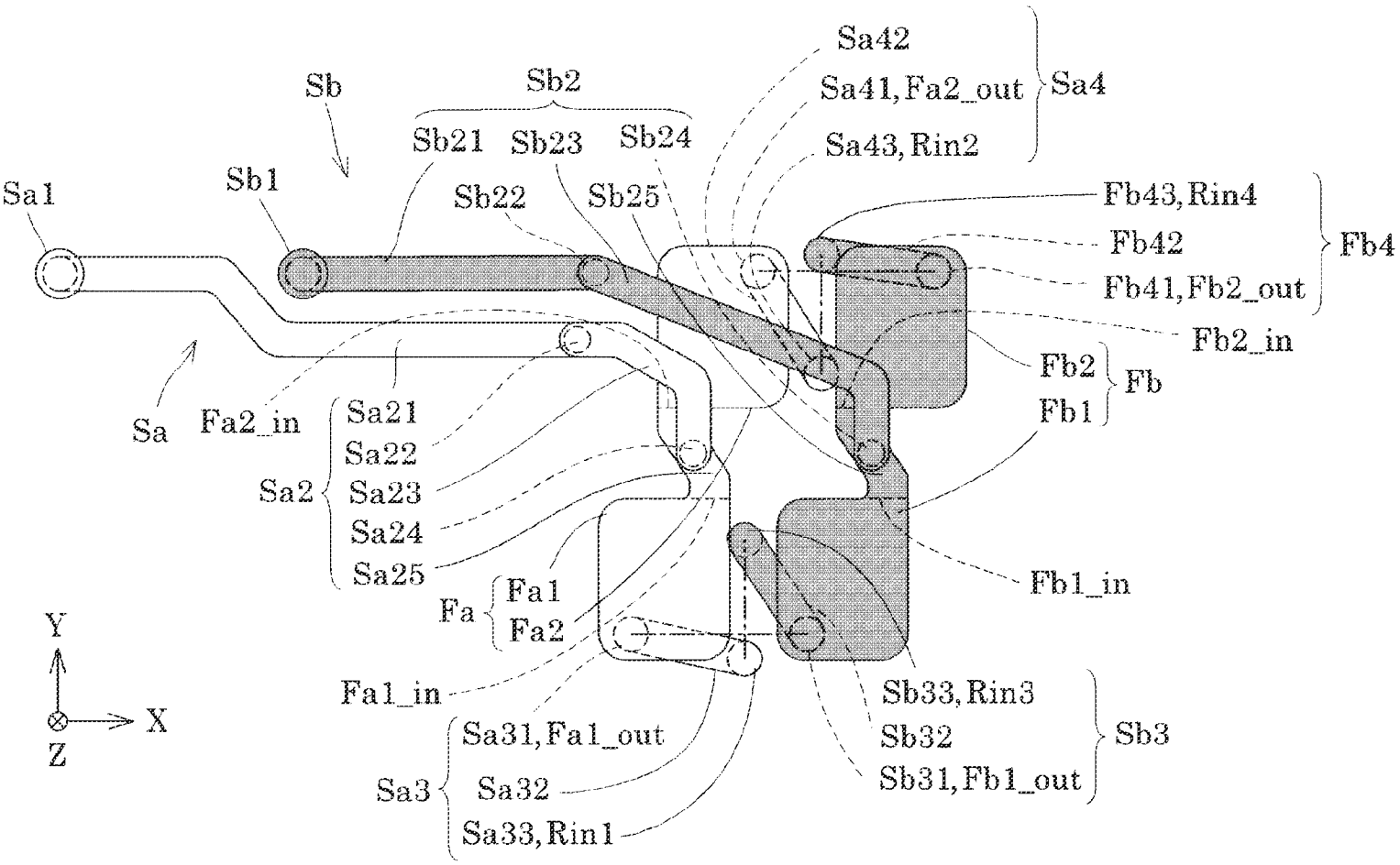
FIG. 14 is a plan view obtained by extracting a first supply path and a second supply path.
Figure 15:
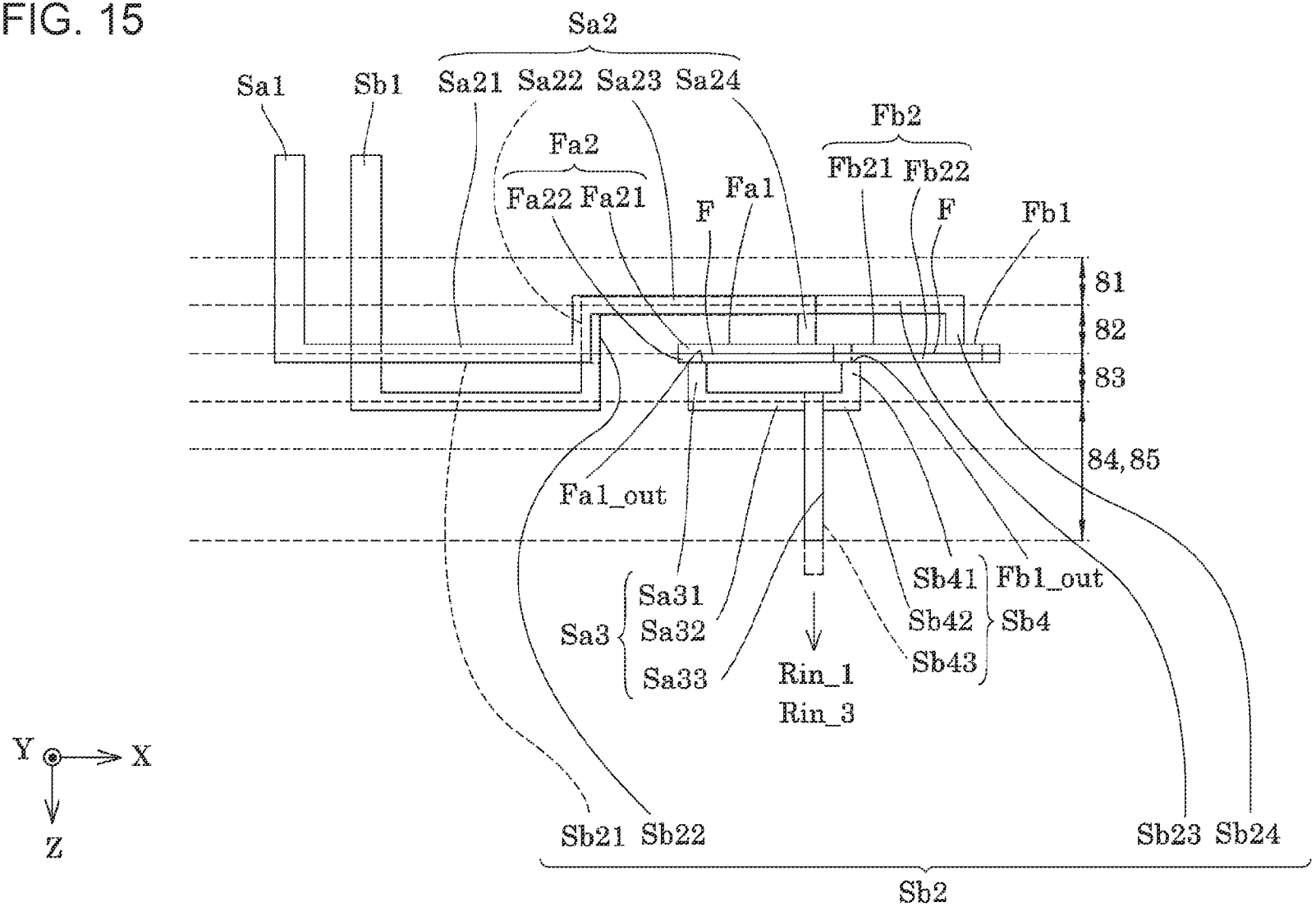
FIG. 15 is a side view obtained by extracting the first supply path and the second supply path.
Figure 16:
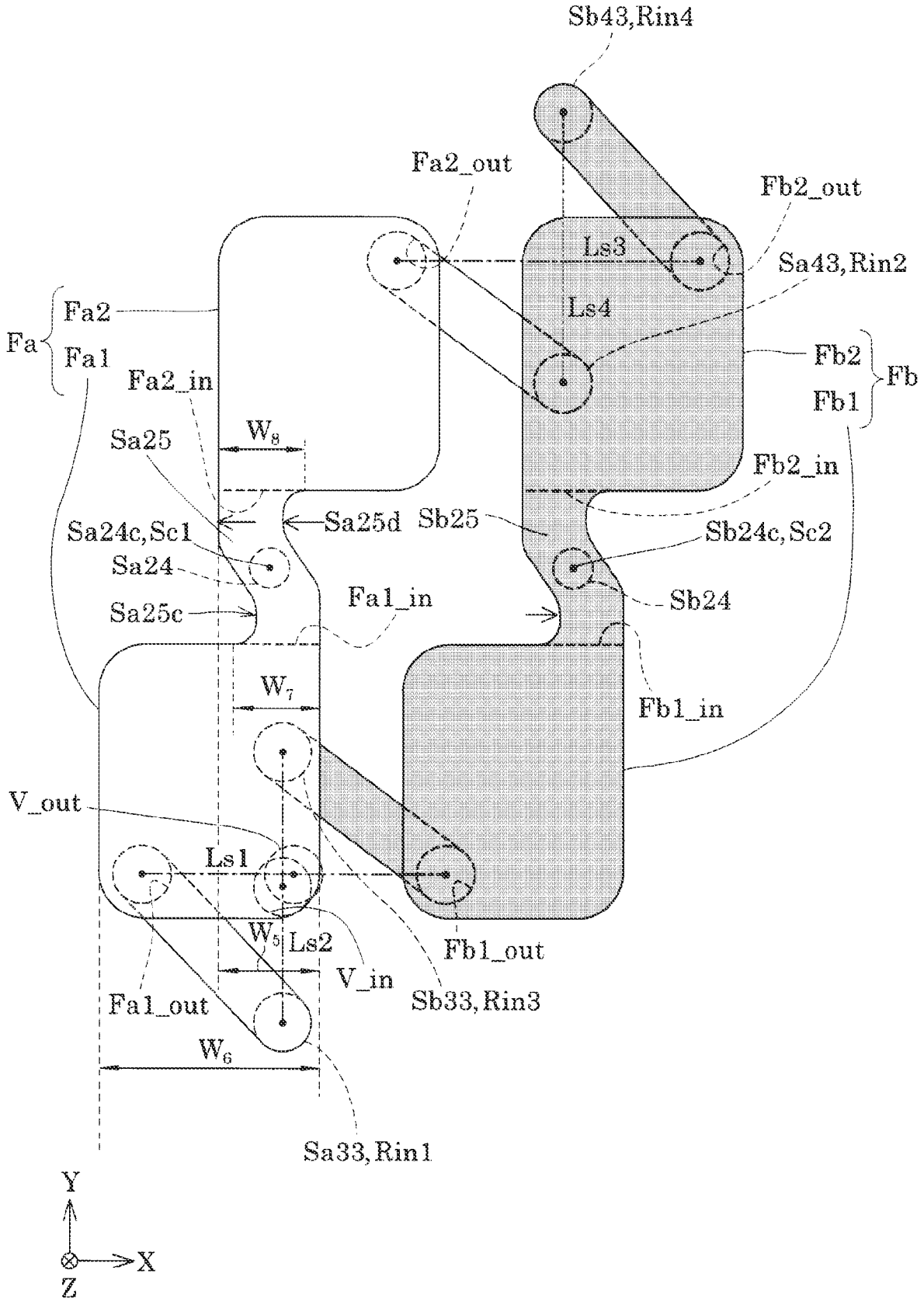
FIG. 16 is a plan view of a first filter chamber group and a second filter chamber group.
Figure 17:
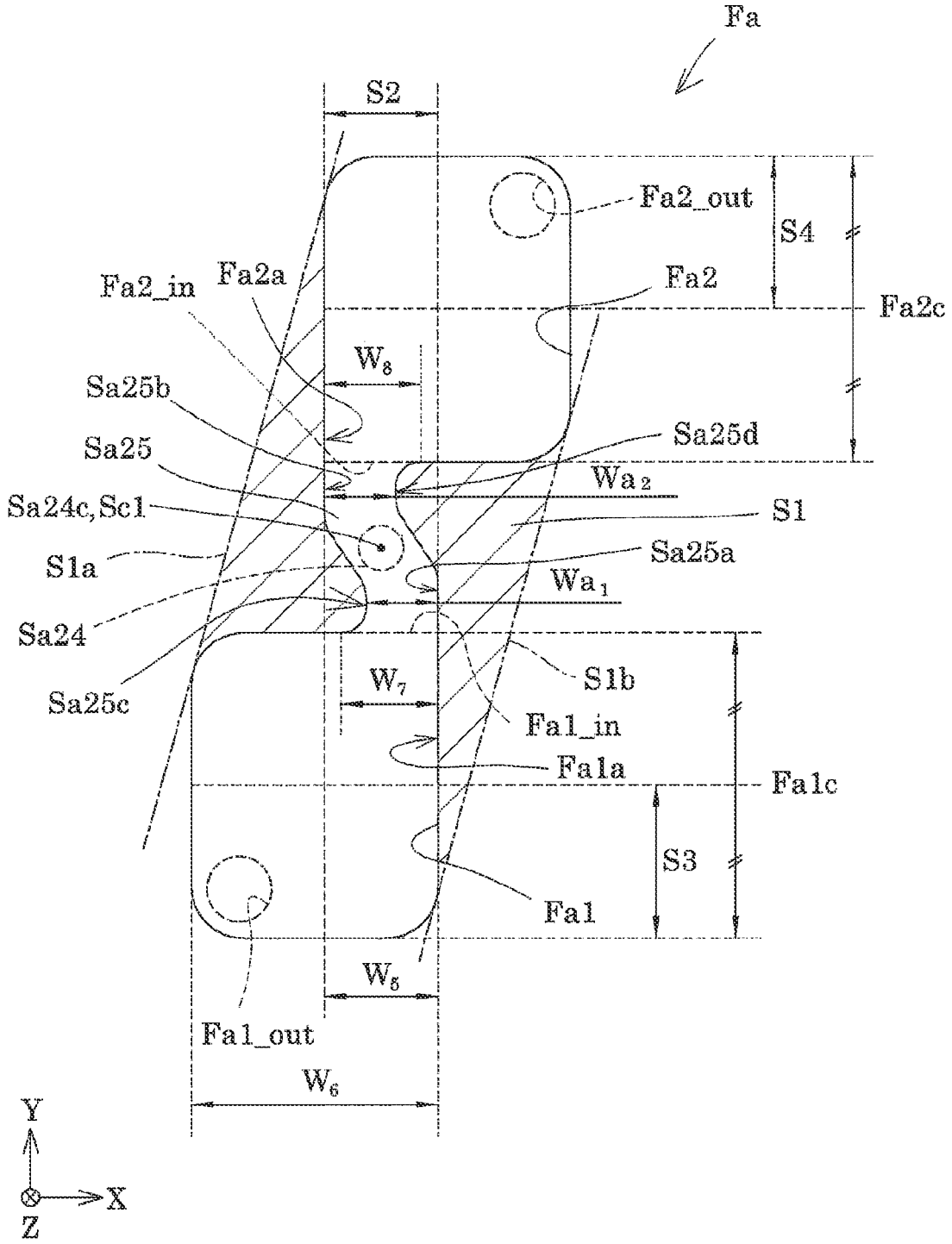
FIG. 17 is a plan view obtained by extracting the first filter chamber group.
Figure 18:
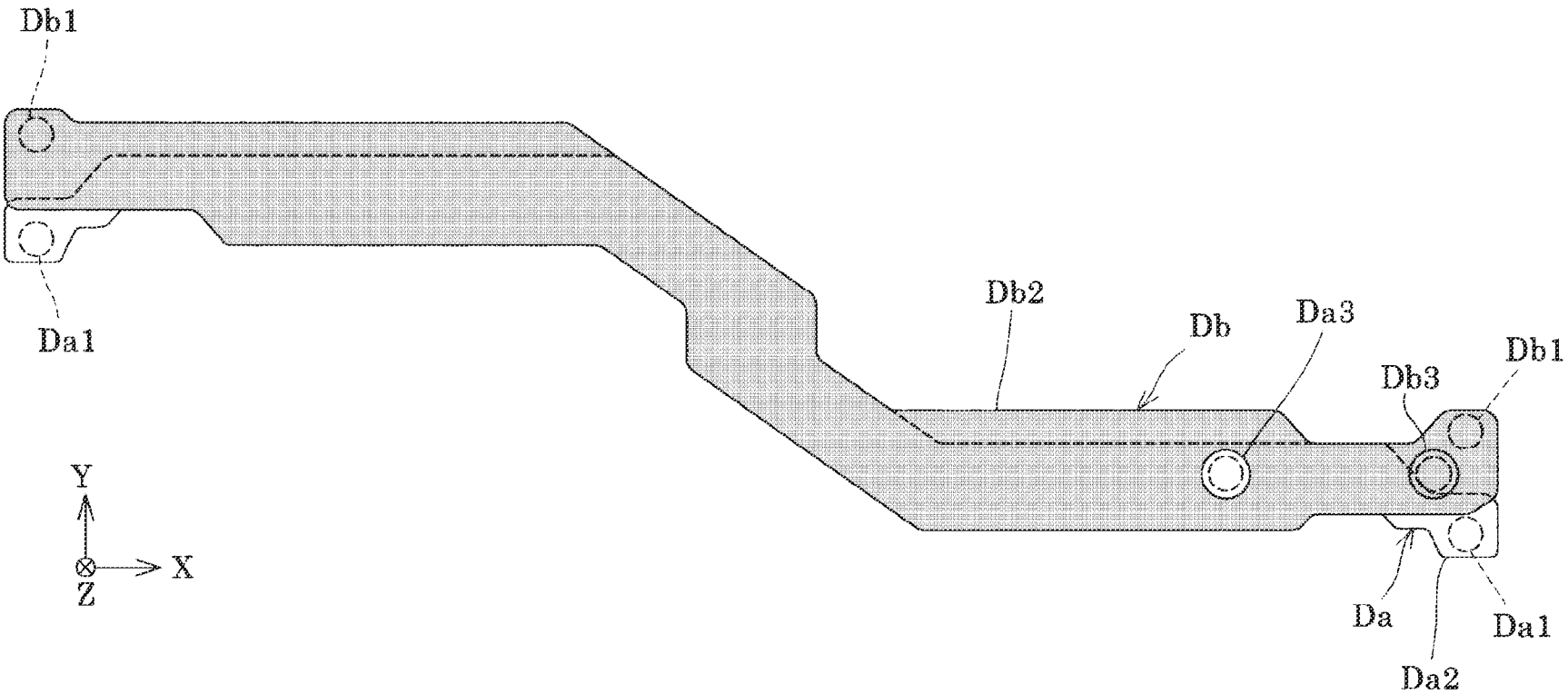
FIG. 18 is a plan view obtained by extracting a first discharge path and a second discharge path.
Figure 19:
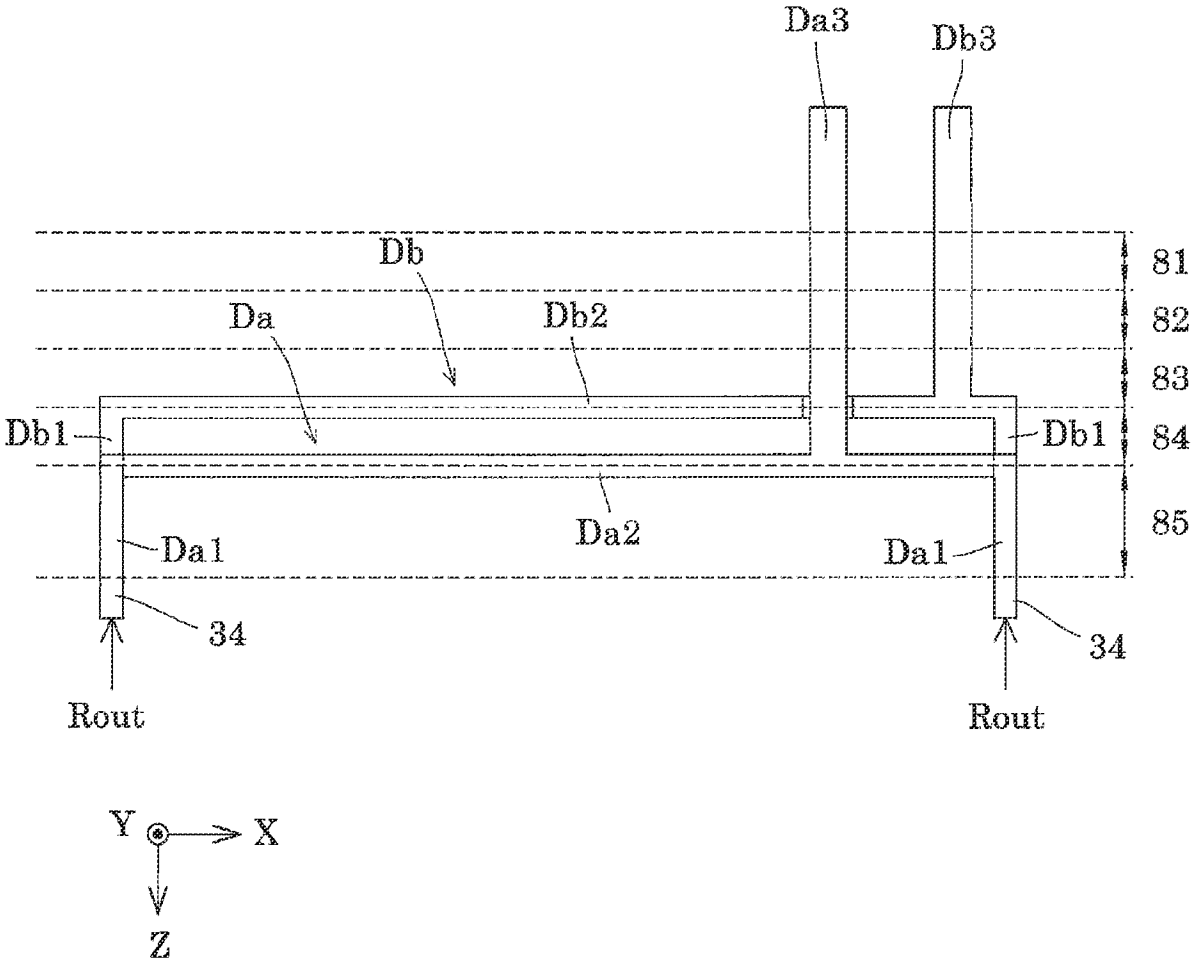
FIG. 19 is a side view of the first discharge path and the second discharge path.

Here, the flow paths provided in the flow path member 60 and the holder 30 will be further described with reference to FIGS. 12 to 20. FIG. 12 is a perspective view of a flow path mainly formed inside the flow path member 60. FIG. 13 is a plan view of the flow path mainly formed inside the flow path member 60. FIG. 14 is a plan view obtained by extracting the first supply path Sa and the second supply path Sb. FIG. 15 is a side view obtained by extracting the first supply path Sa and the second supply path Sb. FIG. 16 is a plan view of the first filter chamber group Fa and the second filter chamber group Fb. FIG. 17 is a plan view obtained by extracting the first filter chamber group Fa. FIG. 18 is a plan view obtained by extracting the first discharge path Da and the second discharge path Db. FIG. 19 is a side view obtained by extracting the first discharge path Da and the second discharge path Db.

As illustrated in FIG. 5, the flow path member 60 of the present embodiment includes a plurality of flow path substrates laminated on the Z-axis, and in the present embodiment, five flow path substrates. In the present embodiment, the five flow path substrates laminated on the Z-axis are sequentially referred to as a first flow path substrate 81, a second flow path substrate 82, a third flow path substrate 83, a fourth flow path substrate 84, and a fifth flow path substrate 85 from the −Z direction side to the +Z direction side.

As illustrated in FIG. 12, the flow path member 60 is provided with the first supply path Sa and the second supply path Sb, and the first discharge path Da and the second discharge path Db. Different types of ink are supplied to the flow path member 60 in each of the first supply path Sa and the second supply path Sb. In the present embodiment, the two inks are referred to as ink Ia and ink Ib, respectively.

Here, as illustrated in FIGS. 12 to 15, the first supply path Sa includes the first introduction section Sa1, the first supply flow path Sa2, the first filter chamber group Fa having a first filter chamber Fa1 and a second filter chamber Fa2, a first outflow flow path Sa3, and a second outflow flow path Sa4, from the upstream to the downstream.

The first introduction section Sa1 is for introducing the ink Ia into the flow path member 60 from the outside, and is provided so as to penetrate the first flow path substrate 81 and the second flow path substrate 82 over the Z-axis from the inside of the supply pipe PAin protruding in the −Z direction of the first flow path substrate 81.

One end of the first supply flow path Sa2 is coupled to the first introduction section Sa1, the first supply flow path Sa2 is branched in the middle, and the other two branched ends are respectively coupled to the first filter chamber Fa1 and the second filter chamber Fa2 that form the first filter chamber group Fa. Specifically, the first supply flow path Sa2 includes a first supply section Sa21, a first penetration section Sa22, a first linking section Sa23, a first coupling section Sa24, and a first branch section Sa25, from the upstream to the downstream.

The first supply section Sa21 extends along the in-plane direction of the XY plane including the X-axis and the Y-axis at the interface where the second flow path substrate 82 and the third flow path substrate 83 are fixed to each other. One end of the first supply section Sa21 is coupled to the first introduction section Sa1.

The first penetration section Sa22 is provided to penetrate the second flow path substrate 82 on the Z-axis such that one end is coupled to the other end of the first supply section Sa21 and the other end is open on the surface of the second flow path substrate 82 on the −Z direction side.

The first linking section Sa23 extends along the in-plane direction of the XY plane at the interface where the first flow path substrate 81 and the second flow path substrate 82 are fixed to each other. One end of the first linking section Sa23 is coupled to the other end of the first penetration section Sa22, which is open on the surface of the second flow path substrate 82 on the −Z direction side.

The first coupling section Sa24 is provided to penetrate the second flow path substrate 82 on the Z-axis such that one end is coupled to the other end of the first linking section Sa23 and the other end is open on the surface of the second flow path substrate 82 on the +Z direction side.

The first branch section Sa25 corresponds to "branch flow path", and extends along the in-plane direction of the XY plane at the interface where the second flow path substrate 82 and the third flow path substrate 83 are fixed to each other. The middle of the first branch section Sa25 is coupled to the other end of the first coupling section Sa24, which is open on the surface of the second flow path substrate 82 on the +Z direction side. The part where the first coupling section Sa24 and the first branch section Sa25 are coupled to each other is a first branch position Sc1 where the first supply flow path Sa2 is branched and the ink, which is a liquid, is distributed to the first filter chamber Fa1 and the second filter chamber Fa2.

One end of the first branch section Sa25 is coupled to the first filter chamber Fa1, and the other end thereof is coupled to the second filter chamber Fa2.

The flow path of the first supply section Sa21, the first linking section Sa23, the first branch section Sa25, and the like, which are described above, may be formed by forming a recess portion in one substrate and covering the recess portion with the other substrate, and may be formed by forming the recess portions on both substrates and aligning the openings of both recess portions.

Here, the first filter chamber Fa1 is provided at an interface where the second flow path substrate 82 and the third flow path substrate 83 are fixed to each other. The first filter chamber Fa1 is formed by aligning the openings of the recess portion provided in the second flow path substrate 82 and the recess portion provided in the third flow path substrate 83. A filter F is provided in the first filter chamber Fa1. The filter F is provided at an interface where the second flow path substrate 82 and the third flow path substrate 83 are fixed to each other, and the first filter chamber Fa1 is divided into a first upstream filter chamber Fa11 on the upstream and a first downstream filter chamber Fa12 on the downstream. In other words, the recess portion provided in the second flow path substrate 82 is the first upstream filter chamber Fa11, and the recess portion provided in the third flow path substrate 83 is the first downstream filter chamber Fa12. The filter F provided in the first filter chamber Fa1 is for capturing foreign substances such as air bubbles or dust contained in the ink, and filtering the ink, and for example, a sheet-like filter in which a plurality of micropores are formed by finely weaving or knitting fibers such as metal and resin, or a filter in which a plurality of micropores penetrate through a plate-shaped member such as metal or resin, can be used. As the filter F, for example, a non-woven fabric such as metal or resin may be used.

As illustrated in FIGS. 16 and 17, the first filter chamber Fa1 has a shape elongated in the +Y direction. The first filter chamber Fa1 of the present embodiment has a shape in which the corners of the rectangle are rounded based on a rectangle in which the side along the +Y direction is the long side and the side along the +X direction is the short side when viewed in the +Z direction. In this manner, by forming the first filter chamber Fa1 into a shape in which the corners of the rectangle are rounded from the +Z direction, the air bubbles contained in the ink are less likely to stay in the corner portions, and the discharge properties of the air bubbles can be improved. The shape of the first filter chamber Fa1 is not particularly limited thereto, and may be an ellipse having a long axis in the +Y direction, a polygon, a square, or an elongated shape in the +X direction. In other words, the fact that the first filter chamber Fa1 is elongated in the +Y direction means that the long side of the rectangle having the smallest area including the first filter chamber Fa1 is disposed along the +Y direction when the first filter chamber Fa1 is viewed in the +Z direction.

One end of the first branch section Sa25 of the first supply flow path Sa2 is coupled to the first filter chamber Fa1. The fact that the first supply flow path Sa2 communicates with the first filter chamber Fa1 means that the first supply flow path Sa2 communicates with the first upstream filter chamber Fa11 on the upstream of the filter F of the first filter chamber Fa1. In other words, one end of the first branch section Sa25 of the first supply flow path Sa2 is provided to be open on the inner wall surface of the first upstream filter chamber Fa11. In the present embodiment, the opening of the first branch section Sa25 that is open on the inner surface of the first filter chamber Fa1 is referred to as a first inlet Fa1_in.

The first filter chamber Fa1 has a first outlet Fa1_out through which ink flows out. Here, the fact that the first filter chamber Fa1 has the first outlet Fa1_out means that the first outlet Fa1_out is provided on the downstream separated by the filter F of the first filter chamber Fa1, that is, in the first downstream filter chamber Fa12. The first outlet Fa1 out is an opening of the first outflow flow path Sa3, which is open on the inner wall of the first filter chamber Fa1.

The first outflow flow path Sa3 includes a first outflow penetration section Sa31, a first outflow section Sa32, and a first outflow coupling section Sa33.

The first outflow penetration section Sa31 is provided to penetrate the third flow path substrate 83 on the Z-axis such that one end is open on the surface of the first downstream filter chamber Fa12 on the +Z direction side and the other end is open on the surface of the third flow path substrate 83 on the +Z direction side.

The first outflow section Sa32 extends along the in-plane direction of the XY plane at the interface where the third flow path substrate 83 and the fourth flow path substrate 84 are fixed to each other. One end of the first outflow section Sa32 is coupled to the first outflow penetration section Sa31. The first outflow section Sa32 may be formed by providing a recess portion in either the third flow path substrate 83 or the fourth flow path substrate 84 and covering the recess portion with the other one, and may be formed by forming recess portions on both of the third flow path substrate 83 and the fourth flow path substrate 84 and aligning the openings of both of the recess portions with each other.

The first outflow coupling section Sa33 is provided to penetrate the fourth flow path substrate 84 on the Z-axis such that one end is coupled to the first outflow section Sa32 and the other end is open on the surface of the fourth flow path substrate 84 on the +Z direction side. The other end of the first outflow coupling section Sa33, which is open on the surface of the fourth flow path substrate 84 on the +Z direction side is coupled to the first introduction port Rin1 of the first head chip 44A via the communication path 34 of the holder 30.

Meanwhile, the second filter chamber Fa2 is provided at an interface where the second flow path substrate 82 and the third flow path substrate 83 are fixed to each other. In other words, the second filter chamber Fa2 of the present embodiment is provided at the same interface as the first filter chamber Fa1. The second filter chamber Fa2 is formed by aligning the openings of the recess portion provided in the second flow path substrate 82 and the recess portion provided in the third flow path substrate 83. The filter F is provided in the second filter chamber Fa2. The filter F is provided at an interface where the second flow path substrate 82 and the third flow path substrate 83 are fixed to each other, and the second filter chamber Fa2 is divided into a second upstream filter chamber Fa21 on the upstream and a second downstream filter chamber Fa22 on the downstream. As the filter F provided in the second filter chamber Fa2, the same filter F as the filter F disposed in the first filter chamber Fa1 can be used.

The second filter chamber Fa2 has a shape elongated in the +Y direction. The second filter chamber Fa2 of the present embodiment has a shape in which the corners of the rectangle are rounded based on a rectangle in which the side along the +Y direction is the long side and the side along the +X direction is the short side, when viewed in the +Z direction. In this manner, by forming the second filter chamber Fa2 into a shape in which the corners of the rectangle are rounded from the +Z direction, the air bubbles contained in the ink are less likely to stay in the corner portions, and the discharge properties of the air bubbles can be improved. The shape of the second filter chamber Fa2 is not particularly limited thereto, and may be the same as any of the shapes of the first filter chamber Fa1 illustrated above. In the present embodiment, the second filter chamber Fa2 has the same shape as the first filter chamber Fa1 when viewed in the +Z direction. In this manner, by forming the first filter chamber Fa1 and the second filter chamber Fa2 in the same shape, it is possible to reduce the variation in the effective area of the filter F provided in each of the first filter chamber Fa1 and the second filter chamber Fa2, and to reduce the variation in the pressure loss due to the variation in the effective area of the filter F.

The other end of the first branch section Sa25 of the first supply flow path Sa2 is coupled to the second filter chamber Fa2. Here, the fact that the first supply flow path Sa2 communicates with the second filter chamber Fa2 means that the first supply flow path Sa2 communicates with the second upstream filter chamber Fa21 on the upstream of the filter F of the second filter chamber Fa2. In other words, the other end of the first branch section Sa25 of the first supply flow path Sa2 is provided to be open on the inner wall surface of the second upstream filter chamber Fa21. In the present embodiment, the opening of the first branch section Sa25 that is open on the inner surface of the second filter chamber Fa2 is referred to as a second inlet Fa2_in.

The second filter chamber Fa2 has a second outlet Fa2_out through which ink flows out. Here, the fact that the second filter chamber Fa2 has the second outlet Fa2_out means that the second outlet Fa2_out is provided on the downstream separated by the filter F of the second filter chamber Fa2, that is, in the second downstream filter chamber Fa22. The second outlet Fa2_out is an opening of the second outflow flow path Sa4 that is open on the inner wall of the second filter chamber Fa2.

The second outflow flow path Sa4 includes a second outflow penetration section Sa41, a second outflow section Sa42, and a second outflow coupling section Sa43.

The second outflow penetration section Sa41 is provided to penetrate the third flow path substrate 83 on the Z-axis such that one end is open on the surface of the second downstream filter chamber Fa22 on the +Z direction side and the other end is open on the surface of the third flow path substrate 83 on the +Z direction side.

The second outflow section Sa42 extends along the in-plane direction of the XY plane at the interface where the third flow path substrate 83 and the fourth flow path substrate 84 are fixed to each other. One end of the second outflow section Sa42 is coupled to the second outflow penetration section Sa41. The second outflow section Sa42 may be formed by providing a recess portion in either the third flow path substrate 83 or the fourth flow path substrate 84 and covering the recess portion with the other one, and may be formed by forming recess portions on both of the third flow path substrate 83 and the fourth flow path substrate 84 and aligning the openings of both of the recess portions with each other.

The second outflow coupling section Sa43 is provided to penetrate the fourth flow path substrate 84 on the Z-axis such that one end is coupled to the second outflow section Sa42 and the other end is open on the surface of the fourth flow path substrate 84 on the +Z direction side. The other end of the second outflow coupling section Sa43, which is open on the surface of the fourth flow path substrate 84 on the +Z direction side, is coupled to the second introduction port Rin2 of the second head chip 44B via the communication path 34 of the holder 30.

The first filter chamber group Fa having the first filter chamber Fa1 and the second filter chamber Fa2 that form the first supply path Sa is formed in the first part P1 illustrated in FIG. 7. By providing the first filter chamber group Fa in the first part P1 in this manner, a space for providing the first filter chamber group Fa can be ensured, the filter F having a relatively large area can be provided, the pressure loss due to the filter F can be reduced, and the occurrence of supply failure can be suppressed.

The first filter chamber Fa1 and the second filter chamber Fa2 are provided at the interface between the second flow path substrate 82 and the third flow path substrate 83, which are the same interfaces. The first filter chamber Fa1 and the second filter chamber Fa2 are disposed at intervals in the +Y direction. In other words, the first filter chamber Fa1 and the second filter chamber Fa2 are disposed so as not to overlap each other when viewed in the +X direction.

As illustrated in FIG. 17, the first filter chamber Fa1 and the second filter chamber Fa2 are disposed so as to at least partially overlap each other when viewed in the +Y direction. The first filter chamber Fa1 and the second filter chamber Fa2 may be disposed at positions so as to completely overlap each other when viewed in the +Y direction. In the present embodiment, the first filter chamber Fa1 and the second filter chamber Fa2 are disposed to be offset from each other in the +X direction so as to partially overlap each other when viewed in the +Y direction. In the present embodiment, the second filter chamber Fa2 is disposed at a position offset from the first filter chamber Fa1 in the +X direction. In other words, a part of the first filter chamber Fa1 on the −X direction side and a part of the second filter chamber Fa2 on the +X direction side are disposed so as to overlap each other when viewed in the +Y direction. In this manner, as the first filter chamber Fa1 and the second filter chamber Fa2 are disposed to be offset from each other in the +X direction so as to partially overlap each other when viewed in the +Y direction, in the recording head 10 in which the nozzle rows are disposed to be offset from each other, even when the two introduction ports Rin are offset from each other in the +X direction, the distance between the first filter chamber Fa1 and the introduction port Rin and the distance between the second filter chamber Fa2 and the introduction port Rin can be shortened. Therefore, it is possible to reduce the variation in the pressure loss of the ink supplied to the two introduction ports Rin. In other words, even when the first introduction port Rin1 of the first head chip 44A to which ink is supplied from the first filter chamber Fa1 and the second introduction port Rin2 of the second head chip 44B to which ink is supplied from the second filter chamber Fa2 are disposed to be offset from each other in the +X direction, by disposing the first filter chamber Fa1 and the second filter chamber Fa2 to be offset from each other in the +X direction, the distance from the first filter chamber Fa1 to the first introduction port Rin1 of the first head chip 44A and the distance from the second filter chamber Fa2 to the second introduction port Rin2 of the second head chip 44B can be shortened. Therefore, it is possible to reduce the variation in the pressure loss between the first outflow flow path Sa3 and the second outflow flow path Sa4. Therefore, it is preferable that the amount of deviation between the first filter chamber Fa1 and the second filter chamber Fa2 in the +X direction is approximately the same as the amount of deviation between the first introduction port Rin1 and the second introduction port Rin2 in the +X direction. In this manner, by setting the amount of deviation between the first filter chamber Fa1 and the second filter chamber Fa2 in the +X direction to be approximately the same as the amount of deviation between the first introduction port Rin1 and the second introduction port Rin2 in the +X direction, it is possible to suppress the variation between the flow path length from the first filter chamber Fa1 to the first introduction port Rin1 of the first head chip 44A and the flow path length from the second filter chamber Fa2 to the second introduction port Rin2 of the second head chip 44B, and to reduce the variation in the discharge characteristics of ink droplets discharged from the first nozzle row La1 communicating with the first introduction port Rin1 and the second nozzle row La1 communicating with the second introduction port Rin2.

Since the distance between the first filter chamber Fa1 and the introduction port Rin and the distance between the second filter chamber Fa2 and the introduction port Rin can be shortened, it is possible to reduce the amount of ink to be discarded when the air bubbles staying on the downstream of the filter F of the recording head 10 is discharged from the nozzle N by performing suction cleaning by a maintenance mechanism (not illustrated). The maintenance mechanism (not illustrated) includes, at least, a negative pressure generation unit such as a cap capable of sealing the nozzle surface on which the nozzle N is formed, a waste liquid flow path communicating with the cap, and a pump for making the inside of the cap have a negative pressure in a state where the nozzle surface is sealed.

It is preferable that a width $W_5$ in the +X direction of the part where the first filter chamber Fa1 and the second filter chamber Fa2 overlap each other when viewed in the +Y direction is smaller than half a width $W_6$ of the first filter chamber Fa1 in the +X direction ($W_5<W_6/2$). In this manner, by setting the width $W_5$ where the first filter chamber Fa1 and the second filter chamber Fa2 overlap each other to be smaller than half the width $W_6$ of the first filter chamber Fa1, even when the first inlet Fa1_in is disposed at the end portion of the first filter chamber Fa1, and even when the second inlet Fa2_in is disposed at the end portion of the second filter chamber Fa2, it is possible to make the first filter chamber Fa1 and the second filter chamber Fa2 easily get closer to each other in the +Y direction. By bringing the first filter chamber Fa1 and the second filter chamber Fa2 closer to each other in the +Y direction, the size of the recording head 10 can be reduced in the +Y direction. By bringing the first filter chamber Fa1 and the second filter chamber Fa2 closer to each other in the +Y direction, the head chips 44 arranged side by side in the +Y direction can get closer to each other in the +Y direction, and it is possible to reduce the difference in the discharge timing of ink droplets discharged from different head chips 44. Therefore, it is possible to suppress the deviation of the landing position of the ink droplet on the medium S.

The first branch position Sc1 where the first coupling section Sa24 and the first branch section Sa25 communicate with each other is provided between the first filter chamber Fa1 and the second filter chamber Fa2 in a plan view when viewed in the +Z direction.

Here, the fact that the first branch position Sc1 is disposed between the first filter chamber Fa1 and the second filter chamber Fa2 in a plan view in the +Z direction is that the first branch position Sc1 is within the range of a region S1 sandwiched between the first filter chamber Fa1 and the second filter chamber Fa2 which are illustrated by hatching in FIG. 17. In other words, the region S1 sandwiched between the first filter chamber Fa1 and the second filter chamber Fa2 is a region sandwiched between the first filter chamber Fa1 and the second filter chamber Fa2, between a tangent S1*a* in the −X direction, which is in contact with both the first filter chamber Fa1 and the second filter chamber Fa2, and a tangent S1*b* in the +X direction, which is in contact with both the first filter chamber Fa1 and the second filter chamber Fa2, when viewed in the +Z direction.

Incidentally, the first branch position Sc1 refers to a center position Sa24*c* of the opening of the first coupling section Sa24, which is open to the first branch section Sa25. Therefore, when the center position Sa24*c* of the first branch position Sc1 is within the range of the region S1, the other parts may be outside the range of the region S1.

In this manner, by disposing the first branch position Sc1 between the first filter chamber Fa1 and the second filter chamber Fa2, it is possible to reduce the flow path length of the first branch section Sa25 from the first branch position Sc1 to the first filter chamber Fa1 and the second filter chamber Fa2, and to elongate the flow path length of the common flow path from the first introduction section Sa1 to the first branch position Sc1 before branching. Therefore, the layout of the first supply flow path Sa2 can be simplified as compared with a case where the flow path length of the first branch section Sa25 is elongated.

The first inlet Fa1_in in which ink flows into the first filter chamber Fa1 from the first supply flow path Sa2 and the second inlet Fa2_in in which ink flows into the second filter chamber Fa2 from the first supply flow path Sa2 are disposed at a part where the first filter chamber Fa1 and the second filter chamber Fa2 overlap each other when viewed in the +Y direction, that is, within the range of S2 illustrated in FIG. 17.

In this manner, by disposing the first inlet Fa1_in and the second inlet Fa2_in within the range of a region S3 of the part where the first filter chamber Fa1 and the second filter chamber Fa2 overlap each other, the flow path length of the first branch section Sa25 from the first branch position Sc1 to the first inlet Fa1_in and the flow path length of the first branch section Sa25 from the first branch position Sc1 to the second inlet Fa2_in can be made relatively shortened. Therefore, it is possible to further reduce the variation in the pressure loss between the first branch section Sa25 from the first branch position Sc1 to the first inlet Fa1_in and the first branch section Sa25 from the first branch position Sc1 to the second inlet Fa2_in. Incidentally, when the first inlet Fa1_in and the second inlet Fa2_in are disposed outside the range of the region S2 of the part where the first filter chamber Fa1 and the second filter chamber Fa2 overlap each other, the flow path length from the first branch position Sc1 to the first inlet Fa1_in and the second inlet Fa2_in is elongated, and the variation in the pressure loss proportional to the flow path length also increases.

The first inlet Fa1_in is disposed on the surface of the first filter chamber Fa1 facing the second filter chamber Fa2, and the second inlet Fa2_in is disposed on the surface of the second filter chamber Fa2 facing the first filter chamber Fa1. In other words, the first inlet Fa1_in is disposed on the surface of the first filter chamber Fa1 in the +Y direction, and the second inlet Fa2_in is disposed on the surface of the second filter chamber Fa2 in the −Y direction. In this manner, by disposing the first inlet Fa1_in on the surface of the first filter chamber Fa1 facing the second filter chamber Fa2, and by disposing the second inlet Fa2_in on the surface of the second filter chamber Fa2 facing the first filter chamber Fa1, the first branch position Sc1 can be disposed immediately before the first filter chamber Fa1 and the second filter chamber Fa2. It is needless to say that the first inlet Fa1_in may be disposed on a surface other than the surface of the first filter chamber Fa1 in the +Y direction, that is, a surface in the +Z direction, a surface in the −Z direction, a surface in the +X direction, a surface in the −X direction, and a surface in the −Y direction. However, when the first inlet Fa1_in is disposed on a surface other than the surface in the +Y direction, as compared with a case where the first inlet Fa1_in is provided on the surface in the +Y direction, the first branch position Sc1 cannot be disposed immediately before the first filter chamber Fa1, the flow path length of the first branch section Sa25 is elongated, and thus, the variation in the pressure loss of the first branch section Sa25 occurs. By disposing the first inlet Fa1_in on the surface of the first filter chamber Fa1 facing the second filter chamber Fa2, the first branch position Sc1 is disposed immediately before the first filter chamber Fa1, it is possible to shorten the flow path length of the first branch section Sa25, and to reduce the variation in the pressure loss of the first branch section Sa25. The same applies to the second inlet Fa2_in.

A width $W_7$ of the first inlet Fa1_in in the +X direction and a width $W_8$ of the second inlet Fa2_in in the +X direction are smaller than the width $W_5$ in the +X direction of the part where the first filter chamber Fa1 and the second filter chamber Fa2 overlap each other when viewed in the +Y direction ($W_7<W_5$, $W_8<W_5$). In this manner, by setting the width $W_7$ of the first inlet Fa1_in and the width $W_8$ of the second inlet Fa2_in to be smaller than the width $W_5$ in the +X direction of the part where the first filter chamber Fa1 and the second filter chamber Fa2 overlap each other when viewed in the +Y direction, it is possible to increase the flow velocity of the ink flowing into the first filter chamber Fa1 and the second filter chamber Fa2, and to discharge the air bubbles contained in the ink in the first filter chamber Fa1 and the second filter chamber Fa2 to the downstream, that is, to improve the so-called air bubble discharge properties.

The first branch section Sa25 is formed on a straight line that connects the first inlet Fa1_in and the second inlet Fa2_in to each other. The first branch section Sa25 is disposed to be inclined with respect to the +X direction and the +Y direction. In the present embodiment, the first inlet Fa1_in is provided at the end portion of the first filter chamber Fa1 on the +X direction side, and the second inlet Fa2_in is provided at the end portion of the second filter chamber Fa2 on the −X direction side. As described above, the first filter chamber Fa1 and the second filter chamber Fa2 are disposed to be offset from each other in the +X direction so as to partially overlap each other when viewed in the +Y direction. Therefore, the second inlet Fa2_in is disposed on the −X direction side with respect to the first inlet Fa1_in. Therefore, the first branch section Sa25 is formed along a vector direction having components in the −X direction and the +Y direction from the first inlet Fa1_in toward the second inlet Fa2_in.

A part of the first branch section Sa25 and a part of the inner wall of the first filter chamber Fa1 are continuously provided along the +Y direction in a plan view when viewed in the +Z direction. In other words, an inner wall Sa25*a* of the first branch section Sa25 in the +X direction is continuously provided together with an inner wall Fa1*a* of the first filter chamber Fa1 in the +X direction on a straight line along the +Y direction. In other words, the inner wall Sa25*a* of the first branch section Sa25 and the inner wall Fa1*a* of the first filter chamber Fa1 are provided to be flush with each other.

By continuously providing the inner wall Sa25*a* of the first branch section Sa25 and the inner wall Fa1*a* of the first filter chamber Fa1 along the +Y direction, the ink from the first branch section Sa25 flows into the first filter chamber Fa1 from the first inlet Fa1 in along the inner walls Sa25*a* and Fa1*a*. Therefore, it is possible to suppress a decrease in the flow velocity of the ink when flowing into the first filter chamber Fa1, and to improve the discharge properties of air bubbles contained in the ink in the first filter chamber Fa1, so-called air bubble discharge properties.

Similarly, a part of the first branch section Sa25 and a part of the inner wall of the second filter chamber Fa2 are continuously provided along the +Y direction in a plan view when viewed in the +Z direction. In other words, an inner wall Sa25*b* of the first branch section Sa25 in the −X direction is continuously provided together with an inner wall Fa2*a* of the second filter chamber Fa2 in the −X direction on a straight line along the +Y direction. In other words, the inner wall Sa25*b* of the first branch section Sa25 and the inner wall Fa2*a* of the second filter chamber Fa2 are provided to be flush with each other.

In this manner, by continuously providing the inner wall Sa25*b* of the first branch section Sa25 and the inner wall Fa2*a* of the second filter chamber Fa2 along the +Y direction, the ink from the first branch section Sa25 flows into the second filter chamber Fa2 from the second inlet Fa2 in along the inner walls Sa25*b* and Fa2*a*. Therefore, it is possible to suppress a decrease in the flow velocity of the ink when flowing into the second filter chamber Fa2, and to improve the discharge properties of air bubbles contained in the ink in the second filter chamber Fa2, so-called air bubble discharge properties.

In the first branch section Sa25, between the first branch position Sc1 and the first inlet Fa1_in, a part, of which the width in the +X direction is smaller than the width $W_7$ of the first inlet Fa1_in in the +X direction, is provided. In the present embodiment, in the first branch section Sa25, the inner wall in the −X direction and the inner wall of the first filter chamber Fa1 in the +Y direction are coupled to each other on a curved surface, so-called R surface, and accordingly, the first branch section Sa25 is provided with a first throttle section Sa25*c* in which the width in the +X direction is smaller than that of the first inlet Fa1_in immediately before the first inlet Fa1_in. A width $Wa_1$ of the first throttle section Sa25*c* is smaller than the width $W_7$ of the first inlet Fa1_in ($Wa_1<W_7$).

In this manner, by providing the first throttle section Sa25*c* in the first branch section Sa25, it is possible to increase the flow velocity of the ink that flows into the first filter chamber Fa1 from the first branch section Sa25, and to improve the discharge properties of the air bubbles contained in the ink in the first filter chamber Fa1.

Similarly, in the first branch section Sa25, between the first branch position Sc1 and the second inlet Fa2_in, a part, of which the width in the +X direction is smaller than the width $W_8$ of the second inlet Fa2_in in the +X direction, is provided. In the present embodiment, in the first branch section Sa25, the inner wall in the +X direction and the inner wall of the second filter chamber Fa2 in the −Y direction are coupled to each other on a curved surface, so-called R surface, the first branch section Sa25 is provided with a second throttle section Sa25*d* in which the width in the +X direction is smaller than that of the second inlet Fa2_in immediately before the second inlet Fa2_in. A width $Wa_2$ of the second throttle section Sa25*d* is smaller than the width $W_8$ of the second inlet Fa2_in ($Wa_2<W_8$).

In this manner, by providing the second throttle section Sa25*d* in the first branch section Sa25, it is possible to increase the flow velocity of the ink that flows into the second filter chamber Fa2 from the first branch section Sa25, and to improve the discharge properties of the air bubbles contained in the ink in the second filter chamber Fa2.

In the present embodiment, as described above, the first branch section Sa25, the first inlet Fa1_in, and the second inlet Fa2_in are disposed at the same position in the +Z direction. In this manner, by providing the first branch section Sa25 at the same position as the first inlet Fa1_in and the second inlet Fa2_in in the +Z direction, it is possible to dispose the first branch position Sc1 at the same position in the +Z direction as the first inlet Fa1_in and the second inlet Fa2_in. By disposing the first branch position Sc1 at the same position in the +Z direction as the first inlet Fa1_in and the second inlet Fa2_in, it is possible to dispose the first branch position Sc1 immediately before the first filter chamber Fa1 and the second filter chamber Fa2 as compared with the configuration in which the first branch position Sc1 is disposed at the upper part on the Z-axis of the first filter chamber group Fa, that is, in the −Z direction, or at the lower part, that is, in the +Z direction. Therefore, it is possible to elongate the flow path length of the common part before the first branch position Sc1 of the first supply path Sa, and to simplify the layout of the first supply path Sa.

It is needless to say that the first branch section Sa25 is not particularly limited thereto, and a part of the first branch section Sa25 may be disposed at a position different from those of the first inlet Fa1_in and the second inlet Fa2_in in the +Z direction. The first branch position Sc1 may be disposed at a position different from those of the first inlet Fa1_in and the second inlet Fa2_in in the +Z direction. Furthermore, the first branch position Sc1 may be disposed at the same position in the +Z direction as the first inlet Fa1_in and the second inlet Fa2_in, and a part of the first branch section Sa25 may be disposed at a position different from those of the first inlet Fa1_in and the second inlet Fa2_in in the +Z direction.

The first outlet Fa1_out is disposed at a part that does not overlap the second filter chamber Fa2 when viewed in the +Y direction, and to be far from the second filter chamber Fa2 with respect to a center Fa1*c* of the first filter chamber Fa1 in the +Y direction. In other words, the first outlet Fa1_out is disposed in the region S3 on the outside of the region S2 in the +X direction, that is, on the −X direction side of the region S2 and on the −Y direction side of the center Fa1*c* of the first filter chamber Fa1 in the +Y direction. In other words, when the first filter chamber Fa1 is viewed in the +Z direction, in the rectangle having the smallest area including the first filter chamber Fa1, the first inlet Fa1_in is provided at one corner portion that forms a diagonal, that is, at corner portions in the +X direction and the +Y direction, and the first outlet Fa1_out is provided at the other corner portion that forms a diagonal, that is, in the vicinity of the corner portions in the −X direction and the −Y direction. Therefore, it is possible to dispose the first outlet Fa1_out away from the first inlet Fa1_in, and it is possible to suppress the occurrence of stagnation of ink that flows into the first filter chamber Fa1. In other words, the ink in the first filter chamber Fa1 flows fastest on the straight line that connects the first inlet Fa1_in and the first outlet Fa1_out to each other, and flows slowly as the ink moves away from the straight line. Therefore, by disposing the straight line that connects the first inlet Fa1_in and the first outlet Fa1_out to each other at a position away from the diagonal line of the first filter chamber Fa1, it is possible to reduce occurrence of stagnation of ink in the first filter chamber Fa1.

Similar to the first outlet Fa1_out, the second outlet Fa2_out is disposed at a part that does not overlap the first filter chamber Fa1 when viewed in the +Y direction, and to be far from the first filter chamber Fa1 with respect to a center Fa2*c* of the second filter chamber Fa2 in the +Y direction. In other words, the second outlet Fa2_out is disposed in the region S4 on the outside of the region S2 in the +X direction, that is, on the +X direction side of the region S2, and on the +Y direction side of the center Fa2*c* of the second filter chamber Fa2 in the +Y direction. Therefore, it is possible to dispose the second outlet Fa2_out away from the second inlet Fa2_in, and it is possible to reduce the occurrence of stagnation of ink that flows into the second filter chamber Fa2.

In other words, the first inlet Fa1_in and the first outlet Fa1_out, and the second inlet Fa2_in and the second outlet Fa2_out can be disposed at positions point-symmetrical with respect to the first branch position Sc1.

The ink flow from the first inlet Fa1_in to the first outlet Fa1_out and the ink flow from the second inlet Fa2_in to the second outlet Fa2_out can be reversed to each other. Therefore, the positions of the first outlet Fa1_out and the second outlet Fa2_out can be disposed at positions point-symmetrical with respect to the first branch position Sc1. Therefore, when the first nozzle row La1 and the second nozzle row La1 are offset from each other in the +X direction, the introduction port Rin communicating with each nozzle row L, that is, both the first introduction port Rin1 and the second introduction port Rin2 are offset from each other in the +X direction, but by aligning the deviation of the first introduction port Rin1 and the second introduction port Rin2 in the +X direction, it is possible to deviate the positions of the first outlet Fa1_out and the second outlet Fa2_out. Accordingly, it is possible to shorten the distance from the first outlet Fa1_out to the first introduction port Rin1 and the distance from the second outlet Fa2_out to the second introduction port Rin2, and to suppress the variation in the pressure loss by the short flow path length.

The second supply path Sb has the same configuration as that of the first supply path Sa. In other words, as illustrated in FIGS. 12 to 15, the second supply path Sb includes the second introduction section Sb1, the second supply flow path Sb2, the second filter chamber group Fb having a third filter chamber Fb1 and a fourth filter chamber Fb2, a third outflow flow path Sb3, and a fourth outflow flow path Sb4, from the upstream to the downstream.

The second introduction section Sb1 is for introducing the ink Ib into the flow path member 60 from the outside, and is provided so as to penetrate the first flow path substrate 81, the second flow path substrate 82, and the third flow path substrate 83 over the Z-axis from the inside of the supply pipe PBin protruding in the −Z direction of the first flow path substrate 81.

One end of the second supply flow path Sb2 is coupled to the second introduction section Sb1, the second supply flow path Sb2 is branched in the middle, and the other two branched ends are respectively coupled to the third filter chamber Fb1 and the fourth filter chamber Fb2 that form the second filter chamber group Fb. Specifically, the second supply flow path Sb2 includes a second supply section Sb21, a second penetration section Sb22, a second linking section Sb23, a second coupling section Sb24, and a second branch section Sb25, from the upstream to the downstream.

The second supply section Sb21, the second penetration section Sb22, the second linking section Sb23, the second coupling section Sb24, and the second branch section Sb25 of the second supply flow path Sb2 respectively correspond to the first supply section Sa21, the first penetration section Sa22, the first linking section Sa23, the first coupling section Sa24, and the first branch section Sa25 of the first supply flow path Sa2, and have almost the same configuration, and thus, the duplicate description thereof will be omitted. Incidentally, the second branch section Sb25 corresponds to the "branch flow path". In other words, the middle of the second branch section Sb25 is coupled to the other end of the second coupling section Sb24, which is open on the surface of the second flow path substrate 82 on the +Z direction side. The part where the second coupling section Sb24 and the second branch section Sb25 are coupled to each other is a second branch position Sc2 where the second supply flow path Sb2 is branched and the ink, which is a liquid, is distributed to the third filter chamber Fb1 and the fourth filter chamber Fb2.

The third filter chamber Fb1 is provided at an interface where the second flow path substrate 82 and the third flow path substrate 83 are fixed to each other. The third filter chamber Fb1 is formed by aligning the openings of the recess portion provided in the second flow path substrate 82 and the recess portion provided in the third flow path substrate 83 with each other. The filter F is provided in the third filter chamber Fb1. The filter F is provided at an interface where the second flow path substrate 82 and the third flow path substrate 83 are fixed to each other, and the third filter chamber Fb1 is divided into a third upstream filter chamber Fb11 on the upstream and a third downstream filter chamber Fb12 on the downstream. In other words, the recess portion provided in the second flow path substrate 82 is the third upstream filter chamber Fb11, and the recess portion provided in the third flow path substrate 83 is the third downstream filter chamber Fb12. As the filter F provided in the third filter chamber Fb1, the same filter F as the filter F disposed in the first filter chamber Fa1 can be used.

As illustrated in FIG. 16, similar to the first filter chamber Fa1, the third filter chamber Fb1 has a shape elongated in the +Y direction. In the present embodiment, the third filter chamber Fb1 has the same shape as that of the first filter chamber Fa1 when viewed in the +Z direction. In this manner, by forming the first filter chamber Fa1 and the third filter chamber Fb1 in the same shape, it is possible to reduce the variation in the effective area of the filter F provided in each of the first filter chamber Fa1 and the third filter chamber Fb1, and to reduce the variation in the pressure loss due to the variation in the effective area of the filter F. It is needless to say that the shape of the third filter chamber Fb1 is not particularly limited thereto, and may be the same as any of the shapes of the first filter chamber Fa1 exemplified above.

One end of the second branch section Sb25 of the second supply flow path Sb2 is coupled to the third filter chamber Fb1. Here, the fact that the second supply flow path Sb2 communicates with the third filter chamber Fb1 means that the second supply flow path Sb2 communicates with the third upstream filter chamber Fb11 on the upstream of the filter F of the third filter chamber Fb1. In other words, one end of the second branch section Sb25 of the second supply flow path Sb2 is provided to be open on the inner wall surface of the third upstream filter chamber Fb11. In the present embodiment, the opening of the second branch section Sb25 that is open on the inner surface of the third filter chamber Fb1 is referred to as a third inlet Fb1_in.

The third filter chamber Fb1 has a third outlet Fb1_out through which ink flows out. Here, the fact that the third filter chamber Fb1 has the third outlet Fb1_out means that the third outlet Fb1_out is provided on the downstream separated by the filter F of the third filter chamber Fb1, that is, in the third downstream filter chamber Fb12. The third outlet Fb1_out is an opening of the third outflow flow path Sb3 that is open on the inner wall of the third filter chamber Fb1.

The third outflow flow path Sb3 includes a third outflow penetration section Sb31, a third outflow section Sb32, and a third outflow coupling section Sb33. The third outflow penetration section Sb31, the third outflow section Sb32, and the third outflow coupling section Sb33 that form the third outflow flow path Sb3 are substantially the same as the first outflow penetration section Sa31, the first outflow section Sa32, and the first outflow coupling section Sa33 that form the first outflow flow path Sa1, respectively, and thus, duplicate description thereof will be omitted.

The other end of the third outflow coupling section Sb33 of the third outflow flow path Sb3, which is open on the surface of the fourth flow path substrate on the +Z direction side is coupled to the third introduction port Rin3 of the first head chip 44A via the communication path 34 of the holder 30.

The fourth filter chamber Fb2 is provided at an interface where the second flow path substrate 82 and the third flow path substrate 83 are fixed to each other. The fourth filter chamber Fb2 is formed by aligning the openings of the recess portion provided in the second flow path substrate 82 and the recess portion provided in the third flow path substrate 83. The filter F is provided in the fourth filter chamber Fb2. The filter F is provided at an interface where the second flow path substrate 82 and the third flow path substrate 83 are fixed to each other, and the fourth filter chamber Fb2 is divided into a fourth upstream filter chamber Fb21 on the upstream and a fourth downstream filter chamber Fb22 on the downstream. As the filter F provided in the fourth filter chamber Fb2, the same filter F as the filter F disposed in the first filter chamber Fa1 can be used.

Similar to the first filter chamber Fa1, the fourth filter chamber Fb2 has a shape elongated in the +Y direction. In the present embodiment, the fourth filter chamber Fb2 has the same shape as the third filter chamber Fb1 when viewed in the +Z direction. In this manner, by forming the third filter chamber Fb1 and the fourth filter chamber Fb2 in the same shape, it is possible to reduce the variation in the effective area of the filter F provided in each of the third filter chamber Fb1 and the fourth filter chamber Fb2, and to reduce the variation in the pressure loss due to the variation in the effective area of the filter F. It is needless to say that the shape of the fourth filter chamber Fb2 is not particularly limited thereto, and may be the same as any of the shapes of the first filter chamber Fa1 exemplified above.

The other end of the second branch section Sb25 of the second supply flow path Sb2 is coupled to the fourth filter chamber Fb2. Here, the fact that the second supply flow path Sb2 communicates with the fourth filter chamber Fb2 means that the second supply flow path Sb2 communicates with the fourth upstream filter chamber Fb21 on the upstream of the filter F of the fourth filter chamber Fb2. In other words, the other end of the second branch section Sb25 of the second supply flow path Sb2 is provided to be open on the inner wall surface of the fourth upstream filter chamber Fb21. In the present embodiment, the opening of the second branch section Sb25, which is open on the inner surface of the fourth filter chamber Fb2, is referred to as a fourth inlet Fb2_in.

The fourth filter chamber Fb2 has a fourth outlet Fb2_out through which ink flows out. Here, the fact that the fourth filter chamber Fb2 has the fourth outlet Fb2_out means that the fourth outlet Fb2_out is provided on the downstream separated by the filter F of the fourth filter chamber Fb2, that is, in the fourth downstream filter chamber Fb22. The fourth outlet Fb2_out is an opening of the fourth outflow flow path Sb4, which is open on the inner wall of the fourth filter chamber Fb2.

The fourth outflow flow path Sb4 includes a fourth outflow penetration section Sb41, a fourth outflow section Sb42, and a fourth outflow coupling section Sb43. The fourth outflow penetration section Sb41, the fourth outflow section Sb42, and the fourth outflow coupling section Sb43 that form the fourth outflow flow path Sb4 are substantially the same as the second outflow penetration section Sa41, the second outflow section Sa42, and the second outflow coupling section Sa43 that form the second outflow flow path Sa4, respectively, and thus, duplicate description thereof will be omitted.

The other end of the fourth outflow coupling section Sb43 of the fourth outflow flow path Sb4, which is open on the surface of the fourth flow path substrate 84 on the +Z direction side is coupled to the fourth introduction port Rin4 of the second head chip 44B via the communication path 34 of the holder 30.

Since the relationship between the third filter chamber Fb1 and the fourth filter chamber Fb2 is the same as the relationship between the first filter chamber Fa1 and the second filter chamber Fb2, duplicate description thereof will be omitted. In other words, the first filter chamber Fa1 corresponds to the third filter chamber Fb1, and the second filter chamber Fa2 corresponds to the third filter chamber Fb2. Therefore, the relationship between the first filter chamber Fa1 and the second filter chamber Fa2 described above can be applied to the third filter chamber Fb1 and the fourth filter chamber Fb2. Since the third inlet Fb1_in and the third outlet Fb1_out of the third filter chamber Fb1 are the same as the first inlet Fa1_in and the first outlet Fa1_out of the first filter chamber Fa1, and thus, duplicate description thereof will be omitted. Similarly, since the fourth inlet Fb2_in and the third outlet Fb2_out of the fourth filter chamber Fb2 are the same as the second inlet Fa2_in and the second outlet Fa2_out of the second filter chamber Fa2, and thus, duplicate description thereof will be omitted.

In the present embodiment, as illustrated in FIGS. 12 to 15 and the like, the first introduction section Sa1, the second introduction section Sb1, the first filter chamber group Fa, and the second filter chamber group Fb are disposed in the +X direction in this order.

In other words, with reference to the first introduction section Sa1 positioned most on the −X direction side, the second introduction section Sb1 is positioned on the +X direction side of the first introduction section Sa1, the first filter chamber group Fa is positioned on the +X direction side of the second introduction section Sb1, and the second filter chamber group Fb is positioned on the +X direction side of the first filter chamber group Fa. The fact that the first filter chamber group Fa and the second filter chamber group Fb are disposed in the +X direction in this order means that a center C2 of a region S11 in the +X direction including the third filter chamber Fb1 and the fourth filter chamber Fb2 that form the second filter chamber group Fb is positioned in the +X direction, as compared with a center C1 of a region S10 in the +X direction including the first filter chamber Fa1 and the second filter chamber Fa2 that form the first filter chamber group Fa. Therefore, for example, the second filter chamber Fa2 and the third filter chamber Fb1 may be disposed so as to overlap each other when viewed in the +Y direction.

In this manner, by disposing the first introduction section Sa1, the second introduction section Sb1, the first filter chamber group Fa, and the second filter chamber group Fb in this order in the +X direction, it is possible to suppress the variation in the flow path length between a first supply flow path Sa2 that couples the first introduction section Sa1 and the first filter chamber group Fa to each other and a second supply flow path Sb2 that couples the second introduction section Sb1 and the second filter chamber group Fb to each other. Therefore, it is possible to reduce the variation in the pressure loss between the first supply flow path Sa2 and the second supply flow path Sb2, and to reduce the variation in the supply pressure for supplying ink to each head chip 44. Therefore, in each head chip 44, it is possible to reduce the variation in the discharge characteristics of discharging the ink supplied from the first supply flow path Sa2 and the discharge characteristics of discharging the ink supplied from the second supply flow path Sb2. In other words, it is possible to reduce the variation in the discharge characteristics of ink droplets between the nozzle rows for discharging ink, which have different supply paths in the first supply flow path Sa2 and the second supply flow path Sb2, and to improve the print quality.

In the present embodiment, as illustrated in FIG. 16, the third filter chamber Fb1 is disposed to be adjacent to the first filter chamber Fa1 in the +X direction. In the present embodiment, the first filter chamber Fa1 and the third filter chamber Fb1 are arranged side by side in the +X direction such that the positions in the +Y direction are the same. In other words, the first filter chamber Fa1 and the third filter chamber Fb1 are disposed to partially, and in the present embodiment, completely overlap each other when viewed in the +X direction.

Similarly, the fourth filter chamber Fb2 is disposed to be adjacent to the second filter chamber Fa2 in the +X direction. In the present embodiment, the second filter chamber Fa2 and the fourth filter chamber Fb2 are arranged side by side in the +X direction such that the positions in the +Y direction are the same. In other words, the second filter chamber Fa2 and the fourth filter chamber Fb2 are disposed to partially, and in the present embodiment, completely overlap each other when viewed in the +X direction.

The second filter chamber Fa2 and the third filter chamber Fb1 of the present embodiment are disposed so as to partially overlap each other when viewed in the +Y direction. In this manner, by disposing the second filter chamber Fa2 and the third filter chamber Fb1 so as to partially overlap each other when viewed in the +Y direction, the first filter chamber group Fa and the second filter chamber group Fb can be disposed close to each other in the +X direction. Therefore, the size of the recording head 10 can be reduced in the +X direction.

In the present embodiment, in the first filter chamber group Fa, the second filter chamber Fa2 is disposed at a position offset from the first filter chamber Fa1 in the +X direction, and in the second filter chamber group Fb, the fourth filter chamber Fb2 is disposed at a position offset from the third filter chamber Fb1 in the +X direction. Thus, the second filter chamber Fa2 and the third filter chamber Fb1 are disposed so as to partially overlap each other when viewed in the +Y direction, but the present disclosure is not particularly limited thereto. For example, in the first filter chamber group Fa, the second filter chamber Fa2 may be disposed at a position offset from the first filter chamber Fa1 in the −X direction, and in the second filter chamber group Fb, the fourth filter chamber Fb2 may be disposed at a position offset from the third filter chamber Fb1 in the −X direction. In this case, the first filter chamber Fa1 and the fourth filter chamber Fb2 can be disposed so as to partially overlap each other when viewed in the +Y direction.

As illustrated in FIG. 16, in a plan view when viewed in the +Z direction, a line segment Ls1 that connects the first outlet Fa1_out and the third outlet Fb1_out to each other, and a line segment Ls2 that connects the first introduction port Rin1 and the third introduction port Rin3 to each other are disposed so as to overlap each other. The line segment Ls1 is a line segment that connects the center of the first outlet Fa1_out and the center of the third outlet Fb1_out to each other. The line segment Ls2 is a line segment that connects the center of the first introduction port Rin1 and the center of the third introduction port Rin3 to each other. The fact that the line segment Ls1 and the line segment Ls2 overlap each other in a plan view when viewed in the +Z direction includes the fact that the line segment Ls1 and the line segment Ls2 intersect with each other or completely match each other. In this manner, by disposing the first outlet Fa1_out, the third outlet Fb1_out, the first introduction port Rin1, and the third introduction port Rin3 such that the line segment Ls1 and the line segment Ls2 overlap each other, it is possible to reduce the variation in the flow path length between the first outflow flow path Sa3 on the downstream of the first filter chamber Fa1 and the third outflow flow path Sb3 on the downstream of the third filter chamber Fb1, and to reduce the variation in the pressure loss between the first outflow flow path Sa3 and the third outflow flow path Sb3. Therefore, it is possible to reduce the variation in the discharge characteristics of the ink droplets of the ink Ia discharged from the first nozzle row La1 communicating with the first introduction port Rin1 and the ink droplets of the ink Ib discharged from the third nozzle row Lb1 communicating with the third introduction port Rin3, and to improve the print quality.

The same applies to the second outlet Fa2_out, the fourth outlet Fb2_out, the second introduction port Rin2, and the fourth introduction port Rin4. In other words, in a plan view when viewed in the +Z direction, a line segment Ls3 that connects the second outlet Fa2_out and the fourth outlet Fb2_out to each other, and a line segment Ls4 that connects the second introduction port Rin2 and the fourth introduction port Rin4 to each other are disposed so as to overlap each other. The line segment Ls3 is a line segment that connects the center of the second outlet Fa2_out and the center of the fourth outlet Fb2_out to each other. The line segment Ls4 is a line segment that connects the center of the second introduction port Rin2 and the center of the fourth introduction port Rin4 to each other. The fact that the line segment Ls3 and the line segment Ls4 overlap each other in a plan view when viewed in the +Z direction includes the fact that the line segment Ls3 and the line segment Ls4 intersect with each other or completely match each other. In this manner, by disposing the second outlet Fa2_out, the fourth outlet Fb2_out, the second introduction port Rin2, and the fourth introduction port Rin4 such that the line segment Ls3 and the line segment Ls4 overlap each other, it is possible to reduce the variation in the flow path length between the second outflow flow path Sa4 on the downstream of the second filter chamber Fa2 and the fourth outflow flow path Sb4 on the downstream of the fourth filter chamber Fb2, and to reduce the variation in the pressure loss between the second outflow flow path Sa4 and the fourth outflow flow path Sb4. Therefore, it is possible to reduce the variation in the discharge characteristics of the ink droplets of the ink Ia discharged from the second nozzle row La1 communicating with the second introduction port Rin2 and the ink droplets of the ink Ib discharged from the fourth nozzle row Lb2 communicating with the fourth introduction port Rin4, and to improve the print quality.

The first outlet Fa1_out and the third outlet Fb1_out are arranged side by side in the +X direction, and the first introduction port Rin1 and the second introduction port Rin2 are arranged side by side in the +Y direction. In a plan view when viewed in the +Z direction, the center position between the first outlet Fa1_out and the third outlet Fb1_out and the center position between the first introduction port Rin1 and the third introduction port Rin3 substantially match each other. Here, the fact that the center position between the first outlet Fa1_out and the third outlet Fb1_out and the center position between the first introduction port Rin1 and the third introduction port Rin3 substantially match each other means that a virtual outlet V_out disposed at the center of the first outlet Fa1_out and the third outlet Fb1_out when viewed in the +Z direction and a virtual introduction port V_in disposed at the center of the first introduction port Rin1 and the third introduction port Rin3 at least partially overlap each other.

The virtual outlet V_out has the center disposed at the center of the line segment Ls1 that connects the first outlet Fa1_out and the third outlet Fb1_out to each other. The size of the virtual outlet V_out is the same as the larger opening of the first outlet Fa1_out and the third outlet Fb1_out.

The virtual introduction port V_in has the center disposed at the center of the line segment Ls2 that connects the first introduction port Rin1 and the third introduction port Rin3 to each other. The size of the virtual introduction port V_in is the same as the larger opening of the first introduction port Rin1 and the third introduction port Rin3.

The fact that the center position between the first outlet Fa1_out and the third outlet Fb1_out and the center position between the first introduction port Rin1 and the third introduction port Rin3 substantially match each other means that at least a part of the virtual outlet V_out and a part of the virtual introduction port V_in overlap each other when viewed in the +Z direction. In this manner, by making the center position between the first outlet Fa1_out and the third outlet Fb1_out and the center position between the first introduction port Rin1 and the third introduction port Rin3 substantially match each other, it is possible to reduce the variation in the flow path length between the first outflow flow path Sa3 on the downstream of the first filter chamber Fa1 and the third outflow flow path Sb3 on the downstream of the third filter chamber Fb1, and to reduce the variation in the pressure loss between the first outflow flow path Sa3 and the third outflow flow path Sb3. Therefore, it is possible to reduce the variation in the discharge characteristics of the ink droplets of the ink Ia discharged from the first nozzle row La1 communicating with the first introduction port Rin1 and the discharge characteristics of the ink droplets of the ink Ib discharged from the third nozzle row Lb1 communicating with the third introduction port Rin3, and to improve the print quality.

It is more preferable that the virtual outlet V_out and the virtual introduction port V_in completely overlap each other when viewed in the +Z direction. Incidentally, the fact that the virtual outlet V_out and the virtual introduction port V_in completely overlap each other when viewed in the +Z direction means that, when one of the virtual outlet V_out and the virtual introduction port V_in has a larger opening area compared to that of the other one, the other opening completely overlaps one opening. It is more preferable that the center of the virtual outlet V_out and the center of the virtual introduction port V_in are disposed at the same position when viewed in the +Z direction. Accordingly, it is possible to further reduce the variation in the flow path length between the first outflow flow path Sa3 and the third outflow flow path Sb3, and to reduce the variation in the pressure loss between the first outflow flow path Sa3 and the third outflow flow path Sb3.

In the present embodiment, as described above, the first filter chamber Fa1 and the third filter chamber Fb1 are disposed to be adjacent to each other in the +X direction, and has a shape elongated in the +Y direction when viewed in the +Z direction. Therefore, the first outlet Fa1_out and the third outlet Fb1_out can be disposed close to each other depending on the shape and arrangement of the first filter chamber Fa1 and the third filter chamber Fb1. Therefore, it is possible to shorten the flow path length between the first outflow flow path Sa3, which is the flow path from the first outlet Fa1_out to the first introduction port Rin1, and the third outflow flow path Sb3, which is the flow path from the third outlet Fb1_out to the third introduction port Rin3, and to reduce the variation in the pressure loss between the first outflow flow path Sa3 and the third outflow flow path Sb3.

The second outlet Fa2_out and the fourth outlet Fb2_out, and the second introduction port Rin2 and the fourth introduction port Rin4 also have the same relationship as that between the first outlet Fa1_out and the third outlet Fb1_out, and between the first introduction port Rin1 and the fourth introduction port Rin4. In other words, as illustrated in FIG. 16, the second outlet Fa2_out and the fourth outlet Fb2_out are arranged side by side in the +X direction, and the second introduction port Rin2 and the fourth introduction port Rin4 are arranged side by side in the +Y direction. In a plan view when viewed in the +Z direction, the center position between the second outlet Fa2_out and the fourth outlet Fb2_out and the center position between the second introduction port Rin2 and the fourth introduction port Rin4 substantially match each other. The fact that the center position between the second outlet Fa2_out and the fourth outlet Fb2_out and the center position between the second introduction port Rin2 and the fourth introduction port Rin4 substantially match each other means the same relationship as that between the center position between the first outlet Fa1_out and the third outlet Fb1_out and the center position between the first introduction port Rin1 and the third introduction port Rin3, and thus, duplicate description thereof will be omitted. In this manner, by making the center position between the second outlet Fa2_out and the fourth outlet Fb2_out and the center position between the second introduction port Rin2 and the fourth introduction port Rin4 substantially match each other, it is possible to reduce the variation in the flow path length between the second outflow flow path Sa4 on the downstream of the second filter chamber Fa2 and the fourth outflow flow path Sb4 on the downstream of the fourth filter chamber Fb2, and to reduce the variation in the pressure loss between the second outflow flow path Sa4 and the fourth outflow flow path Sb4. Therefore, it is possible to reduce the variation in the discharge characteristics of the ink droplets of the ink Ia discharged from the second nozzle row La2 communicating with the second introduction port Rin2 and the discharge characteristics of the ink droplets of the ink Ib discharged from the fourth nozzle row Lb2 communicating with the fourth introduction port Rin4, and to improve the print quality.

In the present embodiment, the first outlet Fa1_out, the third outlet Fb1_out, the first introduction port Rin1, and the third introduction port Rin3, the second outlet Fa2_out, the fourth outlet Fb2_out, the second introduction port Rin2, and the fourth introduction port Rin4 are disposed to be substantially point-symmetrical to each other. Therefore, it is possible to suppress the variation in the flow path length between the first outflow flow path Sa3 and the third outflow flow path Sb3, and the second outflow flow path Sa4 and the fourth outflow flow path Sb4, and to reduce the variation in pressure loss. Therefore, by reducing the variation in the pressure loss between the second outflow flow path Sa4 and the fourth outflow flow path Sb4, it is possible to improve the print quality by aligning the discharge characteristics of the ink droplets discharged from the first nozzle row La1, the third nozzle row Lb1, the second nozzle row La2, and the fourth nozzle row Lb2.

The flow path member 60 of the present embodiment is further provided with the first discharge path Da and the second discharge path Db.

As illustrated in FIGS. 12, 13, 18, and 19, the first discharge path Da includes two first discharge penetration sections Da1, a first discharge branch section Da2, and the first discharge section Da3 from the upstream to the downstream.

The first discharge penetration section Da1 is provided so as to penetrate the fourth flow path substrate 84 over the Z-axis such that one end is open on the surface of the fifth flow path substrate 85 on the +Z direction side. In the present embodiment, two first discharge penetration sections Da1 are provided. In other words, the two first discharge penetration sections Da1 are provided at a position that communicates with the communication path 34 of the holder 30 corresponding to each of one discharge port Rout of the first head chip 44A and one discharge port Rout of the second head chip 44B.

The first discharge branch section Da2 is provided at the interface where the fourth flow path substrate 84 and the fifth flow path substrate 85 are fixed to each other, and extends along the in-plane direction of the XY plane. The first discharge branch section Da2 communicates with the other end of the first discharge penetration section Da1, which is open on the surface on the −Z direction side of the fourth flow path substrate 84 at both ends.

The first discharge section Da3 is for discharging ink from the inside of the flow path member 60 to the outside, and is provided so as to penetrate the first flow path substrate 81, the second flow path substrate 82, the third flow path substrate 83, and the fourth flow path substrate 84 over the Z-axis from the inside of the discharge pipe PAout protruding in the −Z direction of the first flow path substrate 81. One end of the first discharge section Da3 is provided so as to communicate with the middle of the first discharge branch section Da2. In the present embodiment, the first discharge section Da3 is provided so as to communicate with one end portion side of the first discharge branch section Da2 in the +X direction.

In the first discharge path Da, the ink Ia discharged from the discharge ports Rout of each of the two head chips 44 merges at the first discharge branch section Da2 via the communication path 34 of the holder 30 and the first discharge penetration section Da1, and returns to the liquid container 2A via the first discharge section Da3 and the discharge tube TAout.

The second discharge path Db includes a second discharge penetration section Db1, a second discharge branch section Db2, and the second discharge section Db3 from the upstream to the downstream.

The second discharge penetration section Db1 is provided so as to penetrate the fourth flow path substrate 84 and the fifth flow path substrate 85 over the Z-axis such that one end is open on the surface of the fourth flow path substrate 84 on the +Z direction side. In the present embodiment, two second discharge penetration sections Db1 are provided. In other words, the two second discharge penetration sections Db1 are provided at a position that communicates with the communication path 34 of the holder 30 corresponding to each of the other one discharge port Rout of the second head chip 44B and the other discharge port Rout of the second head chip 44B.

The second discharge branch section Db2 is provided at the interface where the third flow path substrate 83 and the fourth flow path substrate 84 are fixed to each other, and extends along the in-plane direction of the XY plane. The second discharge branch section Db2 communicates with the other end of the second discharge penetration section Db1, which is open on the surface on the −Z direction side of the third flow path substrate 83 at both ends.

The second discharge section Db3 is for discharging ink from the inside of the flow path member 60 to the outside, and is provided so as to penetrate the first flow path substrate 81, the second flow path substrate 82, and the third flow path substrate 83 over the Z-axis from the inside of the discharge pipe PBout protruding in the −Z direction of the first flow path substrate 71. One end of the second discharge section Db3 is provided so as to communicate with the middle of the second discharge branch section Db2. In the present embodiment, the second discharge section Db3 is provided so as to communicate with one end portion side of the second discharge branch section Db2 in the +X direction.

In the second discharge path Db, the ink Ib discharged from the discharge ports Rout of each of the two head chips 44 merges at the second discharge branch section Db2 via the communication path 34 of the holder 30 and the second discharge penetration section Db1, and returns to the liquid container 2B via the second discharge section Db3 and the discharge tube TBout.

In the recording head 10 having the above-described configuration, ink is supplied from the liquid container 2 to the head chip 44 via the flow path member 60, the print signal or the like is transmitted from the control unit 3 to the head chip 44 via the relay substrate 73 or the like, the piezoelectric actuator 484 in the head chip 44 is driven based on the print signal or the like, and accordingly, ink droplets are ejected from the nozzle N.

As described above, the ink jet type recording head 10 which is the liquid ejecting head according to the present embodiment includes: the first nozzle row La1 extending in the +X direction, which is the first direction; the second nozzle row La2 extending in the +X direction; the first supply flow path Sa2 for supplying ink to the first nozzle row La1 and the second nozzle row La2; the first filter chamber Fa, which has the first inlet Fa1_in through which the ink flows in from the first supply flow path Sa2, and in which the ink supplied from the first supply flow path Sa2 to the first nozzle row flows; and the second filter chamber Fb, which has the second inlet Fa2_in through which the ink flows in from the first supply flow path Sa2, and in which the ink supplied from the first supply flow path Sa2 to the second nozzle row La2 flows, the first nozzle row La1 and the second nozzle row La2 are disposed to be offset from each other in both the +X direction and the +Y direction orthogonal to the +X direction, the first nozzle row La1 ejects the liquid in the +Z direction, which is the third direction, orthogonal to the +X direction and the +Y direction, the first supply flow path Sa2 has the first branch section Sa25, which is the branch flow path, for distributing the ink between the first filter chamber Fa1 and the second filter chamber Fa2 at the first branch position Sc1, which is the branch position, the first branch position Sc1 is disposed between the first filter chamber Fa1 and the second filter chamber Fa2 in a plan view when viewed in the +Z direction, the first filter chamber Fa1 and the second filter chamber Fa2 are disposed so as to at least partially overlap each other when viewed in the +Y direction, and the first inlet Fa1_in and the second inlet Fa2_in are disposed at a part where the first filter chamber Fa1 and the second filter chamber Fa2 overlap each other when viewed in the +Y direction.

In this manner, even when the first nozzle row La1 and the second nozzle row La2 are disposed so as to be offset from each other in both the +X direction and the +Y direction, the first filter chamber Fa1 and the second filter chamber Fa2 are disposed so as to at least partially overlap each other when viewed in the +Y direction, and accordingly, it is possible to dispose the first branch position Sc1 immediately before the first filter chamber Fa1 and the second filter chamber Fa2. Therefore, it is possible to shorten the flow path length of the first branch section Sa25, to suppress the variation in the flow path length from the first branch position Sc1 to the first filter chamber Fa1 and the flow path length from the first branch position Sc1 to the second filter chamber Fa2, and to suppress the variation in the pressure loss due to the variation in the flow path length. Accordingly, it is possible to reduce the variation in the discharge characteristics of the ink droplets discharged from the first nozzle row La1 and the second nozzle row La2, and to improve the print quality. Therefore, since it is possible to shorten the flow path length of the first branch section Sa25, it is possible to elongate the flow path length of the common part before the first branch position Sc1 of the first supply flow path Sa2, and to simplify the layout of the first supply flow path Sa2.

In the recording head 10 of the present embodiment, it is preferable that the first inlet Fa1_in is disposed on the surface of the first filter chamber Fa1 facing the second filter chamber Fa2, and the second inlet Fa2_in is disposed on the surface of the second filter chamber Fa2 facing the first filter chamber Fa1. In this manner, by disposing the first inlet Fa1_in on the surface of the first filter chamber Fa1 facing the second filter chamber Fa2, and by disposing the second inlet Fa2_in on the surface of the second filter chamber Fa2 facing the first filter chamber Fa1, the first branch position Sc1 can be disposed immediately before the first filter chamber Fa1 and the second filter chamber Fa2.

In the recording head 10 of the present embodiment, it is preferable that the first filter chamber Fa1 and the second filter chamber Fa2 are disposed to be offset from each other in the +X direction, which is the first direction, so as to partially overlap each other when viewed in the +Y direction, which is the second direction. In this manner, as the first filter chamber Fa1 and the second filter chamber Fa2 are disposed to be offset from each other in the +X direction so as to partially overlap each other when viewed in the +Y direction, in the recording head 10 in which the nozzle rows are disposed to be offset from each other, even when the two introduction ports Rin are offset from each other in the +X direction, the distance between the first filter chamber Fa1 and the introduction port Rin and the distance between the second filter chamber Fa2 and the introduction port Rin can be shortened. Therefore, it is possible to reduce the variation in the pressure loss of the ink supplied to the two introduction ports Rin.

In the recording head 10 of the present embodiment, it is preferable that the width $W_5$ in the +X direction, which is the first direction, of the part where the first filter chamber Fa1 and the second filter chamber Fa2 overlap each other when viewed in the +Y direction, which is the second direction, is smaller than half the width $W_6$ of the first filter chamber Fa1 in the +X direction. In this manner, by setting the width $W_5$ where the first filter chamber Fa1 and the second filter chamber Fa2 overlap each other to be smaller than half the width $W_6$ of the first filter chamber Fa1, even when the first inlet Fa1_in is disposed at the end portion of the first filter chamber Fa1, and even when the second inlet Fa2_in is disposed at the end portion of the second filter chamber Fa2, it is possible to make the first filter chamber Fa1 and the second filter chamber Fa2 easily get closer to each other in the +Y direction. By bringing the first filter chamber Fa1 and the second filter chamber Fa2 closer to each other in the +Y direction, the size of the recording head 10 can be reduced in the +Y direction. By bringing the first filter chamber Fa1 and the second filter chamber Fa2 closer to each other in the +Y direction, the head chips 44 arranged side by side in the +Y direction can get closer to each other in the +Y direction, and it is possible to reduce the difference in the discharge timing of ink droplets discharged from different head chips 44. Therefore, it is possible to suppress the deviation of the landing position of the ink droplet on the medium S.

In the recording head 10 of the present embodiment, it is preferable that each of the widths $W_7$ and $W_8$ of the first inlet Fa1_in and the second inlet Fa2_in in the +X direction, which is the first direction, are smaller than the width $W_5$ in the +X direction of the part where the first filter chamber Fa1 and the second filter chamber Fa2 overlap each other when viewed in the +Y direction, which is the second direction. In this manner, by setting the width $W_7$ of the first inlet Fa1_in and the width $W_8$ of the second inlet Fa2_in to be smaller than the width $W_5$ in the +X direction, which is the first direction, of the part where the first filter chamber Fa1 and the second filter chamber Fa2 overlap each other when viewed in the +Y direction, which is the second direction, it is possible to increase the flow velocity of the ink flowing into the first filter chamber Fa1 and the second filter chamber Fa2, and to discharge the air bubbles contained in the ink in the first filter chamber Fa1 and the second filter chamber Fa2 to the downstream, that is, to improve the so-called air bubble discharge properties.

In the recording head 10 of the present embodiment, it is preferable that the inner wall Sa25*a*, which is a part, of the first branch section Sa25, which is the branch flow path, and the inner wall Fa1*a*, which is a part, of the inner wall of the first filter chamber Fa1 are continuous along the +Y direction, which is the second direction, in the plan view when viewed in the +Z direction, and the inner wall Sa25*b* of the first branch section Sa25 and the inner wall Fa2*a*, which is a part, of the inner wall of the second filter chamber Fa2 are continuous along the +Y direction in a plan view when viewed in the +Z direction. By continuously providing the inner wall Sa25*a* of the first branch section Sa25 and the inner wall Fa1*a* of the first filter chamber Fa1 along the +Y direction, the ink from the first branch section Sa25 flows into the first filter chamber Fa1 from the first inlet Fa1_in along the inner walls Sa25*a* and Fa1*a*. Therefore, it is possible to suppress a decrease in the flow velocity of the ink when flowing into the first filter chamber Fa1, and to improve the discharge properties of air bubbles contained in the ink in the first filter chamber Fa1, so-called air bubble discharge properties. Similarly, by continuously providing the inner wall Sa25*b* of the first branch section Sa25 and the inner wall Fa2*a* of the second filter chamber Fa2 along the +Y direction, the ink from the first branch section Sa25 flows into the second filter chamber Fa2 from the second inlet Fa2_in along the inner walls Sa25*b* and Fa2*a*. Therefore, it is possible to suppress a decrease in the flow velocity of the ink when flowing into the second filter chamber Fa2, and to improve the discharge properties of air bubbles contained in the ink in the second filter chamber Fa2, so-called air bubble discharge properties.

In the recording head 10 of the present embodiment, it is preferable that the first throttle section Sa25*c*, which is a part, of which the width $Wa_1$ in the +X direction is smaller than the width $W_7$ of the first inlet Fa1_in in the +X direction, which is the first direction, is provided between the first branch section Sc1, which is the branch position, and the first inlet Fa1_in in the first branch section Sa25, which is the branch flow path. In this manner, by providing the first throttle section Sa25*c* in the first branch section Sa25, it is possible to increase the flow velocity of the ink that flows into the first filter chamber Fa1 from the first branch section Sa25, and to improve the discharge properties of the air bubbles contained in the ink in the first filter chamber Fa1.

In the recording head 10 of the present embodiment, it is preferable that the first branch section Sc25, which is the branch flow path, the first inlet Fa1_in, and the second inlet Fa2_in are disposed at the same position in the +Z direction, which is the third direction. In this manner, by providing the first branch section Sa25 at the same position as the first inlet Fa1_in and the second inlet Fa2_in in the +Z direction, it is possible to dispose the first branch position Sc1 at the same position in the +Z direction as the first inlet Fa1_in and the second inlet Fa2_in. By disposing the first branch position Sc1 at the same position in the +Z direction as the first inlet Fa1_in and the second inlet Fa2_in, it is possible to dispose the first branch position Sc1 immediately before the first filter chamber Fa1 and the second filter chamber Fa2 as compared with the configuration in which the first branch position Sc1 is disposed at the upper part on the Z-axis of the first filter chamber group Fa, that is, in the −Z direction, or at the lower part, that is, in the +Z direction. Therefore, it is possible to elongate the flow path length of the common part before the first branch position Sc1 of the first supply path Sa, and to simplify the layout of the first supply path Sa.

In the recording head 10 of the present embodiment, it is preferable that the first filter chamber Fa1 has the first outlet Fa1_out through which the ink, which is the liquid, flows out, the second filter chamber Fa2 has the second outlet Fa2_out through which the ink flows out, the first outlet Fa1_out is disposed at a part that does not overlap the second filter chamber Fa2 when viewed in the +Y direction, which is the second direction, to be far from the second filter chamber Fa2 with respect to the center Fa1*c* of the first filter chamber Fa1 in the +Y direction, and the second outlet Fa2_out is disposed at a part that does not overlap the first filter chamber Fa1 when viewed in the +Y direction to be far from the first filter chamber Fa1 with respect to the center Fa2*c* of the second filter chamber Fa2 in the +Y direction. By disposing the first outlet Fa1_out in this manner, it is possible to dispose the straight line that connects the first inlet Fa1_in and the first outlet Fa1_out to each other at a position away from the diagonal line of the first filter chamber Fa1, and it is possible to suppress occurrence of stagnation of ink in the first filter chamber Fa1. Similarly, by disposing the second outlet Fa2_out as described above, it is possible to dispose the straight line that connects the second inlet Fa2_in and the second outlet Fa2_out to each other at a position away from the diagonal line of the second filter chamber Fa2, and it is possible to suppress occurrence of stagnation of ink in the second filter chamber Fa2.

In the recording head 10 of the present embodiment, the third nozzle row Lb1 extending in the +X direction, which is the first direction; the fourth nozzle row Lb2 extending in the +X direction; the second supply flow path Sb2 for supplying ink, which is the liquid, to the third nozzle row Lb1 and the fourth nozzle row Lb2; the third filter chamber Fb1, which has the third inlet Fb1_in through which the ink flows in from the second supply flow path Sb2, and in which the ink supplied from the second supply flow path Sb2 to the third nozzle row Lb1 flows; and the fourth filter chamber Fb2, which has the fourth inlet Fb2_in through which the ink flows in from the second supply flow path Sb2, and in which the ink supplied from the second supply flow path Sb2 to the fourth nozzle row Lb2 flows, are provided, the third filter chamber Fb1 and the first filter chamber Fa1 are disposed to be adjacent to each other in the +X direction, the fourth filter chamber Fb2 and the second filter chamber Fa2 are disposed to be adjacent to each other in the +X direction, the third filter chamber Fb1 and the fourth filter chamber Fb2 are disposed to be offset from each other in the +X direction so as to partially overlap each other when viewed in the +Y direction, which is the second direction, and a part of the first filter chamber Fa1 and a part of the fourth filter chamber Fb2 overlap each other when viewed in the +Y direction, or a part of the second filter chamber Fa2 and a part of the third filter chamber Fb1 overlap each other when viewed in the +Y direction. In the present embodiment, the second filter chamber Fa2 and the third filter chamber Fb1 are disposed so as to partially overlap each other when viewed in the +Y direction, which is the second direction. In this manner, by disposing the second filter chamber Fa2 and the third filter chamber Fb1 so as to partially overlap each other when viewed in the +Y direction, the first filter chamber group Fa and the second filter chamber group Fb can be disposed close to each other in the +X direction. Therefore, the size of the recording head 10 can be reduced in the +X direction.

In the recording head 10 of the present embodiment, it is preferable that the first nozzle row La1 and the second nozzle row La2 are disposed so as to partially overlap each other when viewed in the +Y direction, which is the second direction. By disposing the first nozzle row La1 and the second nozzle row La2 so as to partially overlap each other when viewed in the +Y direction, which is the second direction, the continuous rows of the nozzles N along the +X direction can be formed by the first nozzle row La1 and the second nozzle row La2.

The ink jet type recording apparatus 1, which is the liquid ejecting apparatus of the present embodiment, includes: the above-described recording head 10; and the transport mechanism 4, which is the transport section, that transports the medium S. In the ink jet type recording apparatus 1, it is possible to reduce the variation in the discharge characteristics of the ink discharged from the recording head 10, and to improve the print quality.

Other Embodiments

Although one embodiment of the present disclosure was described above, the basic configuration of the present disclosure is not limited to the above-described one.

For example, in the present embodiment 1 described above, the configuration in which the second filter chamber Fa2 is disposed at a position offset from the first filter chamber Fa1 in the +X direction is illustrated, but the present disclosure is not particularly limited thereto, and the second filter chamber Fa2 may be disposed at a position offset from the first filter chamber Fa1 in the −X direction. Similarly, regarding the third filter chamber Fb1 and the fourth filter chamber Fb2, the fourth filter chamber Fb2 may also be disposed at a position offset from the third filter chamber Fb1 in the + and −X directions.

In Embodiment 1 described above, the ink Ia and the ink Ib having different colors are supplied to the first supply path Sa and the second supply path Sb, but the present disclosure is not particularly limited thereto, and the ink having the same color may be supplied to the first supply path Sa and the second supply path Sb.

In Embodiment 1 described above, the configuration in which the first nozzle row La1 and the second nozzle row La1 are disposed so as to partially overlap each other when viewed in the +Y direction is illustrated, but the present disclosure is not particularly limited thereto, and the first nozzle row La1 and the second nozzle row La1 may be disposed so as not to overlap each other when viewed in the +Y direction. The same applies to the third nozzle row Lb1 and the fourth nozzle row Lb2.

Figure 20:
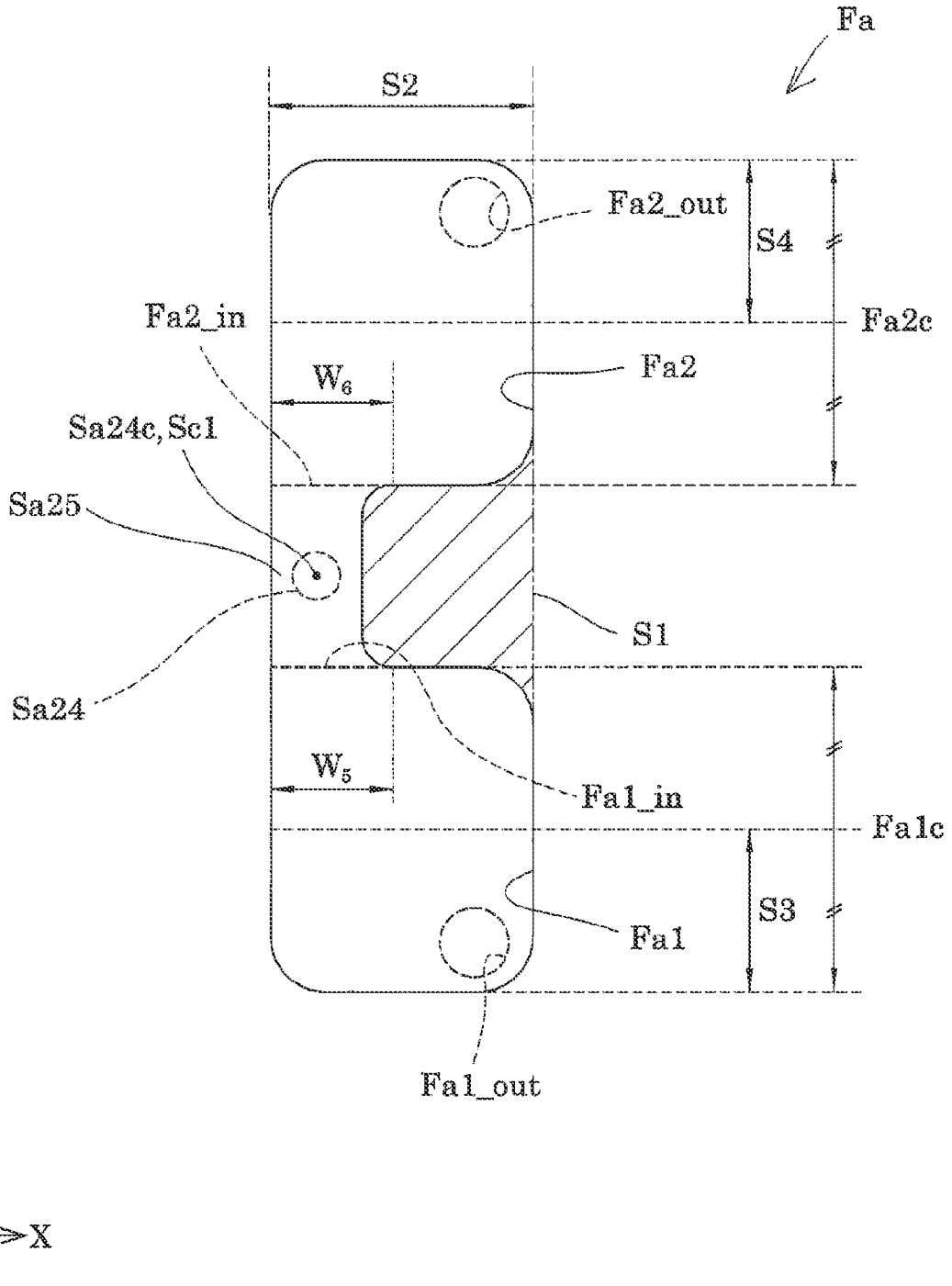
FIG. 20 is a plan view illustrating a modification example of the first filter chamber group.
Figure 21:
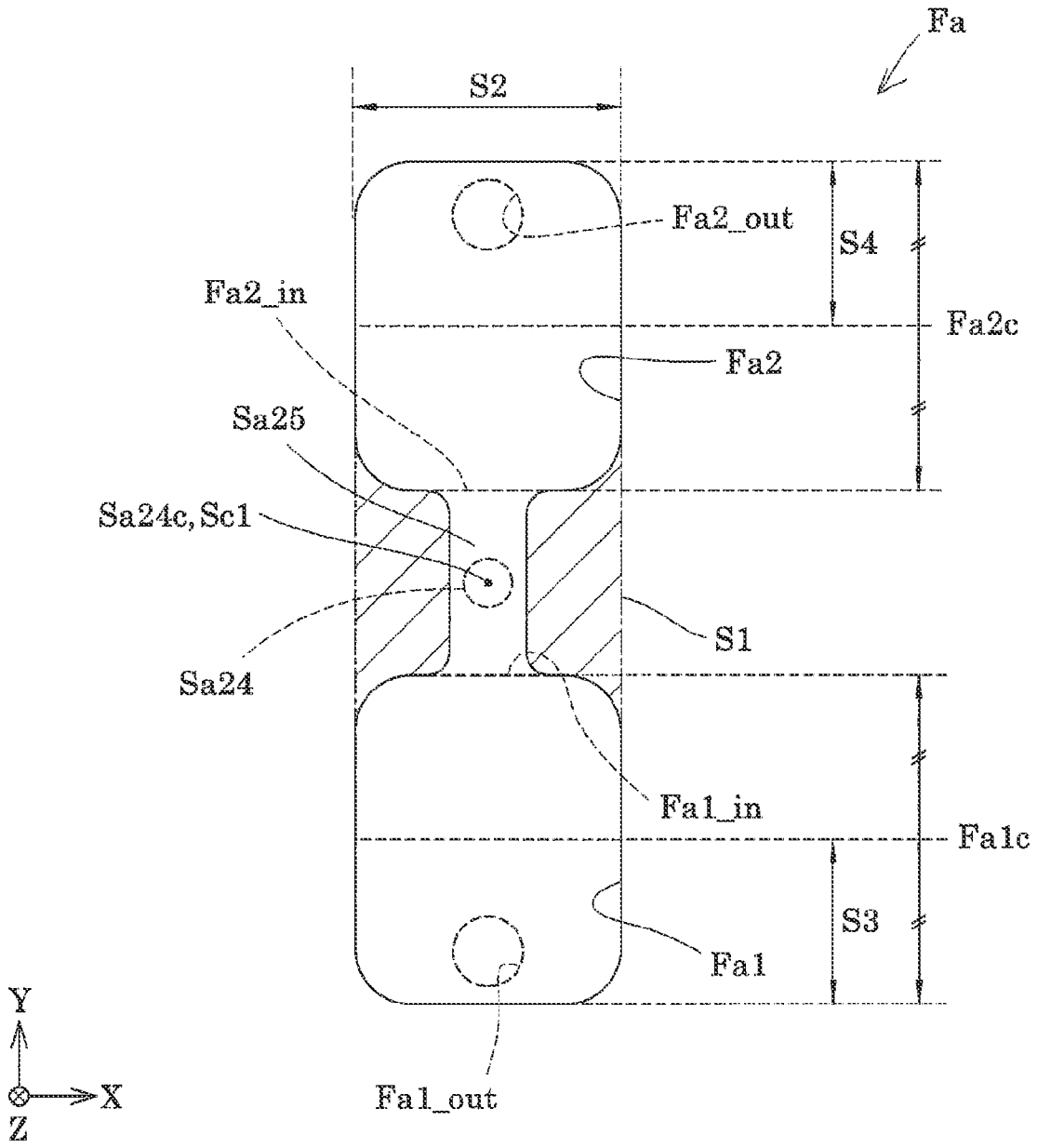
FIG. 21 is a plan view illustrating a modification example of the first filter chamber group.

In Embodiment 1 described above, the first filter chamber Fa1 and the second filter chamber Fa2 that form the first filter chamber group Fa are disposed to be offset from each other in the +X direction so as to partially overlap each other when viewed in the +Y direction, but the present disclosure is not particularly limited thereto. Here, a modification example of the first filter chamber group Fa is illustrated in FIGS. 20 and 21. FIGS. 20 and 21 are plan views illustrating a modification example of the first filter chamber group Fa.

As illustrated in FIGS. 20 and 21, the first filter chamber Fa1 and the second filter chamber Fa2 that form the first filter chamber group Fa are disposed at the same position in the +X direction so as to completely overlap each other when viewed in the +Y direction.

As illustrated in FIG. 20, the first inlet Fa1_in through which ink flows into the first filter chamber Fa1 and the second inlet Fa2_in through which ink flows into the second filter chamber Fa2 may be provided on the same side on the X-axis of the first filter chamber Fa1 and the second filter chamber Fa2, and at the end portion in the −X direction in the present embodiment.

It is preferable that the first outlet Fa1_out is disposed at the end portion in the +X direction opposite to the first inlet Fa1_in on the X-axis, and is disposed in the region S3 on the −Y direction side of the center Fa1*c* of the first filter chamber Fa1 in the +Y direction. Accordingly, it is possible to dispose the first inlet Fa1_in and the first outlet Fa1_out in the vicinity of the position away from the diagonal line of the first filter chamber Fa1, and to suppress occurrence of stagnation of ink in the first filter chamber Fa1.

It is preferable that the second outlet Fa2_out is disposed at the end portion in the +X direction opposite to the second inlet Fa2_in on the X-axis, and is disposed in the region S4 on the +Y direction side of the center Fa2*c* of the second filter chamber Fa2 in the +Y direction. Accordingly, it is possible to dispose the second inlet Fa2_in and the second outlet Fa2_out in the vicinity of the position away from the diagonal line of the second filter chamber Fa2, and to suppress occurrence of stagnation of ink in the second filter chamber Fa2.

The first inlet Fa1_in and the first outlet Fa1_out may not be disposed on the diagonal line of the first filter chamber Fa1 and in the vicinity thereof. In other words, as illustrated in FIG. 21, the first inlet Fa1_in and the first outlet Fa1_out may be disposed in the center portion in the +X direction of the first filter chamber Fa1. It is preferable that the first outlet Fa1_out is disposed in the region S3 on the −Y direction side of the center Fa1*c* of the first filter chamber Fa1 in the +Y direction. It is preferable that the second outlet Fa2_out is disposed in the region S4 on the +Y direction side of the center Fa2*c* of the second filter chamber Fa2 in the +Y direction. In this manner, when the first inlet Fa1_in, the first outlet Fa1_out, the second inlet Fa2_in, and the second outlet Fa2_out are disposed in the center portion of the first filter chamber Fa1 and the second filter chamber Fa2 in the +X direction, the stagnation of ink is likely to occur in the first filter chamber Fa1 and the second filter chamber Fa2 compared to Embodiment 1 described above and FIG. 20. Accordingly, as illustrated in Embodiment 1 described above and FIG. 20, it is preferable that the first inlet Fa1_in and the first outlet Fa1_out are disposed on the diagonal line of the first filter chamber Fa1 and in the vicinity thereof. Similarly, it is preferable that the second inlet Fa2_in and the second outlet Fa2_out are disposed on the diagonal line of the second filter chamber Fa2 and in the vicinity thereof.

The second filter chamber group Fb can also have the same configuration as those in FIGS. 20 and 21.

Figure 22:
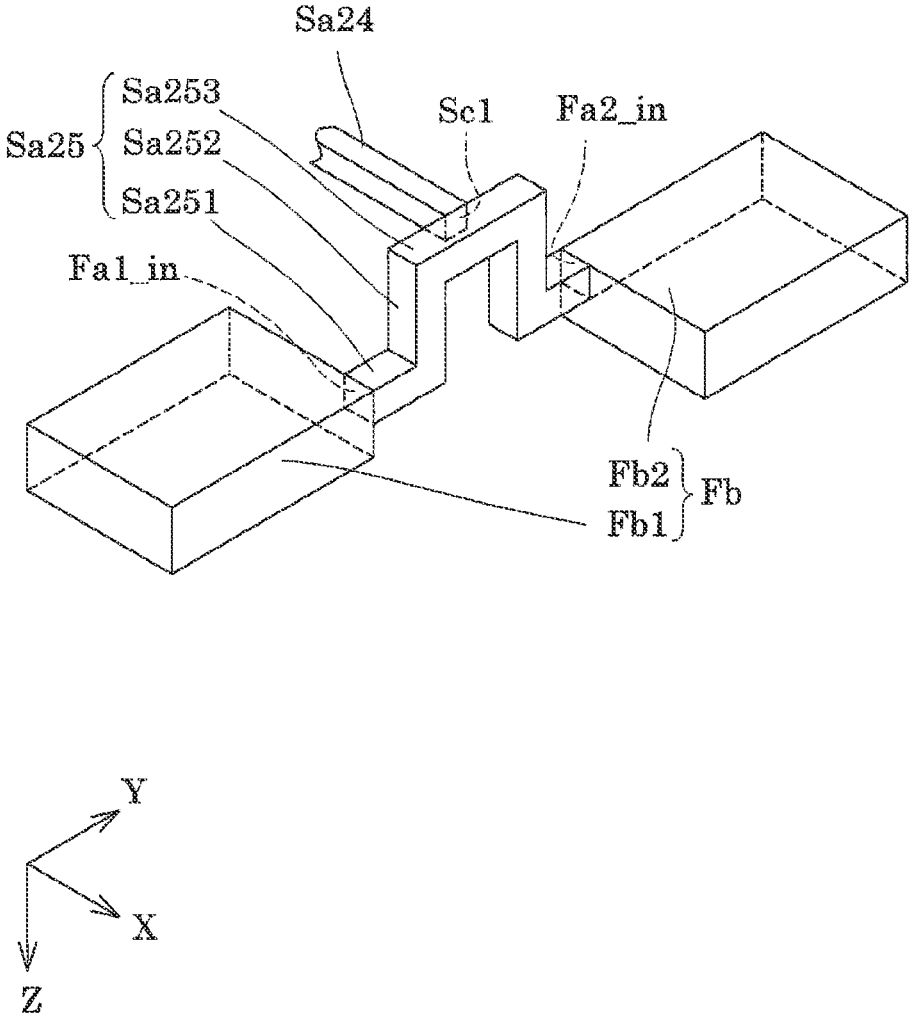
FIG. 22 is a perspective view illustrating a part of the first supply path.

In Embodiment 1 described above, the first branch section Sa25, the first inlet Fa1_in, and the second inlet Fa2_in are disposed at the same position in the +Z direction, and the present disclosure is not particularly limited thereto. Here, a modification example of the first supply path Sa is illustrated in FIG. 22. FIG. 22 is a perspective view illustrating a part of the first supply path Sa.

The first branch section Sa25 includes a pair of first flow path sections Sa251 coupled to the first inlet Fa1_in and the second inlet Fa2_in, a pair of second flow path sections Sa252 coupled to the pair of first flow path section Sa251, and a third flow path section Sa253 that couples the pair of second flow path sections Sa252 and the first coupling section Sa24 to each other.

The pair of first flow path sections Sa251 are provided at the same position in the +Z direction as the first inlet Fa1_in and the second inlet Fa2_in, and one end thereof communicates with the first inlet Fa1_in and the second inlet Fa2_in, respectively. The pair of first flow path sections Sa251 are provided along the X-axis.

The pair of second flow path sections Sa252 are parts provided along the Z-axis, and one second flow path section Sa252 couples the other end of one first flow path section Sa251 and one end of the third flow path section Sa253 to each other. The other second flow path section Sa252 is coupled to the other end of the other first flow path section Sa251 and the other end of the third flow path section Sa253 to each other.

The third flow path section Sa253 is disposed at a position different from that of the first inlet Fa1_in and the second inlet Fa2_in in the +Z direction, and in the present embodiment, on the −Z direction side of the first inlet Fa1_in and the second inlet Fa2_in. The first coupling section Sa24 is coupled to the middle of the third flow path section Sa253. In other words, the first branch position Sc1 is disposed at a position different from that of the first inlet Fa1_in and the second inlet Fa2_in in the +Z direction.

In such a configuration, similar to Embodiment 1 described above, the first branch position Sc1 is disposed between the first filter chamber Fa1 and the second filter chamber Fa2 in a plan view when viewed in the +Z direction. Therefore, as illustrated in FIG. 22, even when a part of the first branch section Sa25 is disposed at a position different from those of the first inlet Fa1_in and the second inlet Fa2_in in the +Z direction, by disposing the first branch position Sc1 in the region S1 between the first filter chamber Fa1 and the second filter chamber Fa2, it is possible to relatively shorten the flow path length of the first branch section Sa25 compared to a case where the first branch position Sc1 is disposed in a region other than the region S1. Similar to Embodiment 1 described above, it is needless to say that the flow path length of the first branch section Sa25 can be shortened when the first branch section Sa25 is disposed at the same position as the first inlet Fa1_in and the second inlet Fa2_in in the +Z direction, and it is possible to suppress the variation in the pressure loss.

In Embodiment 1 described above, the recording head 10 having two supply paths of the first supply path Sa and the second supply path Sb was illustrated, but the present disclosure is not particularly limited thereto, and the recording head 10 having three or more supply paths may be employed. Assuming that the three supply paths are the first supply path, the second supply path, and the third supply path, and the introduction section and the filter chamber group of each supply path are provided, while the introduction section and the filter chamber group of the first supply path are referred to as "first introduction section" and "first filter chamber group" described in the range of the claims, and the introduction section and the filter chamber group of the second supply path are referred to as "second introduction section" and "second filter chamber group" described in the range of the claims, the configuration described in the range of the claims may be employed. While the introduction section and the filter chamber group of the second supply path are referred to as "first introduction section" and "first filter chamber group" described in the range of the claims, and the introduction section and the filter chamber group of the third supply path are referred to as "second introduction section" and "second filter chamber group" described in the range of the claims, the configuration described in the range of the claims may also be employed to the second supply path and the third supply path. Even when there are four or more supply paths, it is needless to say that the same configuration as described above can be employed. Accordingly, even in a plurality of three or more supply paths, it is possible to reduce the variation in the flow path length, to reduce the variation in the pressure loss, and to suppress the variation in the discharge characteristics of the ink droplets.

What is claimed is:

1. A liquid ejecting head comprising:
a first nozzle row extending in a first direction;
a second nozzle row extending in the first direction;
a first supply flow path for supplying a liquid to the first nozzle row and the second nozzle row;
a first filter chamber, which has a first inlet through which the liquid flows in from the first supply flow path, and in which the liquid to be supplied from the first supply flow path to the first nozzle row flows; and
a second filter chamber, which has a second inlet through which the liquid flows in from the first supply flow path, and in which the liquid to be supplied from the first supply flow path to the second nozzle row flows, wherein
the first nozzle row and the second nozzle row are shifted from each other in both the first direction and a second direction orthogonal to the first direction,
the first nozzle row is configured to eject the liquid in a third direction orthogonal to the first direction and the second direction,
the first supply flow path has a branch flow path for distributing the liquid between the first filter chamber and the second filter chamber at a branch position,
the branch position is disposed between the first filter chamber and the second filter chamber in a plan view when viewed in the third direction, and
the first filter chamber and the second filter chamber are disposed so as to at least partially overlap each other when viewed in the second direction.

2. The liquid ejecting head according to claim 1, wherein
the first nozzle row and the second nozzle row are disposed so as to partially overlap each other when viewed in the second direction.

3. A liquid ejecting apparatus comprising:
the liquid ejecting head according to claim 1; and a transport section that transports a medium.

4. The liquid ejecting head according to claim 1, wherein
the first inlet and the second inlet are disposed at a region regarding the first direction, the region regarding the first direction where the first filter chamber and the second filter chamber overlap each other when viewed in the second direction.

5. The liquid ejecting head according to claim 1, wherein
the first inlet and the second inlet are disposed at a part where the first filter chamber and the second filter chamber overlap each other when viewed in the second direction.

6. The liquid ejecting head according to claim 5, wherein
the first inlet is disposed on a surface of the first filter chamber facing the second filter chamber, and
the second inlet is disposed on a surface of the second filter chamber facing the first filter chamber.

7. The liquid ejecting head according to claim 5, wherein the first filter chamber and the second filter chamber are shifted from each other in the first direction so as to partially overlap each other when viewed in the second direction.

8. The liquid ejecting head according to claim 7, wherein a width of a part, where the first filter chamber and the second filter chamber overlap each other when viewed in the second direction, with respect to the first direction is smaller than half a width of the first filter chamber with respect to the first direction.

9. The liquid ejecting head according to claim 7, wherein each width of the first inlet and the second inlet with respect to the first direction is smaller than a width of the part, where the first filter chamber and the second filter chamber overlap each other when viewed in the second direction, with respect to the first direction.

10. The liquid ejecting head according to claim 9, wherein a part of the branch flow path and a part of an inner wall of the first filter chamber are continuous along the second direction in the plan view, and a part of the branch flow path and a part of an inner wall of the second filter chamber are continuous along the second direction in the plan view.

11. The liquid ejecting head according to claim 7, wherein the first filter chamber has a first outlet through which the liquid flows out, the second filter chamber has a second outlet through which the liquid flows out, the first outlet is disposed at a part that does not overlap the second filter chamber when viewed in the second direction to be far from the second filter with respect to a center of the first filter chamber in the second direction, and the second outlet is disposed at a part that does not overlap the first filter chamber when viewed in the second direction to be far from the first filter with respect to a center of the second filter chamber in the second direction.

12. The liquid ejecting head according to claim 3, further comprising:

a third nozzle row extending in the first direction;

a fourth nozzle row extending in the first direction;

a second supply flow path for supplying the liquid to the third nozzle row and the fourth nozzle row;

a third filter chamber, which has a third inlet through which the liquid flows in from the second supply flow path, and in which the liquid to be supplied from the second supply flow path to the third nozzle row flows; and a fourth filter chamber, which has a fourth inlet through which the liquid flows in from the second supply flow path, and in which the liquid to be supplied from the second supply flow path to the fourth nozzle row flows, wherein the third filter chamber and the first filter chamber are disposed to be adjacent to each other, the third filter chamber is disposed in the first direction with respect to the first filter chamber, the fourth filter chamber and the second filter chamber are disposed to be adjacent to each other, the fourth filter chamber is disposed in the first direction with respect to the second filter chamber, the third filter chamber and the fourth filter chamber are shifted from each other in the first direction so as to partially overlap each other when viewed in the second direction, and a part of the first filter chamber and a part of the fourth filter chamber overlap each other when viewed in the second direction, or a part of the second filter chamber and a part of the third filter chamber overlap each other when viewed in the second direction.

13. The liquid ejecting head according to claim 5, wherein a part, of which a width with respect to the first direction is smaller than a width of the first inlet with respect to the first direction, is provided between the branch position and the first inlet in the branch flow path.

14. The liquid ejecting head according to claim 5, wherein the branch flow path, the first inlet, and the second inlet are disposed at the same position with respect to the third direction.

* * * * *